US006124084A

United States Patent [19]

Tateishi et al.

[11] Patent Number: 6,124,084

[45] Date of Patent: Sep. 26, 2000

[54] SILVER HALIDE PHOTOGRAPHIC LIGHT-SENSITIVE MATERIAL

[75] Inventors: Keiichi Tateishi; Takayoshi Kamio; Tetsu Kamosaki; Yasuhiro Ishiwata; Hideaki Naruse, all of Kanagawa, Japan

[73] Assignee: Fuji Photo Film Co., Ltd., Kanagawa, Japan

[21] Appl. No.: 09/121,852

[22] Filed: Jul. 24, 1998

[30] Foreign Application Priority Data

| | | | |
|---|---|---|---|
| Jul. 28, 1997 | [JP] | Japan | 9-201578 |
| Aug. 22, 1997 | [JP] | Japan | 9-226749 |
| Jun. 25, 1998 | [JP] | Japan | 10-179006 |

[51] Int. Cl.[7] ..... G03C 1/40

[52] U.S. Cl. ..... 430/561; 430/223; 430/226; 430/242; 430/562; 430/563

[58] Field of Search ..... 430/562, 563, 430/223, 561, 965, 242, 226

[56] References Cited

U.S. PATENT DOCUMENTS

| | | | |
|---|---|---|---|
| 5,223,387 | 6/1993 | Tsukase et al. | 430/563 |
| 5,716,754 | 2/1998 | Arnost et al. . | |

FOREIGN PATENT DOCUMENTS

| | | |
|---|---|---|
| 60-14243 | 1/1985 | Japan . |
| 60-93434 | 5/1985 | Japan . |
| 3114042 | 5/1991 | Japan . |
| 7219180 | 8/1995 | Japan . |

*Primary Examiner*—Thorl Chea
*Attorney, Agent, or Firm*—Sughrue, Mion, Zinn, Macpeak & Seas, PLLC

[57] ABSTRACT

A silver halide photographic light-sensitive material comprising a support having provided thereon a layer containing at least one cyan dye image forming compound represented by the following formula (1):

$$(\text{Dye-X})_1\text{—Y} \qquad (1)$$

wherein Dye, X, Y and q are as defined in the specification. The silver halide photographic light-sensitive material containing the cyan dye image forming compound according to the present invention provides a cyan color image excellent in fastness to light, humidity and heat.

17 Claims, No Drawings

SILVER HALIDE PHOTOGRAPHIC LIGHT-SENSITIVE MATERIAL

FIELD OF THE INVENTION

The present invention relates to a silver halide color photographic light-sensitive material containing an image forming compound comprising a cyan dye having good fastness to light, heat air and chemicals or a precursor thereof.

BACKGROUND OF THE INVENTION

A color diffusion transfer photographic process using an azo dye image forming compound which provides an azo dye having diffusibility different from that of the image forming compound per se as a result of development under a basic condition has hitherto well known in the art. Image forming compounds which release cyan dyes include, for example, those described in U.S. Pat. Nos. 3,942,987, 4,013,635, 4,273,708 and 4,268,625.

These compounds described in the above described patents have a nitro group at the p-position to the azo group. However, it has been found that there is a problem in that the nitro group is subjected to reduction to cause discoloration during the development processing. Further, azo dyes having a nitro group generally have a light reducing property and color images formed therefrom are poor in light fastness.

Moreover, when the image forming compound is incorporated into a layer containing a light-sensitive silver halide emulsion, a phenomenon of inhibiting development of the silver halide may be observed. It is considered that the reason for the phenomenon is also based on the nitro group.

In JP-A-53-66227 (the term "JP-A" as used herein means an "unexamined published Japanese patent application"), cyan azo dye image forming compounds having a trifluoromethanesulfonyl group at the p-position to the azo group are described. However, the compounds are troublesome in view of synthesis and environmental pollution, since they contains fluorine atoms. It is also desired to further improve clearness of hue and diffusibility of a dye released. In British Patent 1,490,248 and JP-A-55-40402, magenta azo dye image forming compounds comprising diazo components having two or more alkylsulfonyl groups are described. These compounds, however, have absorption in a short wavelength region and can not be used for cyan dye image forming compounds because the 2-position of the naphthol is unsubstituted or substituted with an electron withdrawing group in any of these compounds.

Recently, novel cyan azo dye image forming compounds obtained by an azo coupling reaction of diazo components having neither a nitro group nor a trifluoromethanesulfonyl group with 2-acylamino-1-naphthols have been proposed in JP-A-60-93434, JP-A-60-87134 and JP-A-60-257579. Although, the image forming compounds descried in these patents are useful as cyan dyes in comparison with conventionally known compounds, they are insufficient in color reproducibility since their color are light. Also, a large amount of the image forming compounds is necessary in order to obtain a good gray balance.

In order to solve the above described problems, azo dyes are proposed in JP-A-3-114042 and JP-A-7-219180. However, further improvement has been desired with respect to hue and light fastness.

Making an attempt to improve hue and light fastness, heterylazo dyes are developed by replacing aniline diazo components with heterocyclic diazo components as described, for example, in JP-A-60-14243, JP-A-60-140240, JP-A-62-257151, JP-A-61-44301 and U.S. Patent 5,716,754. However, these dyes are still insufficient in hue and light-fastness. Among them condensed ring isothiazolylazo dyes including typically benzisothiazolylazo dyes as described in JP-A-60-14243 and U.S. Pat. No. 5,716,754 are noticeable since they have the characteristic of absorbing longer wavelength light. However, since the naphthol derivatives which are coupler components are inappropriately selected in the compounds described in JP-A-60-14243, and since the condensed ring isothiazole derivatives which are diazo components are inappropriately selected in the compounds described in U.S. Pat. No. 5,716,754, these dyes are not preferable in color reproducibility, can not provide a good gray balance, and have insufficient light fastness. Moreover, both of these compounds have problems in that sensitivity is decreased and in that a sufficient image density can not be obtained, since they interact with silver.

As described above, cyan dyes obtained from conventionally known cyan azo dye image forming compounds have neither preferred hue nor sufficient stability to light.

SUMMARY OF THE INVENTION

Therefore, an object of the present invention is to provide a cyan image forming compound which is improved in hue and stability to light.

Another object of the present invention is to provide a silver halide color photographic light-sensitive material having improved color reproducibility and light fastness.

Other objects of the present invention will become apparent from the following description.

As a result of extensive investigations, it has been found that the above described objects of the present invention can be accomplished by a silver halide photographic light-sensitive material comprising a support having provided thereon a layer containing at least one image forming compound represented by the following formula (1A) or (1B):

$$(\text{Dye-X})_q\text{—Y} \qquad (1A)$$

wherein Dye represents a dye moiety containing one or more dyes or precursors thereof represented by the formula (2) or (3) shown below; X represents a mere bond or linking group which is dissociated corresponding to or inversely corresponding to the development of the photographic light-sensitive material; Y represents a group having a property of causing difference in the diffusibility of dye components corresponding to or inversely corresponding to the reaction of a light-sensitive silver salt having imagewise a latent image; Dye bonds to X at the position of at least one of $R^2$, $R^3$, $R^4$ and W in the formula (2) or at least one of $R^5$ and W in the formula (3); and q represents 1 or 2 and when q is 2, the Dye-X groups may be the same or different, (2)

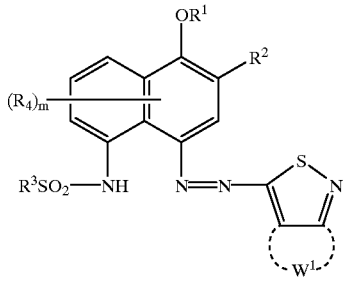

(3)

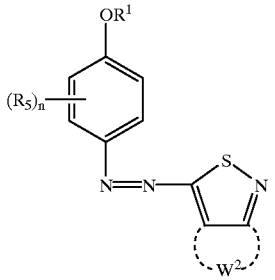

wherein $R^1$ represents a hydrogen atom, a monovalent cation or a group capable of being hydrolyzed; $R^2$ represents an acylamino group, a carbamoyl group, a sulfamoyl group, a ureido group or an alkoxycarbonylamino group; $R^3$ represents an alkyl group or an aryl group; $R^4$ represents a hydrogen atom or a substituent; $R^5$ represents a hydrogen atom or a substituent; m represents an integer of from 0 to 4; n represents an integer of from 0 to 4 and when n is 2 to 4, two $R^5$ groups may be bonded each other to form a saturated or unsaturated ring, provided that a case wherein the ring formed is a naphthalene ring is excluded; $W^1$ represents an atomic group necessary to form a 5-membered or 6-membered ring, provided that a case wherein the ring formed is a benzene ring is excluded; and $W^2$ represents an atomic group necessary to form a 5-membered or 6-membered ring;

$$(\text{Dye'-X})_q\text{—Y} \tag{1B}$$

wherein Dye' represents a dye moiety containing one or more cyan dyes or precursors thereof represented by the formula (4) shown below; X represents a mere bond or a linking group; Y represents a group which is capable of releasing Dye' corresponding to or inversely corresponding to the reaction of a light-sensitive silver salt having image-wise a latent image and has a property of causing difference in the diffusibility between the Dye' released and the compound of $(\text{Dye'-X})_q$—Y; q represents 1 or 2 and when q is 2, the Dye'-X groups may be the same or different; and X bonds to Dye' at the carbon atom of the benzene ring to which B is bonded, (4)

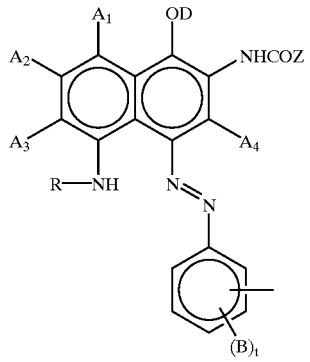

wherein $A^1$, $A^2$, $A^3$ and $A^4$ each represents a hydrogen atom, a cyano group, a carboxyl group, a sulfo group, a halogen atom, an alkyl group, an aryl group, a heterocyclic group, an acyl group, a sulfonyl group, an alkoxy group, an aryloxy group, a heteroaryloxy group, a silyloxy group, an alkylthio group, an arylthio group, a heteroarylthio group, a carbamoyl group, a sulfamoyl group, an acylamino group, a sulfonylamino group, an alkoxycarbonylamino group, an aryloxycarbonylamino group, an alkoxycarbonyloxy group, an aryloxycarbonyloxy group, an aminocarbonylamino group, an aminocarbonyloxy group, an aminosulfonylamino group, a carbamoyloxy group, an amino group, an alkoxycarbonyl group, an aryloxycarbonyl group, an acyloxy group or a sulfonyloxy group; R represents an acyl group, a sulfonyl group, an alkoxycarbonyl group, an aryloxycarbonyl group, an aminocarbonyl group or an aminosulfonyl group; D represents a hydrogen atom or a protective group of a hydroxy group which is released upon the action of a nucleophilic reagent; Z represents a hydrogen atom, an alkyl group, an aryl group, a heterocyclic group or an amino group; B represents a hydrogen atom, an alkylsulfonyl group, a phenylsulfonyl group, a cyano group, a halogen atom or a sulfamoyl group; and l represents an integer of from 1 to 4 and when l is 2 or more, the B groups may be the same or different.

DETAILED DESCRIPTION OF THE INVENTION

Now, the image forming compound represented by the formula (1A) or (1B) according to the present invention will be described in greater detail hereinafter.

The dye or precursor thereof represented by the formula (2) or (3) is described in detail below.

$R^1$ in the formula (2) or (3) represents a hydrogen atom, a monovalent cation (e.g., $Na^+$, $K^+$, $NH_4^+$, or $N(CH_3)_4^+$) or a group capable of being hydrolyzed (e.g., an acyl group, a sulfonyl group, or a dialkylphosphoryl group). Among these, a hydrogen atom is preferred.

$R^2$ represents an acylamino group (an acylamino group having preferably 12 or less, more preferably 8 or less carbon atoms, which may be substituted, e.g., acetylamino, propanoylamino, isobutyroylamino, benzoylamino, or 3-methanesulfonylaminobenzoylamino), a carbamoyl group (a carbamoyl group having preferably 12 or less, more preferably 8 or less carbon atoms, which may be substituted, e.g., methylcarbamoyl, diethylcarbamoyl, bis(2-methoxyethyl)carbamoyl, phenylcarbamoyl, or cyclohexylcarbamoyl), a sulfamoyl group (a sulfamoyl group having preferably 12 or less, more preferably 8 or less carbon atoms, which may be substituted, e.g., sulfamoyl, dimethylsulfamoyl, diethylsufamoyl, bis(2-methoxyethyl) sulfamoyl, or N-phenyl-N-methylsulfamoyl), a ureido group (a ureido group having preferably 12 or less, more preferably 8 or less carbon atoms, which may be substituted, e.g., 3-methylureido, or 3-phenylureido), or an alkoxycarbonylamino group (an alkoxycarbonylamino group having preferably 12 or less, more preferably 8 or less carbon atoms, which may be substituted, e.g., methoxycarbonylamino, 2-methoxyethoxycarbonylamino, or benzyloxycarbonylamino). Among these, an acylamino group, a carbamoyl group and a sulfamoyl group are preferred.

$R^3$ represents an alkyl group (an alkyl group having preferably 12 or less, more preferably 8 or less carbon atoms, which may be substituted, e.g., methyl, ethyl, or n-octyl), or an aryl group (an aryl group having preferably 18 or less, more preferably 10 or less carbon atoms, which may be substituted, e.g., phenyl, 3-methanesulfonylaminophenyl, or 2-methoxyphenyl).

$R^4$ and $R^5$ each represents a hydrogen atom or a substituent. The substituent includes a halogen atom (e.g., fluorine, chlorine, or bromine), a cyano group, a carboxy group, a sulfo group, an alkyl group (an alkyl group having preferably 12 or less, more preferably 8 or less carbon atoms, which may be substituted, e.g., methyl, ethyl, isopropyl, n-octyl, benzyl, cyclohexyl, trifluoromethyl, ethoxycarbonylmethyl, acetylaminomethyl, or allyl), an aryl group (an aryl group having preferably 18 or less, more preferably 10 or less carbon atoms, which may be substituted, e.g., phenyl, naphthyl, 3-methanesulfonylaminophenyl, 2-methoxyphenyl, or 4-methanesulfonylphenyl), a heterocyclic group (a heterocyclic group having preferably 18 or less, more preferably 10 or less carbon atoms, which may be substituted, e.g., 1-imidazolyl, 2-furyl, 2-pyridyl, 3-pyridyl, 3,5-dicyano-2-pyridyl, 5-tetrazolyl, 2-benzothiazolyl, 2-benzimidazolyl, 2-benzoxazolyl, 2-oxazolin-2-yl, or morpholino), an acyl group (an acyl group having preferably 12 or less, more preferably 8 or less carbon atoms, which may be substituted, e.g., acetyl, propionyl, isobutyroyl, benzoyl, 3,4-dichlorobenzoyl, or 3-acetylamino-4-methoxybenzoyl), a sulfonyl group (a sulfonyl group having preferably 12 or less, more preferably 8 or less carbon atoms, which may be substituted, e.g., methanesulfonyl, ethanesulfonyl, butanesulfonyl, or benzenesulfonyl), an alkoxy group (an alkoxy group having preferably 12 or less, more preferably 8 or less carbon atoms, which may be substituted, e.g., methoxy, ethoxy, isopropyloxy, or methoxyethoxy), an aryloxy or heterocyclic oxy group (an aryloxy or heterocyclic oxy group having preferably 18 or less, more preferably 10 or less carbon atoms, which may be substituted, e.g., phenoxy, naphthyloxy, 4-acetylaminophenoxy, pyrimidin-2-yloxy, or 2-pyridyloxy), a silyloxy group (a silyloxy group having preferably 10 or less, more preferably 7 or less carbon toms, which may be substituted, e.g., trimethylsilyloxy, or tert-butyldimethylsilyloxy), an alkylthio group (an alkylthio group having preferably 12 or less, more preferably 8 or less carbon atoms, which may be substituted, e.g., methylthio, ethylthio, tert-octylthio, ethoxycarbonylmethylthio, benzylthio, or 2-hydroxyethylthio), an arylthio or heterocyclic thio group (an arylthio or heterocyclic thio group having preferably 18 or less, more preferably 10 or less carbon atoms, which may be substituted, e.g., phenylthio, 4-chlorophenylthio, 2-n-butoxy-5-tert-octylphenylthio, 4-nitrophenylthio, 1-phenyl-5-tetrazolylthio, or 5-methanesulfonylbenzothiazol-2-ylthio), a carbamoyl group (a carbamoyl group having preferably 12 or less, more preferably 8 or less carbon atoms, which may be substituted, e.g., carbamoyl, methylcarbamoyl, dimethylcarbamoyl, bis(2-methoxyethyl) carbamoyl, diethylcarbamoyl, or phenylcarbamoyl), a sulfamoyl group (a sulfamoyl group having preferably 12 or less, more preferably 8 or less carbon atoms, which may be substituted, e.g., sulfamoyl, methylsulfamoyl, dimethylsulfamoyl, bis(2-methoxyethyl)sulfamoyl, diethylsulfamoyl, or phenylsulfamoyl), an acylamino group (an acylamino group having preferably 12 or less, more preferably 8 or less carbon atoms, which may be substituted, e.g., acetylamino, propanoylamino, isobutyroylamino, benzoylamino, 2-methanesulfonylaminobenzoylamino, or acryloylamino), a sulfonylamino group (a sulfonylamino group having preferably 12 or less, more preferably 8 or less carbon atoms, which may be substituted, e.g., methanesulfonylamino, benzenesulfonylamino, or 3-methanesulfonylaminobenzenesulfonylamino), an alkoxycarbonylamino group (an alkoxycarbonylamino group having preferably 12 or less, more preferably 8 or less carbon atoms, which may be substituted, e.g., methoxycarbonylamino, ethoxycarbonylamino, 2-methoxyethoxycarbonylamino, isobutoxycarbonylamino, benzyloxycarbonylamino, or 2-cyanoethoxycarbonylamino), an aryloxycarbonylamino group (an aryloxycarbonylamino group having preferably 12 or less, more preferably 8 or less carbon atoms, which may be substituted, e.g., phenoxycarbonylamino, 2,4-nitrophenoxycarbonylamino, or 4-tert-butoxyphenoxycarbonylamino), an alkoxycarbonyloxy group (an alkoxycarbonyloxy group having preferably 12 or less, more preferably 8 or less carbon atoms, which may be substituted, e.g., methoxycarbonyloxy, ethoxycarbonyloxy, or methoxyethoxycarbonyloxy), an aryloxycarbonyloxy group (an aryloxycarbonyloxy group having preferably 12 or less, more preferably 8 or less carbon atoms, which may be substituted, e.g., phenoxycarbonyloxy, 3-cyanophenoxycarbonyloxy, 4-acetoxyphenoxycarbonyloxy, or 4-tert-butoxycarbonylaminophenoxycarbonyloxy), an aminocarbonylamino group (an aminocarbonylamino group having preferably 12 or less, more preferably 8 or less carbon atoms, which may be substituted, e.g., methylaminocarbonylamino, morpholinocarbonylamino, diethylaminocarbonylamino, N-ethyl-N-phenylaminocarbonylamino, 4-cyanophenylaminocarbonylamino, or 4-methanesulfonylaminocarbonylamino), an aminocarbonyloxy group (an aminocarbonyloxy group having preferably 12 or less, more preferably 8 or less carbon atoms, which may be substituted, e.g., dimethylaminocarbonyloxy, or pyrrolidinocarbonyloxy), an aminosulfonylamino group (an aminosulfonylamino group having preferably 12 or less, more preferably 8 or less carbon atoms, which may be substituted, e.g., diethylaminosulfonylamino, di-n-butylaminosulfonylamino, or phenylaminosulfonylamino), a carbamoyloxy group (a carbamoyloxy group having preferably 12 or less, more preferably 8 or less carbon atoms, which may be substituted, e.g., dimethylcarbamoyloxy, or pyrrolidinocarbonyloxy), an amino group (an amino group having preferably 12 or less, more preferably 8 or less carbon atoms, which may be substituted, e.g., amino, methylamino, dimethylamino, ethylamino, N-ethyl-N-3-carboxypropylamino, N-ethyl-N-2-sulfoethylamino, phenylamino, or N-methyl-N-phenylamino), an alkoxycarbonyl group (an alkoxycarbonyl group having preferably 12 or less, more preferably 8 or less carbon atoms, which may be substituted, e.g., methoxycarbonyl, ethoxycarbonyl, or methoxyethoxycarbonyl), an aryloxycarbonyl group (an aryloxycarbonyl group having preferably 15 or less, more preferably 10 or less carbon atoms, which may be substituted, e.g., phenoxycarbonyl, or p-methoxyphenoxycarbonyl), an acyloxy group (an acyloxy group having preferably 12 or less, more preferably 8 or less carbon atoms, which may be substituted, e.g., acetoxy, benzoyloxy, 2-butenoyloxy, or 2-methylpropanoyloxy), and a sulfonyloxy group (a sulfonyloxy group having preferably 12 or less, more preferably 8 or less carbon atoms, which may be substituted, e.g., phenylsulfonyloxy, methanesulfonyloxy, 4-chlorophenylsulfonyloxy).

m and n each represents an integer of from 0 to 4, and when n is 2 to 4, two $R^5$ groups may be bonded each other to form a saturated or unsaturated ring, provided that a case wherein the ring formed is a naphthalene ring is excluded.

For $R^4$ or $R^5$, a hydrogen atom, a halogen atom, an alkyl group, a cyano group, an alkoxy group, a carbamoyl group, a sulfamoyl group, an acylamino group, a sulfonylamino group, an alkoxycarbonyl group and an alkoxycarbonylamino group are preferred. $R^4$ is particularly preferably a hydrogen atom. $R^5$ is particularly preferably an acylamino group which is bonded to the 2-position of the phenol of the dye represented by the formula (3).

$W^1$ represents an atomic group necessary to form a 5-membered or 6-membered ring. Preferably, $W^1$ represents an atomic group necessary to form a hetero ring containing at least one hetero atom selected from a nitrogen atom, a sulfur atom and an oxygen atom, for example, a thiophene ring, an isothiazole ring, a pyrazole ring, an imidazole ring, a pyridine ring, a piperidine ring, or a pyrazine ring.

$W^2$ represents an atomic group necessary to form a 5-membered or 6-membered ring. Preferably, $W^2$ represents an atomic group necessary to form a benzene ring, a thiophene ring, an isothiazole ring, a pyrazole ring, an imidazole ring, a pyridine ring, a pyrimidine ring, a pyridazine ring or a pyrazine ring. Among these, an atomic group necessary to form a benzene ring is particularly preferred.

The dye or precursor thereof represented by the formula (4) is described in detail below.

$A^1$, $A^2$, $A^3$ and $A^4$ in the formula (4) each represents a hydrogen atom, a cyano group, a carboxyl group, a sulfo group, a halogen atom (e.g., fluorine, chlorine, bromine, iodine), an alkyl group (an alkyl group having preferably 12 or less, more preferably 8 or less carbon atoms, which may be substituted, e.g., methyl, trifluoromethyl, benzyl, dimethylaminomethyl, ethoxycarbonylmethyl, acetylaminomethyl, ethyl, carboxyethyl, allyl, n-propyl, isopropyl, n-butyl, tert-butyl, tert-pentyl, cyclopentyl, n-hexyl, tert-hexyl, cyclohexyl, tert-octyl, n-decyl, n-undecyl, or n-dodecyl), an aryl group (an aryl group having preferably 18 or less, more preferably 10 or less carbon atoms, which may be substituted, e.g., phenyl, naphthyl, 3-hydroxyphenyl, 3-chlorophenyl, 4-acetylaminophenyl, 2-methanesulfonylphenyl, 4-methoxyphenyl, 4-methanesulfonylphenyl, or 2,4-dimethylphenyl), a heterocyclic group (a heterocyclic group having preferably 18 or less, more preferably 10 or less carbon atoms, which may be substituted, e.g., 1-imidazolyl, 2-furyl, 2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazolin-2-yl, or morpholino), an acyl group (an acyl group having preferably 12 or less, more preferably 8 or less carbon atoms, which may be substituted, e.g., acetyl, propionyl, butyroyl, isobutyroyl, 2,2-dimethylpropionyl, benzoyl, 3,4-dichlorobenzoyl, 3-acetylamino-4-methoxybenzoyl, or 4-methylbenzoyl), a sulfonyl group (a sulfonyl group having preferably 12 or less, more preferably 8 or less carbon atoms, which may be substituted, e.g., methanesulfonyl, ethanesulfonyl, chloromethanesulfonyl, propanesulfonyl, butanesulfonyl, n-octanesulfonyl, n-dodecanesulfonyl, benzenesulfonyl, or 4-methylphenylsulfonyl), an alkoxy group (an alkoxy group having preferably 12 or less, more preferably 8 or less carbon atoms, which may be substituted, e.g., methoxy, ethoxy, n-propyloxy, isopropyloxy, or cyclohexylmethoxy), an aryloxy or heteroaryloxy group (an aryloxy or heteroaryloxy group having preferably 18 or less, more preferably 10 or less carbon atoms, which may be substituted, e.g., phenoxy, naphthyloxy, 4-acetylaminophenoxy, pyrimidin-2-yloxy, or 2-pyridyloxy), a silyloxy group (a silyloxy group having preferably 10 or less, more preferably 7 or less carbon toms, which may be substituted, e.g., trimethylsilyloxy, or tert-butyldimethylsilyloxy), an alkylthio group (an alkylthio group having preferably 12 or less, more preferably 8 or less carbon atoms, which may be substituted, e.g., methylthio, ethylthio, n-butylthio, n-octylthio, tert-octylthio, ethoxycarbonylmethylthio, benzylthio, or 2-hydroxyethylthio), an arylthio or heterocyclic thio group (an arylthio or heterocyclic thio group having preferably 18 or less, more preferably 10 or less carbon atoms, which may be substituted, e.g., phenylthio, 4-chlorophenylthio, 2-n-butoxy-5-tert-octylphenylthio, 4-nitrophenylthio, 2-nitrophenylthio, 4-acetylaminophenylthio, 1-phenyl-5-tetrazolylthio, or 5-methanesulfonylbenzothiazol-2-yl), a carbamoyl group (a carbamoyl group having preferably 12 or less, more preferably 8 or less carbon atoms, which may be substituted, e.g., carbamoyl, methylcarbamoyl, dimethylcarbamoyl, bis(2-methoxyethyl)carbamoyl, diethylcarbamoyl, cyclohexylcarbamoyl, or di-n-octylcarbamoyl), a sulfamoyl group (a sulfamoyl group having preferably 12 or less, more preferably 8 or less carbon atoms, which may be substituted, e.g., sulfamoyl, methylsulfamoyl, dimethylsulfamoyl, bis(2-methoxyethyl) sulfamoyl, diethylsulfamoyl, di-n-butylsulfamoyl, methyl-n-octylsulfamoyl, 3-ethoxypropylmethylsulfamoyl, or N-phenyl-N-methylsulfamoyl), an acylamino group (an acylamino group having preferably 12 or less, more preferably 8 or less carbon atoms, which may be substituted, e.g., acetylamino, 2-carboxybenzoylamino, 3-nitrobenzoylamino, 3-diethylaminopropanoylamino, or acryloylamino), a sulfonylamino group (a sulfonylamino group having preferably 12 or less, more preferably 8 or less carbon atoms, which may be substituted, e.g., methanesulfonylamino, benzenesulfonylamino, or 3-methanesulfonylaminobenzenesulfonylamino), an alkoxycarbonylamino group (an alkoxycarbonylamino group having preferably 12 or less, more preferably 8 or less carbon atoms, which may be substituted, e.g., methoxycarbonylamino, ethoxycarbonylamino, 2-methoxyethoxycarbonylamino, isobutoxycarbonylamino, benzyloxycarbonylamino, tert-butoxycarbonylamino, or 2-cyanoethoxycarbonylamino), an aryloxycarbonylamino group (an aryloxycarbonylamino group having preferably 12 or less, more preferably 8 or less carbon atoms, which may be substituted, e.g., phenoxycarbonylamino, 2,4-nitrophenoxycarbonylamino, or 4-tert-butoxyphenoxycarbonylamino), an alkoxycarbonyloxy group (an alkoxycarbonyloxy group having preferably 12 or less, more preferably 8 or less carbon atoms, which may be substituted, e.g., methoxycarbonyloxy, ethoxycarbonyloxy, or methoxyethoxycarbonyloxy), an aryloxycarbonyloxy group (an aryloxycarbonyloxy group having preferably 12 or less, more preferably 8 or less carbon atoms, which may be substituted, e.g., phenoxycarbonyloxy, 3-cyanophenoxycarbonyloxy, 4-acetoxyphenoxycarbonyloxy, or 4-tert-butoxycarbonylaminophenoxycarbonyloxy), an aminocarbonylamino group (an aminocarbonylamino group having preferably 12 or less, more preferably 8 or less carbon atoms, which may be substituted, e.g., methylaminocarbonylamino, morpholinocarbonylamino, diethylaminocarbonylamino, N-ethyl-N-phenylaminocarbonylamino, 4-cyanophenylaminocarbonylamino, or 4-methanesulfonylaminocarbonylamino), an aminocarbonyloxy group (an aminocarbonyloxy group having preferably 12 or less, more preferably 8 or less carbon atoms, which may be substituted, e.g., dimethylaminocarbonyloxy, or pyrrolidinocarbonyloxy), an aminosulfonylamino group (an aminosulfonylamino group having preferably 12 or less, more preferably 8 or less carbon atoms, which may be substituted, e.g., diethylaminosulfonylamino, di-n-butylaminosulfonylamino, or phenylaminosulfonylamino), a carbamoyloxy group (a carbamoyloxy group having preferably 12 or less, more preferably 8 or less carbon atoms, which may be substituted, e.g., dimethylaminocarbonyloxy, or pyrrolidinocarbonyloxy), an amino group (an amino group having preferably 12 or less, more preferably 8 or less carbon atoms, which may be substituted, e.g., amino, methylamino, dimethylamino, ethylamino, ethyl-3-carboxypropylamino, ethyl-2-sulfoethylamino, phenylamino, methylphenylamino, or methyloctylamino), an alkoxycarbonyl group (an alkoxycarbonyl group having preferably 10 or less, more preferably 6 or less carbon atoms, which may be substituted, e.g., methoxycarbonyl, ethoxycarbonyl, or methoxyethoxycarbonyl), an aryloxycarbonyl group (an aryloxycarbonyl group having preferably 15 or less, more preferably 10 or less carbon atoms, which may be substituted, e.g., phenoxycarbonyl, or p-methoxyphenoxycarbonyl), an acyloxy group (an acyloxy group having preferably 12 or less, more preferably 8 or less carbon atoms, which may be substituted, e.g., acetoxy, benzoyloxy, 2-butenoyloxy, or 2-methylpropanoyloxy), or a sulfonyloxy group (a sulfonyloxy group having preferably 12 or less, more preferably 8 or less carbon atoms, which may be substituted, e.g., phenylsulfonyloxy, methanesulfonyloxy, chloromethanesulfonyloxy, 4-chlorophenylsulfonyloxy, or dodecylsulfonyloxy).

Among these, a hydrogen atom, a cyano group a halogen atom, an alkyl group, an alkoxy group, a carbamoyl group, a sulfamoyl group, an acylamino group, a sulfonylamino group, an aminosulfonylamino group, an alkoxycarbonylamino group, an aryloxycarbonylamino group and an aminocarbonylamino group are preferred.

R presents an acyl group (an acyl group having preferably 12 or less, more preferably 8 or less carbon atoms, which may be substituted, e.g., acetyl, propionyl, butyroyl, isobutyroyl, 2,2-dimethylpropionyl, benzoyl, 3,4-dichlorobenzoyl, 3-acetylamino-4-methoxybenzoyl, or 4-methylbenzoyl), a sulfonyl group (a sulfonyl group having preferably 12 or less, more preferably 8 or less carbon atoms, which may be substituted, e.g., methanesulfonyl, ethanesulfonyl, chloromethanesulfonyl, propanesulfonyl, butanesulfonyl, n-octanesulfonyl, n-dodecanesulfonyl, benzenesulfonyl, or 3-methanesulfonylaminophenylsulfonyl), an alkoxycarbonyl group (an alkoxycarbonyl group having preferably 10 or less, more preferably 6 or less carbon atoms, which may be substituted, e.g., methoxycarbonyl, ethoxycarbonyl, methoxyethoxycarbonyl, or isobutyloxycarbonyl), an aryloxycarbonyl group (an aryloxycarbonyl group having preferably 15 or less, more preferably 10 or less carbon atoms, which may be substituted, e.g., phenoxycarbonyl, or p-methoxyphenoxycarbonyl), an aminocarbonyl group (an aminocarbonyl group having preferably 12 or less, more preferably 8 or less carbon atoms, which may be substituted, e.g., methylaminocarbonyl, morpholinocarbonyl, diethylaminocarbonyl, N-ethyl-N-phenylaminocarbonyl, 4-cyanophenylaminocarbonyl, or 4-methanesulfonylaminocarbonyl), or an aminosulfonyl group (an aminosulfonyl group having preferably 12 or less, more preferably 8 or less carbon atoms, which may be substituted, e.g., diethylaminosulfonyl, di-n-butylaminosulfonyl, or phenylaminosulfonyl).

D represents a hydrogen atom or a protective group of a hydroxy group which is released upon the action of a nucleophilic reagent, for example, an acyl group (e.g., acetyl, or benzoyl), a G-$CH_2CH_2$— group (wherein G represents an electron withdrawing group (e.g., cyano, or sulfonyl)), or a G-CH═CH— group (wherein G represents an electron withdrawing group (e.g., cyano, or sulfonyl)).

Z represents a hydrogen atom, an alkyl group including a substituted alkyl group, an aryl group including a substituted aryl group, a heterocyclic group including a substituted heterocyclic group or an amino group including a substituted amino group.

Among these, an alkyl group (an alkyl group having preferably 12 or less, more preferably 8 or less carbon atoms, which may be substituted, e.g., methyl, trifluoromethyl, benzyl, dimethylaminomethyl, ethoxycarbonylmethyl, acetylaminomethyl, ethyl, carboxyethyl, allyl, n-propyl, isopropyl, n-butyl, tert-butyl, tert-pentyl, cyclopentyl, n-hexyl, tert-hexyl, cyclohexyl, tert-octyl, n-decyl, n-undecyl, or n-dodecyl) and an aryl group (an aryl group having preferably 18 or less, more preferably 10 or less carbon atoms, which may be substituted, e.g., phenyl, naphthyl, 3-hydroxyphenyl, 3-chlorophenyl, 4-acetylaminophenyl, 2-methanesulfonylaminophenyl, 4-methoxyphenyl, 4-methanesulfonylphenyl, or 2,6-dimethoxyphenyl) are preferred.

B represents a hydrogen atom, an alkylsulfonyl group including a substituted alkylsulfonyl group, a phenylsulfonyl group including a substituted phenylsulfonyl group, a cyano group, a halogen atom or a sulfamoyl group including a substituted sulfamoyl group.

Among these groups, a hydrogen atom, a methanesulfonyl group, a phenylsulfonyl group, a cyano group, a halogen atom (e.g., fluorine, chlorine, bromine, iodine) and a sulfamoyl group are preferred.

Further, a case wherein at least one of the B groups is a group having a Hammett's substituent constant sigma para value of 0.3 or more is particularly preferred.

In the formula (4), l represents an integer from 1 to 4 and when l is 2 or more, the B groups may be the same or different.

In the formula (1A) or (1B), q represents 1 or 2 and when q is 2, the Dye-X groups in the formula (1A) or the Dye'-X groups in the formula (1B) may be the same or different, respectively.

In the formula (1A), Dye bonds to X at the position of at least one of $R^3$, $R^4$, $R^5$, $W^1$ and $W^2$ in the formula (2) or (3).

In the formula (1B), X may essentially bond to any position (i.e., o-, m-, or p-position) of the benzene ring to which B is bonded.

In the formula (1A) or (1B), X represents a mere bond or a linking group which is dissociated corresponding to or inversely corresponding to development. Representative examples of the linking group represented by X include a group represented by —N($J^1$)- (wherein $J^1$ represents a hydrogen atom, an alkyl group or a substituted alkyl group), —$SO_2$—, —CO—, an alkylene group, a substituted alkylene group, a phenylene group, a substituted phenylene group, a naphthylene group, a substituted naphthylene group, —O—, —SO— and a group obtained by combining two or more of these divalent groups. Among these, a group represented by —$NJ^1$-$SO_2$—, a group represented by —$NJ^1$-CO— and a group represented by $J^2$-$(L)_k$-$(J^3)_p$-, wherein $J^2$ and $J^3$ each represents an alkylene group, a substituted alkylene group, a phenylene group, a substituted phenylene group, a naphthylene group or a substituted naphthylene group; L represents —O—, —CO—, —SO—, —$SO_2$—, —$SO_2$NH—, —NH$SO_2$—, —CONH— or —NHCO—; k represents 0 or 1; and p represents 1 or 0 are preferred.

A combination of -$J^1$-$SO_2$— or —$NJ^1$-CO— with -$J^2$-$(L)_k$-$(J^3)_p$- is also preferred.

Preferably, the dye moiety and Y are connected in the form of Dye-$SO_2$NH—Y in the formula (1A) or in the form of Dye'-$SO_2$NH—Y in the formula (1B).

Of the cyan dyes or precursors thereof represented by the formula (4), those represented by the following formula (4') are preferred.

(4')

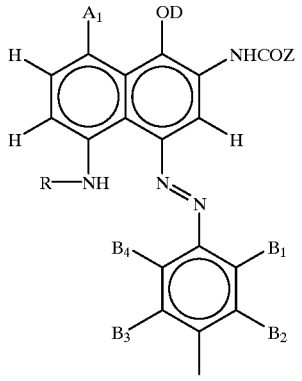

wherein $A^1$ represents a hydrogen atom, a cyano group, a halogen atom, an alkyl group, an alkoxy group, a carbamoyl group, a sulfamoyl group, an acylamino group, a sulfonylamino group, an alkoxycarbonylamino group, an aryloxycarbonylamino group, an aminocarbonylamino group, or an aminosulfonylamino group,; R, D, and Z have the same meanings as those defined in the formula (4), respectively; and $B^1$, $B^2$, $B^3$ and $B^4$ each has the same meaning as B defined in the formula (4).

In the formula (4'), $A^1$ preferably represents a hydrogen atom, a carbamoyl group or an acylamino group.

In the formula (4'), R preferably represents a sulfonyl group (a sulfonyl group having preferably 8 or less carbon atoms, which may be substituted, e.g., methanesulfonyl, butanesulfonyl, n-octanesulfonyl, benzenesulfonyl, or 3-methanesulfonylaminophenylsulfonyl, 4-methanesulfonylaminophenylsulfonyl, 3-butanesulfonylaminophenylsulfonyl, 3-(n-octanesulfonylamino)phenylsulfonyl, or 3,5-dimethanesulfonylaminophenylsulfonyl.

In the formula (4'), preferred examples of Z include those described for Z in the formula (4). More preferably, Z represents an alkyl group (an alkyl group having preferably 3 or less carbon atoms, which may be substituted, e.g., methyl, trifluoromethyl, ethyl, n-propyl, or isopropyl) or an aryl group (an aryl group having preferably 10 or less carbon atoms, which may be substituted, e.g., phenyl, 2-methanesulfonylaminophenyl, 4-methoxyphenyl, 4-methanesulfonylphenyl, or 2,6-dimethoxyphenyl).

In the formula (4'), $B^1$, $B^2$, $B^3$ and $B^4$ each represents a hydrogen atom, an alkylsulfonyl group including a substituted alkylsulfonyl group, a phenylsulfonyl group including a substituted phenylsulfonyl group, a cyano group, a halogen atom or a sulfamoyl group including a substituted sulfamoyl group.

Among these groups, a hydrogen atom, a methanesulfonyl group, phenylsulfonyl group, a cyano group, a halogen atom (e.g., fluorine, chlorine, bromine, iodine) and a sulfamoyl group are preferred.

Further, a case wherein at least one of the $B^1$, $B^2$, $B^3$ and $B^4$ groups is a group having a Hammett's substituent constant sigma para value of 0.3 or more is preferred.

A case wherein $B^1$ represents a methanesulfonyl group, a phenylsulfonyl group or a cyano group is particularly preferred.

Now, Y in the formula (1A) or (1B) is described below.

Y represents a group having a property of dissociating the Y—X bond corresponding to or inversely corresponding to a light-sensitive silver halide having a latent image. Such a group is known in the field of photographic chemistry utilizing diffusion transfer of a dye and examples thereof are described in U.S. Pat. No. 5,021,334 (corresponding to JP-A-2-184852).

Y is described in detail. In the formulae described below, X is also included.

(1) First, Y includes a negative acting releaser which releases a photographically useful group corresponding to development.

Known examples of Y classified into the negative acting releaser include a group of releasers which each releases a photographically useful group from an oxidation product.

Y of this type is preferably represented by the following formula (Y-1).

(Y-1)

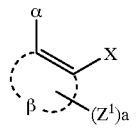

wherein β represents a nonmetallic atomic group necessary for forming a benzene ring, the benzene ring may be condensed with a saturated or unsaturated carbon ring or heterocyclic ring; α represents -$OZ^2$ or —$NHZ^3$, wherein $Z^2$ represents a hydrogen atom or a group which generates a hydroxyl group by hydrolysis; and $Z^3$ represents a hydrogen atom, an alkyl group, an aryl group or a group which generates an amino group by hydrolysis; $Z^1$ represents an alkyl group, an aryl group, an aralkyl group, an alkoxy group, an alkylthio group, an aryloxy group, an arylthio group, an acyl group, a sulfonyl group, an acylamino group, a sulfonylamino group, a carbamoyl group, a sulfamoyl group, a ureido group, a urethane group, a heterocyclic group, which groups each may have a substituent, a cyano group or a halogen atom; a represents a positive integer, and when two or more $Z^1$ groups are present, they may be the same or different; and X represents a group represented by —$NHSO_2Z^4$, wherein $Z^4$ represents a divalent group.

Among the groups represented by formula (Y-1), those represented by the following formula (Y-2) or (Y-3) are preferred.

(Y-2)

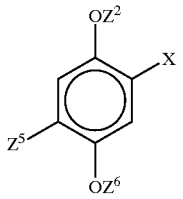

(Y-3)

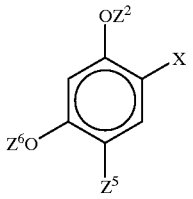

wherein $Z^2$ and X each has the same meaning as defined in formula (Y-1); and $Z^5$ and $Z^6$ each represents an alkyl group, an aryl group or an aralkyl group, which groups each may have a substituent.

More preferably, $Z^5$ is a secondary or tertiary alkyl group and the total number of carbon atoms included in $Z^5$ and $Z^6$ is from 20 to 50.

Specific examples thereof include those described in U.S. Pat. Nos. 4,055,428 and 4,336,322, JP-A-51-113624, JP-A-56-16131, JP-A-56-71061, JP-A-56-71060, JP-A-56-71072, JP-A-56-73057, JP-A-57-650, JP-A-57-4043, JP-A-59-60439, JP-B-56-17656 and JP-B-60-25780.

Another example of Y is a group represented by the following formula (Y-4).

(Y-4)

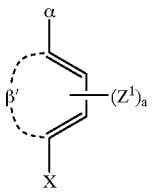

wherein α, X, $Z^1$ and a each has the same meaning as defined in formula (Y-1); and β represents a nonmetallic atomic group necessary for forming a benzene ring, and the benzene ring may be condensed with a saturated or unsaturated carbon ring or heterocyclic ring.

Among the groups represented by formula (Y-4), those wherein α is —$OZ^2$ and β' forms a naphthalene skeleton are preferred. Specific examples thereof include those described in U.S. Pat. Nos. 3,928,312 and 4,135,929.

Examples of the releaser which releases a photographically useful group by the same reaction as in the case of formula (Y-1) or (Y-2) include the groups described in JP-A-51-104343, JP-A-53-46730, JP-A-54-130122, JP-A-57-85055, JP-A-53-3819, JP-A-54-48534, JP-A-49-64436, JP-A-57-20735, JP-B-48-32129, JP-B-48-39165 and U.S. Pat. No. 3,443,934.

The compound which releases a photographically useful group from an oxidation product in a different mechanism, includes hydroquinone derivatives represented by the following formulae (Y-5) and (Y-6).

(Y-5)

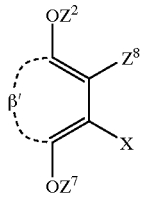

(Y-6)

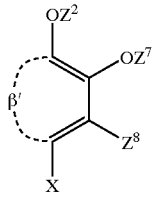

wherein β' has the same meaning as defined in formula (Y-4); $Z^2$ has the same meaning as defined in formula (Y-1); $Z^7$ has the same meaning as $Z^2$; $Z^8$ represents a substituent described for $Z^1$ or a hydrogen atom; and $Z^2$ and $Z^7$ may be the same or different. Specific examples of the compound are described in U.S. Pat. No. 3,725,062.

The above-described hydroquinone derivative releaser may have a nucleophilic group in the molecule. Specific examples thereof are described in JP-A-4-97347.

Other examples of Y include p-hydroxydiphenylamine derivatives described in U.S. Pat. No. 3,443,939 and hydrazine derivatives described in U.S. Pat. Nos. 3,844,785 and 4,684,604, and *Research Disclosure,* No. 128, page 22.

The negative acting releaser further includes those represented by the following formula (Y-7).

Coup-X (Y-7)

wherein Coup represents a group capable of coupling with an oxidation product of a p-phenylenediamine or a p-aminophenol, namely, a group known as a photographic coupler. Specific examples thereof include those described in British Patent 1,330,524.

(2) Next, as Y of another type, a positive acting releaser which releases a photographically useful group inversely corresponding to development is described.

The positive acting releaser includes releasers which each exerts a function upon reduction at the time of processing. Preferred examples of Y of this type include those represented by the following formula (Y-8).

(Y-8)

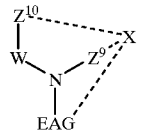

wherein EAG represents a group of accepting an electron from a reducing substance; N represents a nitrogen atom; W represents an oxygen atom, a sulfur atom or —$NZ^{11}$-, wherein the N—W bond is cleaved when EAG accepts an electron and $Z^{11}$ represents an alkyl group or an aryl group; $Z^9$ and $Z^{10}$ each represents a mere bond or a substituent other than a hydrogen atom; the solid line indicates that the groups are bonded; and the dashed line indicates that at least one pair is bonded.

Among the groups represents by formula (Y-8), those represented by the following formula (Y-9) are preferred.

(Y-9)

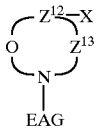

wherein O represents an oxygen atom (namely, W in formula (Y-8) is an oxygen atom); $Z^{12}$ represents an atomic group having properties such that a heterocyclic ring containing the N—O bond is formed and subsequent to the cleavage of the N—O bond, the $Z^{12}$-X bond is broken, and $Z^{12}$ may have a substituent or may be condensed with a saturated or unsaturated ring; and $Z^{13}$ represents —CO— or —$SO_2$—.

Among the groups represented by formula (Y-9), those represented by the following formula (Y-10) are more preferred.

(Y-10)

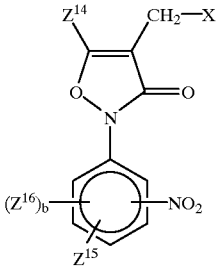

wherein $Z^{14}$ represents an alkyl group, an aryl group or an aralkyl group; $Z^{15}$ represents a carbamoyl group or a sulfamoyl group; $Z^{16}$ represents an alkyl group, an aryl group, an aralkyl group, an alkoxy group, an alkylthio group, an aryloxy group, an arylthio group, a halogen atom, a cyano group or a nitro group; b represents an integer of from 0 to 3; and the substitution position of the nitro group is the ortho- or para-position to the nitrogen atom.

Further, those wherein $Z^{15}$ is a carbamoyl or sulfamoyl group substituted with an alkyl group having from 12 to 30 carbon atoms are particularly preferred.

Specific examples of Y of this type are described in JP-A-62-215270 and U.S. Pat. No. 4,783,396.

Other examples of the positive acting releaser which exerts a function upon reduction, include BEND compounds described in U.S. Pat. Nos. 4,139,379 and 4,139,389, Carquin compounds described in British Patent 11,445 and releasers described in JP-A-54-126535 and JP-A-57-84453.

When the releaser to be reduced as represented by Y of formula (Y-8) is used, a reducing agent is used in combination, however, an LDA compound containing a reducing group in the same molecule may also be used. This is described in U.S. Pat. No. 4,551,423.

The positive acting releaser also includes those which are incorporated into a light-sensitive material in a reduced form and deactivated upon oxidation at the time of processing.

Examples of the releaser of this type include Fields compounds described in JP-A-51-63618 and U.S. Pat. No. 3,980,479 and Hinshaw compounds described in JP-A-49-111628, JP-A-52-4819 and U.S. Pat. No. 4,199,354.

Examples of Y of this type also include a group represented by formula (Y-11).

(Y-11)

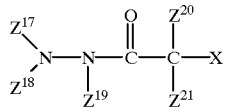

wherein $Z^{17}$ and $Z^{19}$ each represents a hydrogen atom, a substituted or unsubstituted acyl, alkoxycarbonyl or aryloxycarbonyl group; $Z^{18}$ represents an alkyl group, an aryl group, an aralkyl group, an acyl group, an alkoxycarbonyl group, an aryloxycarbonyl group, a carbamoyl group, a sulfonyl group or a sulfamoyl group; $Z^{20}$ and $Z^{21}$ each represents a hydrogen atom, a substituted or unsubstituted alkyl, aryl or aralkyl group. Specific examples of the group include those described in JP-A-62-245270 and JP-A-63-46450.

The positive acting releaser having a different mechanism includes a thiazolidine type releaser. Specific examples thereof are described in U.S. Pat. No. 4,468,451.

Specific examples of the compound represented by formula (1A) or (1B) which can be used in the present invention are set forth below, but the present invention should not be construed as being limited thereto.

(Compound 1a)

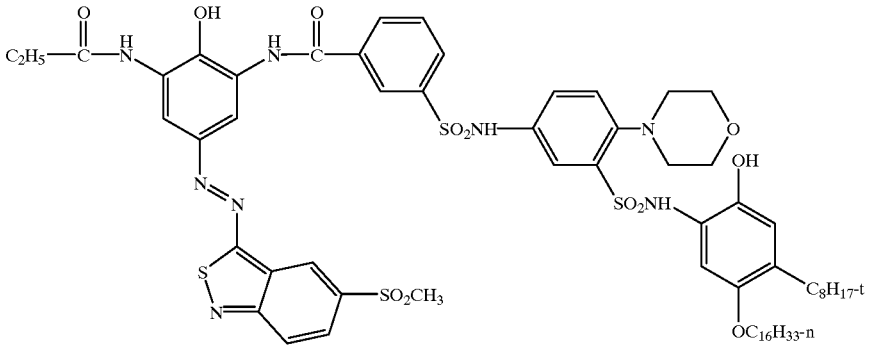

-continued
(Compound 2a)
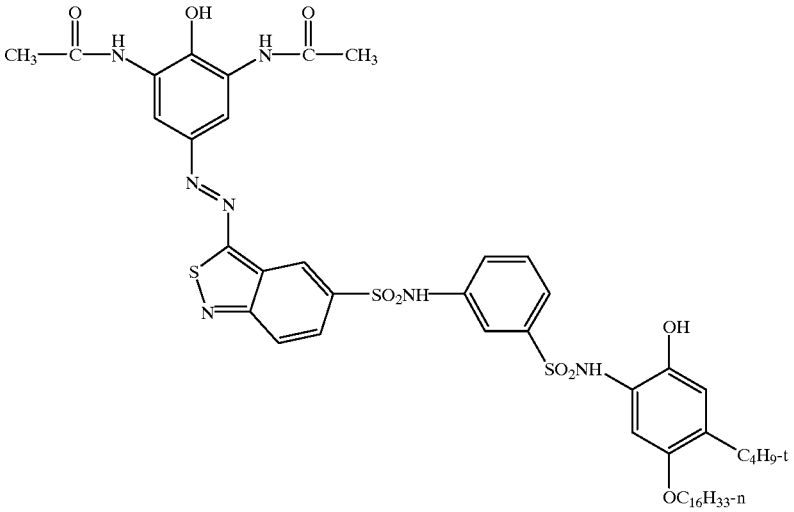
(Compound 3a)
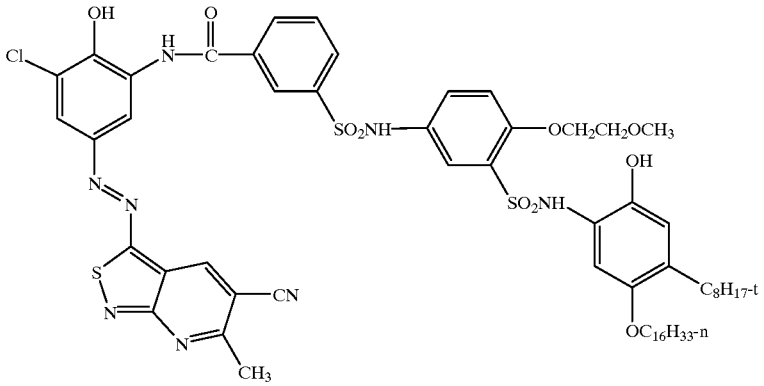
(Compound 4a)
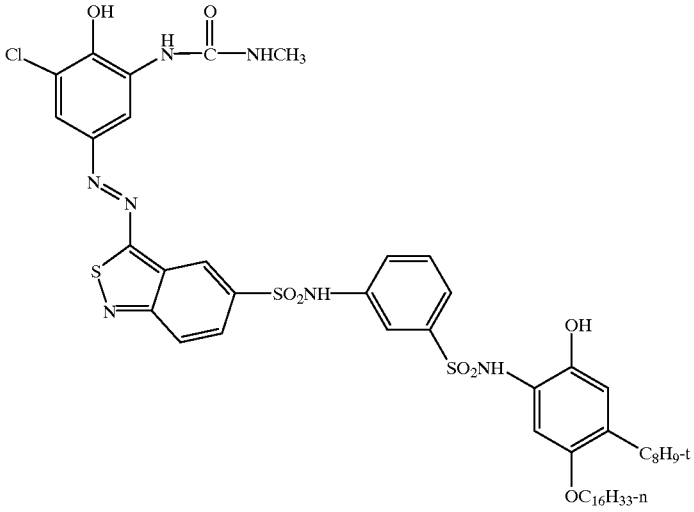

-continued
(Compound 5a)
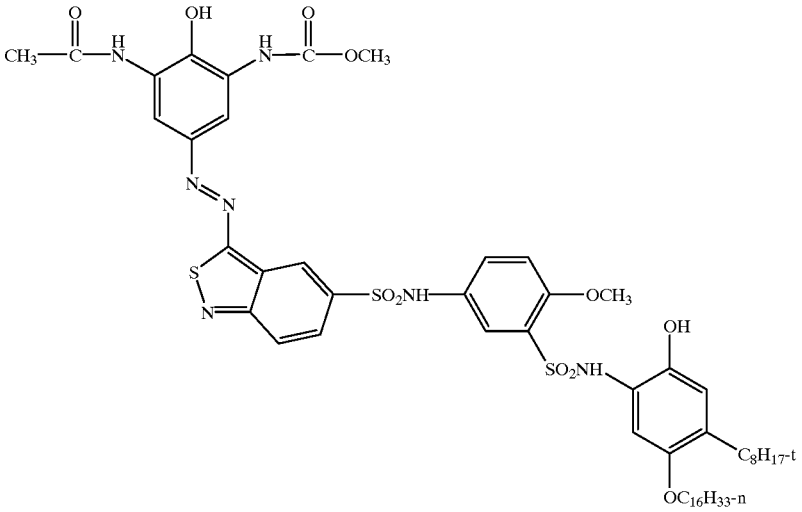
(Compound 6a)
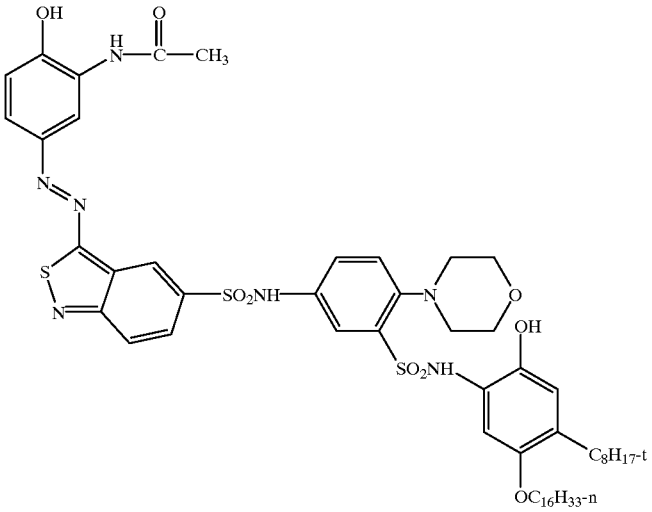
(Compound 7a)
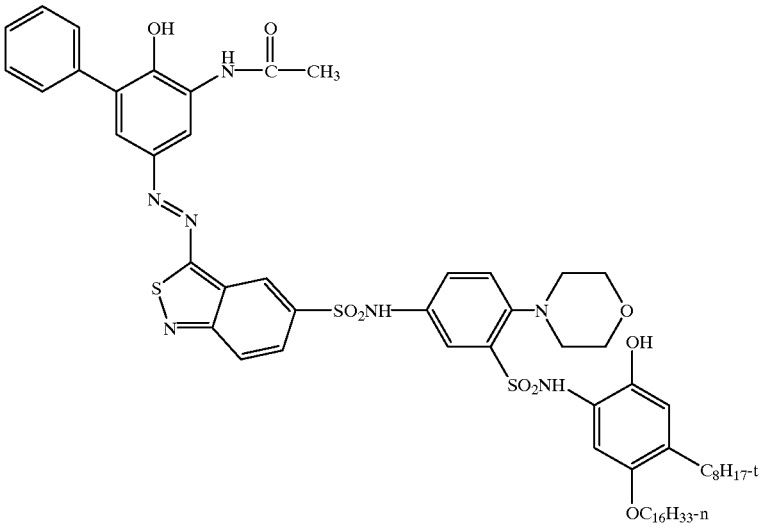

-continued
(Compound 8a)
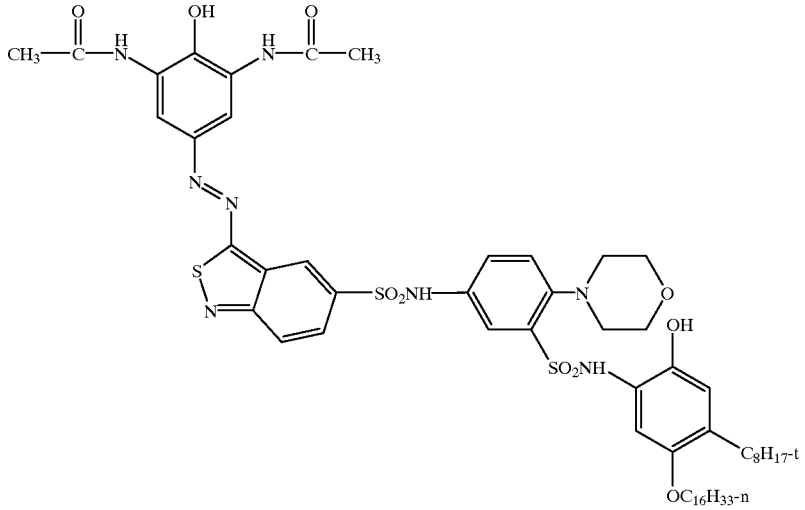
(Compound 9a)
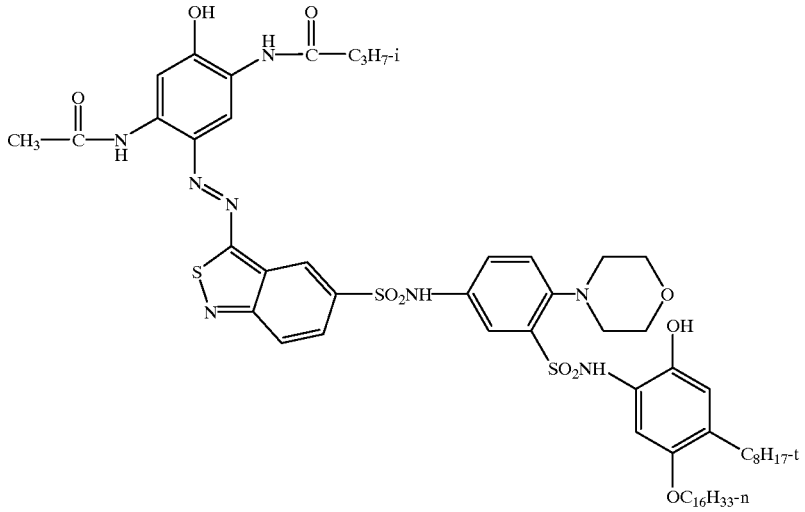
(Compound 10a)
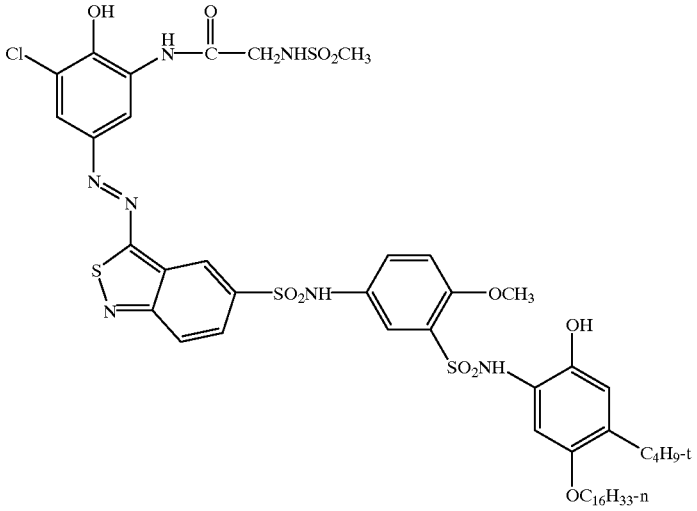

-continued
(Compound 11a)
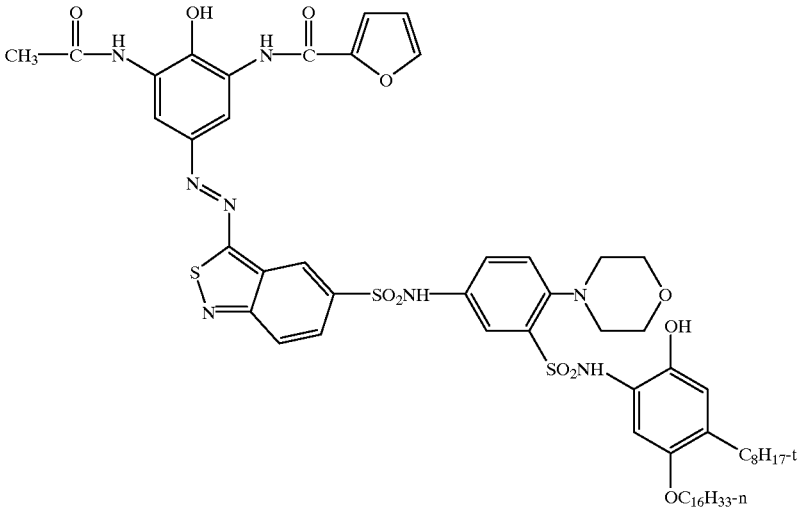
(Compound 12a)
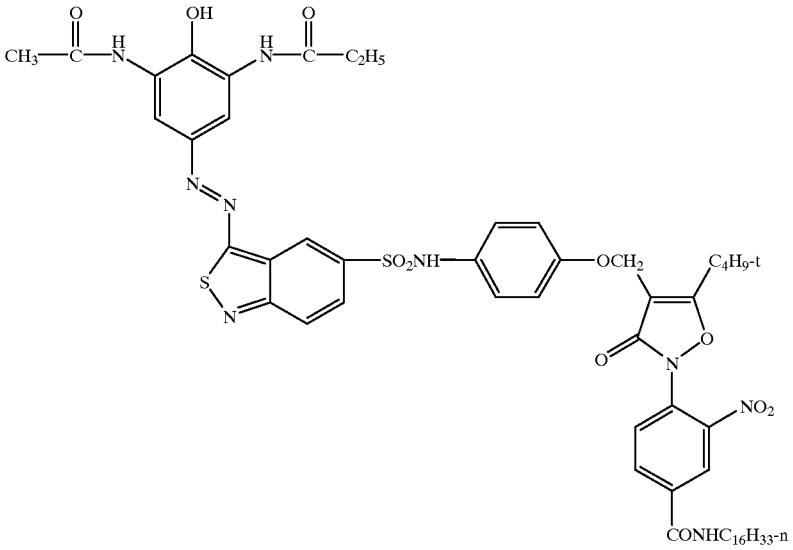
(Compound 13a)
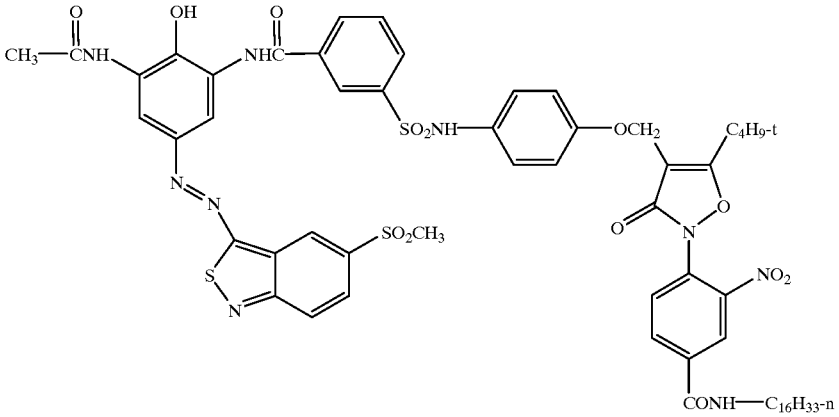

-continued
(Compound 14a)
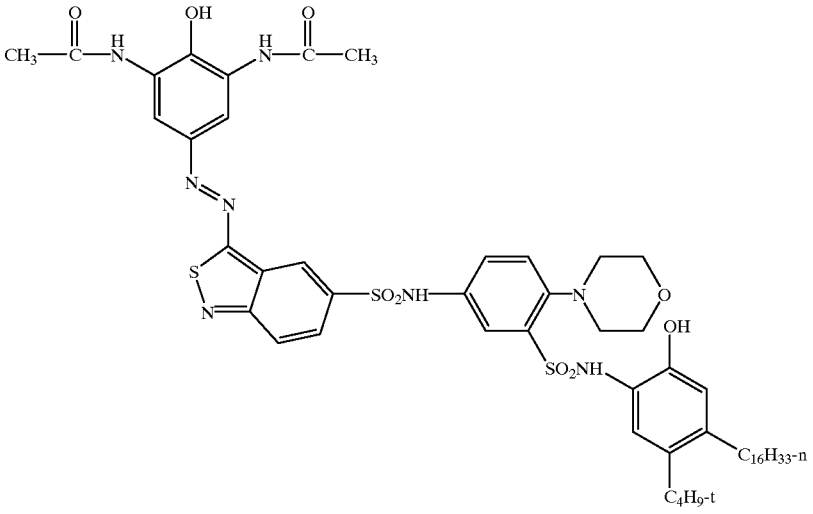
(Compound 15a)
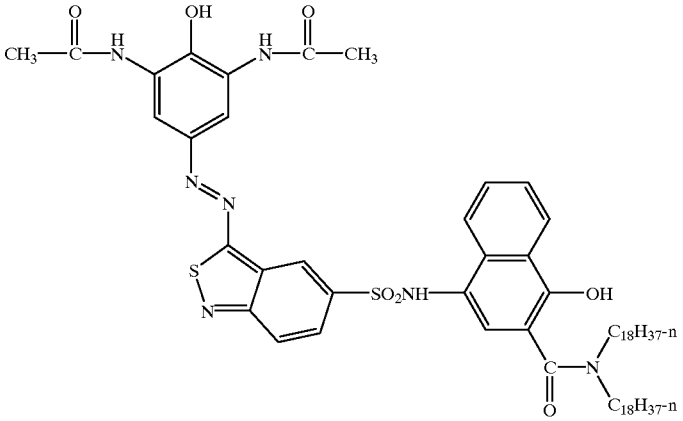
(Compound 16a)
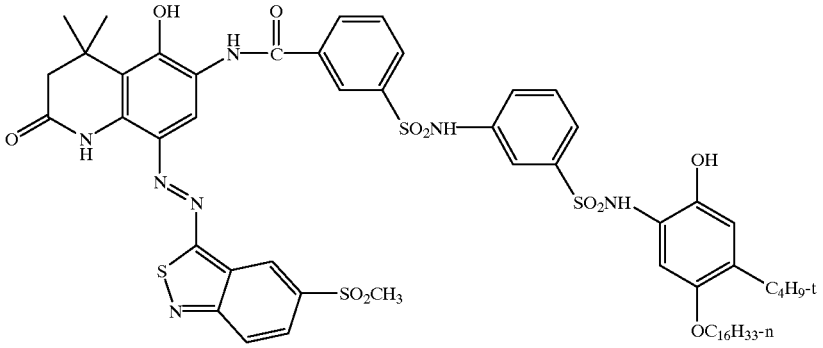

-continued
(Compound 17a)
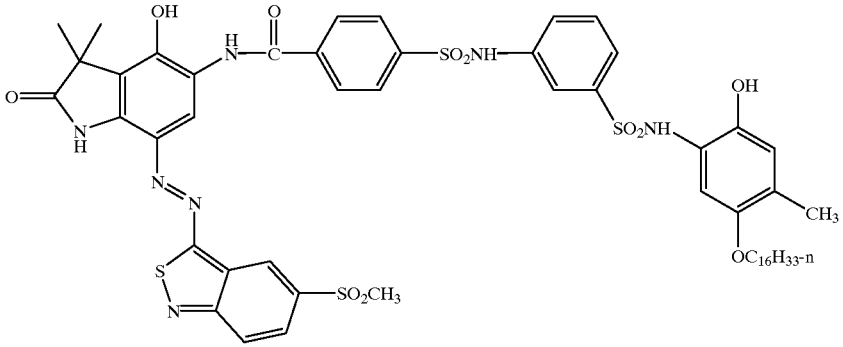
(Compound 18a)
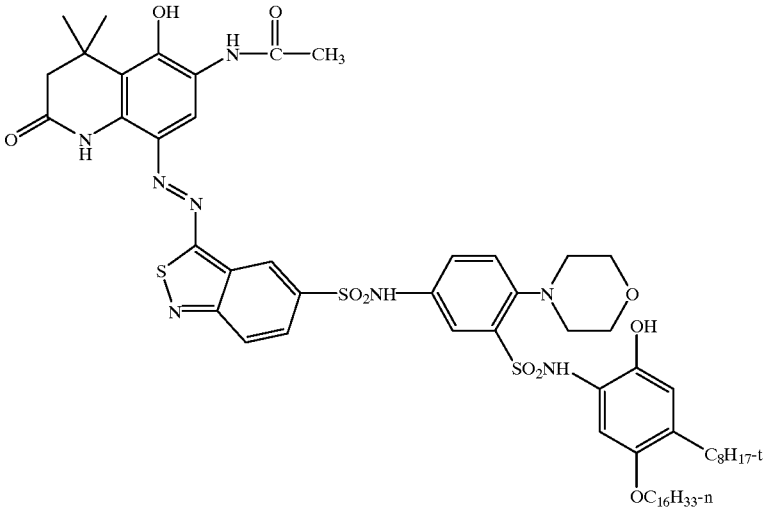
(Compound 19a)
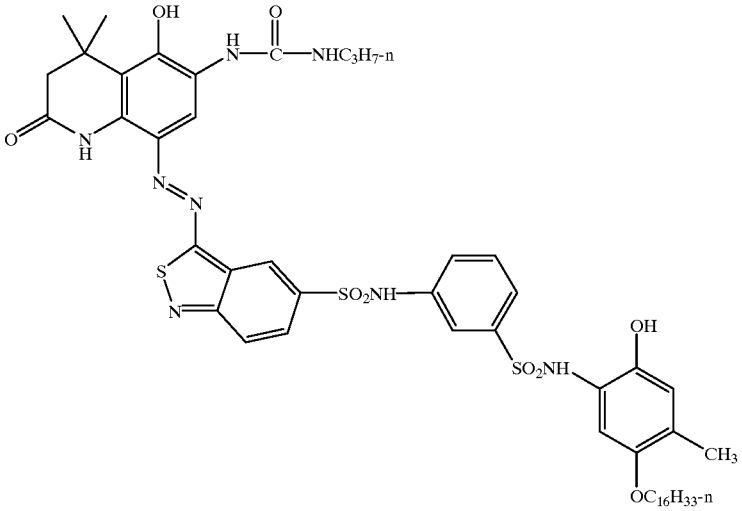

-continued
(Compound 20a)
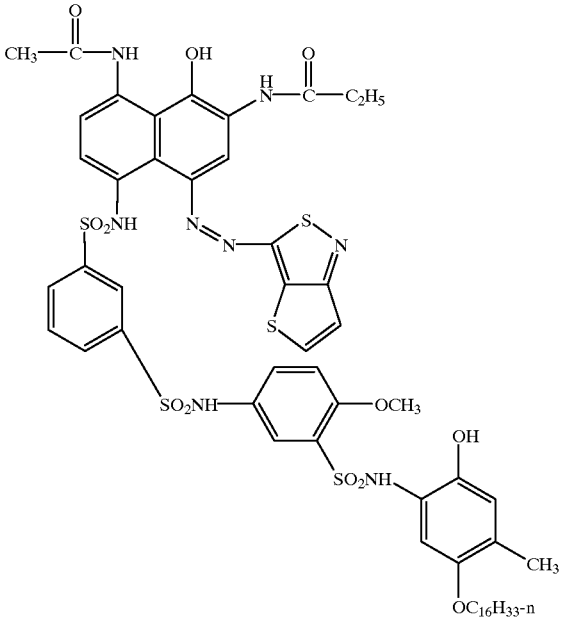
(Compound 21a)
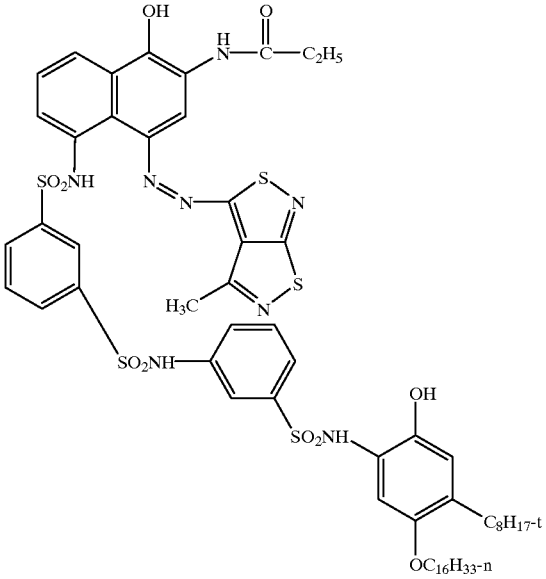

-continued
(Compound 22a)
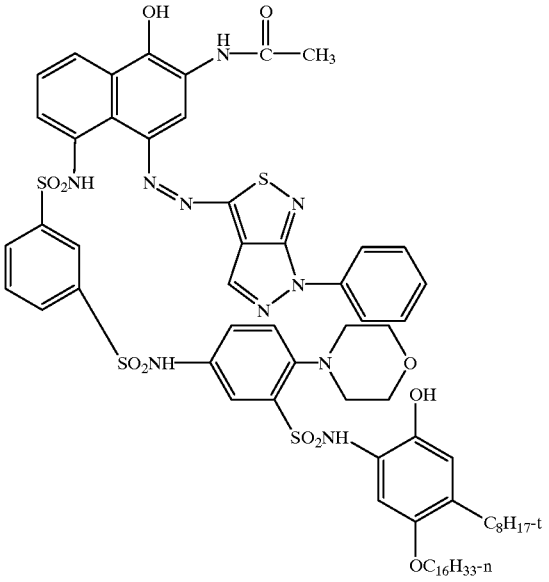
(Compound 23a)
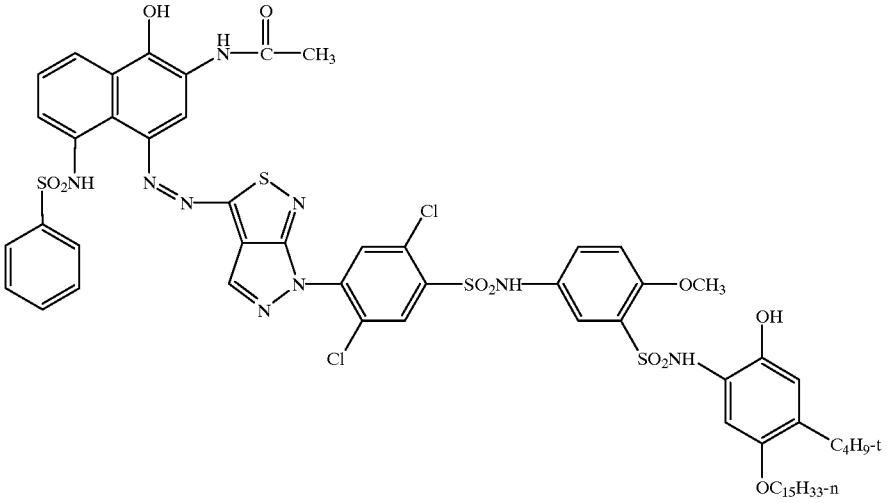

-continued
(Compound 24a)
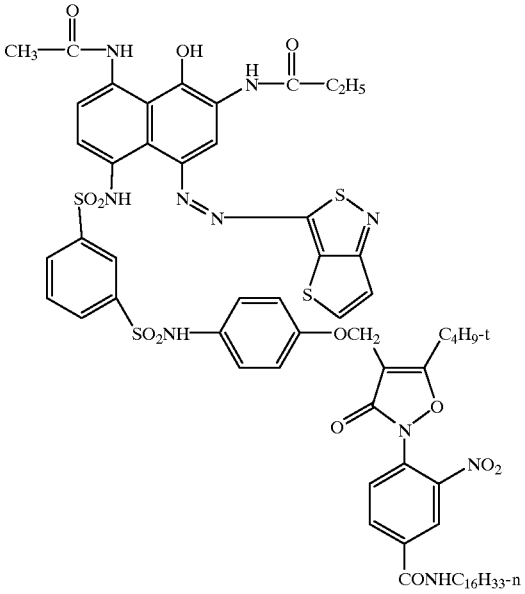
(Compound 25a)
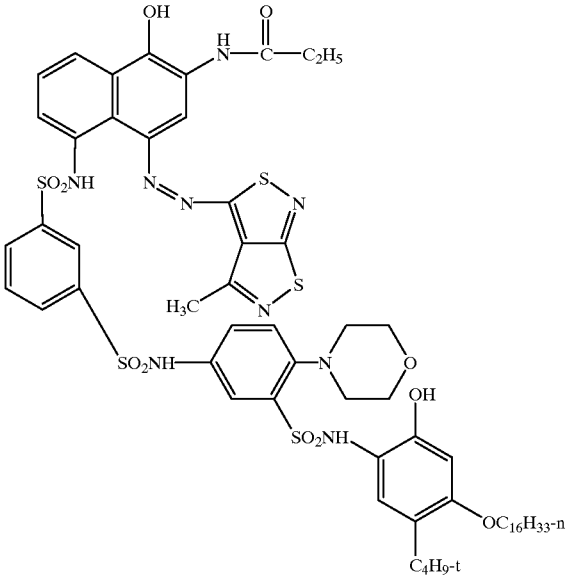

-continued
(Compound 26a)
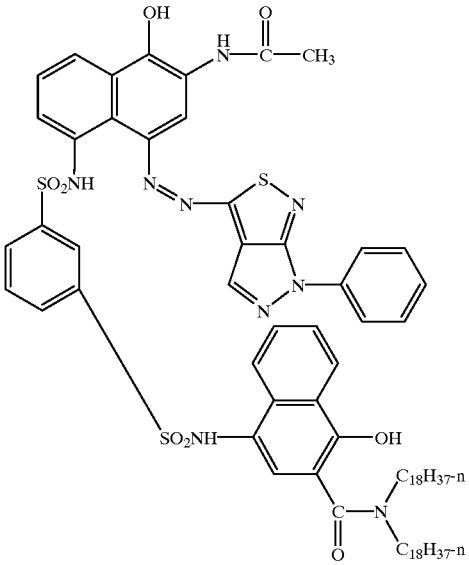
(Compound 27a)
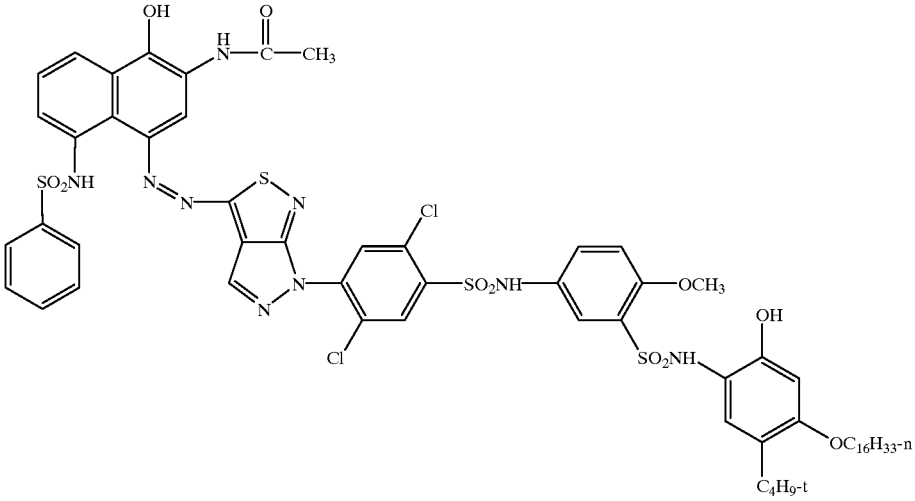

| Compound No. | A | Z | R | $B_1$ | $B_2$ | $B_3$ | $B_4$ |
|---|---|---|---|---|---|---|---|
| | | | 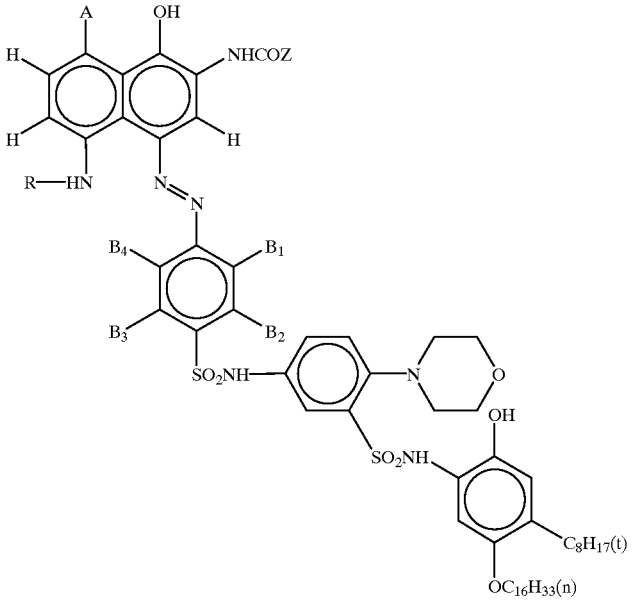 | | | | |
| 1b | —H | —$CH_3$ | —$SO_2Ph$ | —CN | —H | —H | —H |
| 2b | —H | —$C_2H_5$ | —$SO_2Ph$ | —CN | —H | —H | —H |
| 3b | —H | —$C_6H_7$(i) | —$SO_2Ph$ | —CN | —H | —H | —H |
| 4b | —H | -Ph | —$SO_2Ph$ | —CN | —H | —H | —H |
| 5b | —H | -Ph | 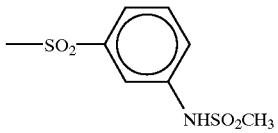 | —CN | —H | —H | —H |
| 6b | —H | -Ph | 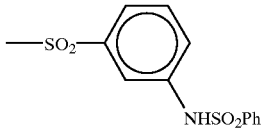 | —CN | —H | —H | —H |
| 7b | —H | -Ph | 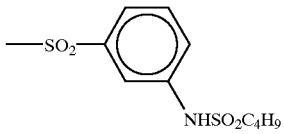 | —CN | —H | —H | —H |
| 8b | —H | -Ph | 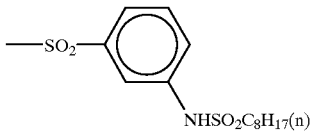 | —CN | —H | —H | —H |
| 9b | —$CONH_2$ | —$C_3H_7$(i) | —$SO_2Ph$ | —CN | —H | —H | —H |
| 10b | HO —NCPr(i) | —$C_3H_7$(i) | —$SO_2CH_3$ | —CN | —H | —H | —H |
| 11b | HO —NCPr(i) | —$C_3H_7$(i) | —$SO_2Ph$ | -Ms | —H | —H | —H |

-continued

| Compound No. | A | Z | R | $B_1$ | $B_2$ | $B_3$ | $B_4$ |
|---|---|---|---|---|---|---|---|
| 12b | —H | —$CH_3$ | —$SO_2$—C$_6$H$_4$—$NHSO_2C_4H_9$ | —CN | —H | —H | —H |
| 13b | —H | —$CH_3$ | —$SO_2$—C$_6$H$_4$—$NHSO_2C_8H_{17}$(n) | —CN | —H | —H | —H |
| 14b | —H | —$CH_3$ | —$SO_2C_4H_9$(n) | —CN | —H | —H | —H |
| 15b | —H | —$CH_3$ | —$SO_2C_8H_{17}$(n) | —CN | —H | —H | —H |
| 16b | —H | —$C_2H_5$ | —$SO_2$—C$_6$H$_4$—$NHSO_2CH_3$ | —CN | —H | —H | —H |
| 17b | —H | —$C_2H_5$ | —$SO_2$—C$_6$H$_4$—$NHSO_2C_8H_{17}$(n) | -Ms | —H | —H | —H |
| 18b | —H | —$C_3H_7$(i) | —$SO_2$—C$_6$H$_4$—$NHSO_2C_8H_{17}$(n) | —CN | —H | —H | —H |
| 19b | —H | —$C_3H_7$(i) | —$SO_2$—C$_6$H$_4$—$NHSO_2Ph$ | -Ms | —H | —H | —H |
| 20b | —H | —C$_6$H$_4$—$NHSO_2CH_3$ | —$SO_2$—C$_6$H$_4$—$NHSO_2C_4H_9$ | —CN | —H | —H | —H |
| 21b | —H | —C$_6$H$_4$—$NHSO_2CH_3$ | —$SO_2$—C$_6$H$_4$—$NHSO_2C_4H_9$ | —CN | —H | —H | —H |
| 22b | —H | —C$_6$H$_4$—OH | —$SO_2$—C$_6$H$_4$—$NHSO_2CH_3$ | —CN | —H | —H | —H |

-continued
| Compound No. | A | Z | R | $B_1$ | $B_2$ | $B_3$ | $B_4$ |
|---|---|---|---|---|---|---|---|
| 23b | —H | 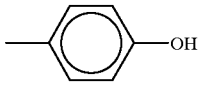 | 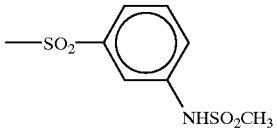 | —CN | —H | —H | —H |
| 24b | —H | 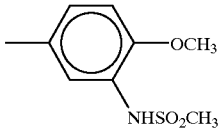 | 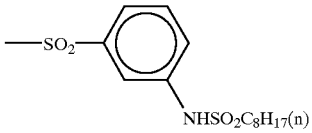 | —CN | —H | —H | —H |
| 25b | —H | 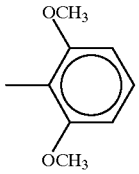 | $—SO_2C_8H_{17}(n)$ | —CN | —H | —H | —H |
| 26b | —H | $—CH_3$ | —COPh | —CN | —H | —H | —H |
| 27b | —H | $—CH_3$ | $—COC_3H_7(i)$ | —CN | —H | —H | —H |
| 28b | —H | $—C_3H_7(i)$ | $—COCH_3$ | —CN | —H | —H | —H |
| 29b | —H | $—C_2H_5$ | 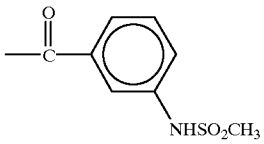 | —CN | —H | —H | —H |
| 30b | —H | $—C_3H_7(i)$ | 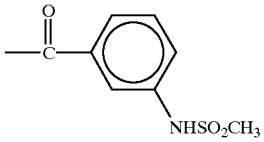 | -Ms | —H | —H | —H |
| 31b | —H | $—C_2H_5$ | $—COOC_2H_5$ | —CN | —H | —H | —H |
| 32b | —H | -Ph | $—COOC_2H_5$ | —CN | —H | —H | —H |
| 33b | —H | $—CH_3$ | $—COOC_3H_7(i)$ | —CN | —H | —H | —H |
| 34b | —H | $—CH_3$ | $—COOC_4H_9(i)$ | -Ms | —H | —H | —H |
| 35b | —H | $—CH_3$ | $—COOC_4H_9(i)$ | -Ms | —H | —H | —H |

-continued
| Compound No. | A | Z | R | $B_1$ | $B_2$ | $B_3$ | $B_4$ |
|---|---|---|---|---|---|---|---|
| | | | 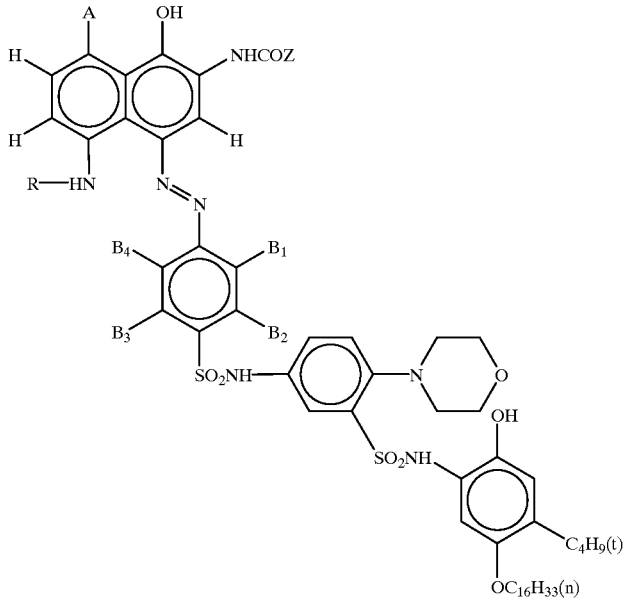 | | | | |
| 36b | —H | —$CH_3$ | —$SO_2C_8H_{17}$(n) | —CN | —H | —H | —H |
| 37b | —H | —$C_2H_5$ | —$SO_2$Ph | —CN | —H | —H | —H |
| 38b | —H | —$C_3H_7$(i) | —$SO_2$Ph | —CN | —H | —H | —H |
| 39b | —H | -Ph | —$SO_2C_8H_{17}$(n) | —CN | —H | —H | —H |
| | | | 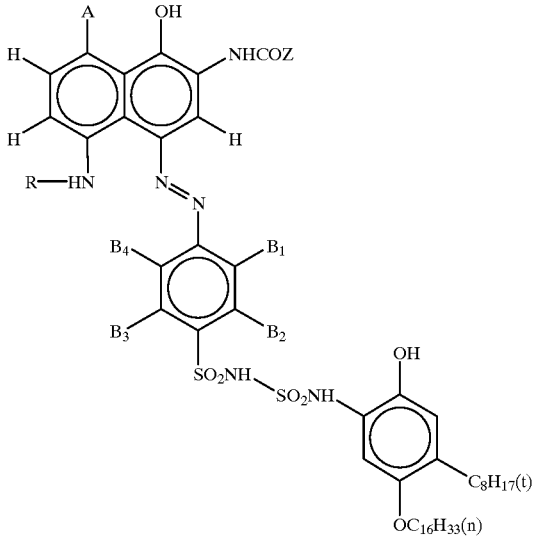 | | | | |
| 40b | —H | —$CH_3$ | —$SO_2$Ph | —CN | —H | —H | —H |
| 41b | —H | —$C_2H_5$ | 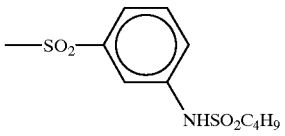 | —CN | —H | —H | —H |
| 42b | —H | —$C_3H_7$(i) | 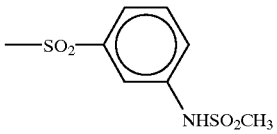 | —CN | —H | —H | —H |

-continued
| Compound No. | A | Z | R | $B_1$ | $B_2$ | $B_3$ | $B_4$ |
|---|---|---|---|---|---|---|---|
| 43b | —H | -Ph | 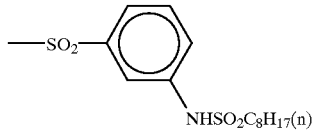 | —CN | —H | —H | —H |
| 44b | —H | —$C_3H_7$(i) | —$SO_2C_8H_{17}$(n) | -Ms | —H | —H | —H |
| | | 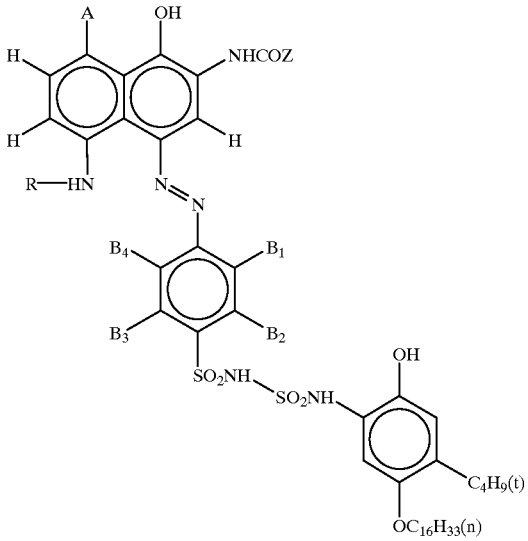 | | | | | |
| 45b | —H | —$CH_3$ | —$SO_2Ph$ | —CN | —H | —H | —H |
| 46b | —H | —$C_2H_5$ | 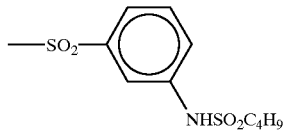 | —CN | —H | —H | —H |
| 47b | —H | —$C_3H_7$(i) | 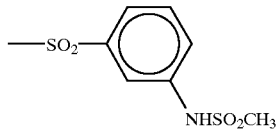 | —CN | —H | —H | —H |
| 48b | —H | -Ph | 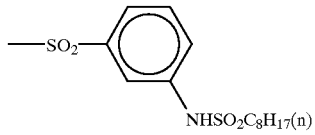 | —CN | —H | —H | —H |
| 49b | —H | —$C_3H_7$(i) | —$SO_2C_8H_{17}$(n) | -Ms | —H | —H | —H |

-continued
| Compound No. | A | Z | R | $B_1$ | $B_2$ | $B_3$ | $B_4$ |
|---|---|---|---|---|---|---|---|
| | | | 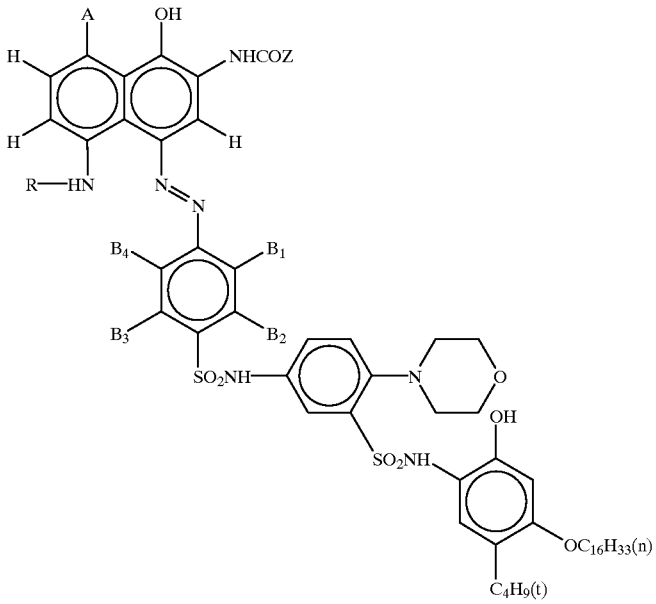 | | | | |
| 50b | —H | —$CH_3$ | —$SO_2Ph$ | —CN | —H | —H | —H |
| 51b | —H | —$C_2H_5$ | —$SO_2C_8H_{17}$(n) | —CN | —H | —H | —H |
| 52b | —H | —$C_3H_7$(i) | —$SO_2C_8H_{17}$(n) | —CN | —H | —H | —H |
| 53b | —H | -Ph | —$SO_2C_8H_{17}$(n) | —CN | —H | —H | —H |
| 54b | —H | —$CH_3$ | 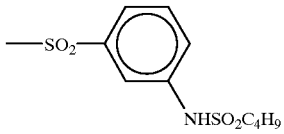 | -Ms | —H | —H | —H |
| | | | 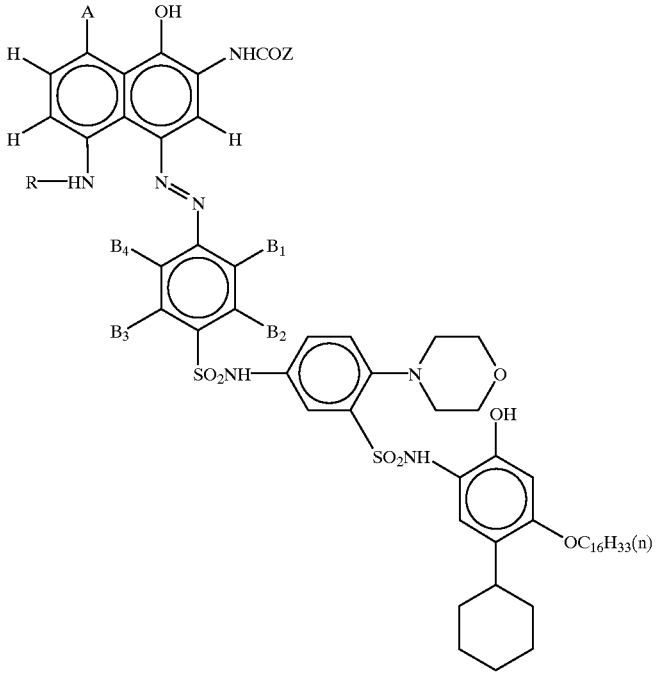 | | | | |
| 55b | —H | —$CH_2$ | —$SO_2Ph$ | —CN | —H | —H | —H |

-continued
| Compound No. | A | Z | R | $B_1$ | $B_2$ | $B_3$ | $B_4$ |
|---|---|---|---|---|---|---|---|
| 56b | —H | —$C_2H_5$ | 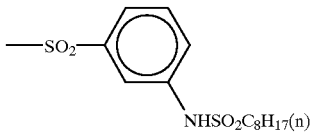 | —CN | —H | —H | —H |
| 57b | —H | —$C_3H_7$(i) | 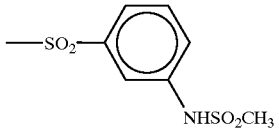 | —CN | —H | —H | —H |
| 58b | —H | -Ph | 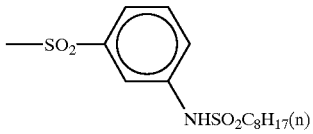 | —CN | —H | —H | —H |
| 59b | —H | —$C_3H_7$(i) | 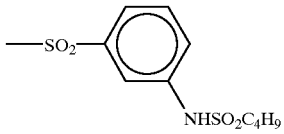 | -Ms | —H | —H | —H |
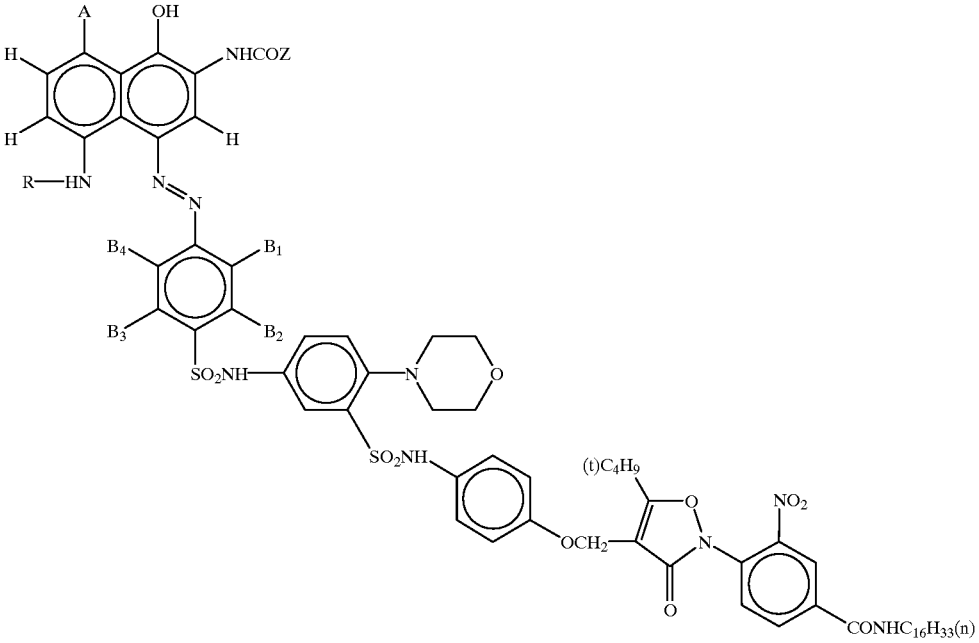
| | | | | | | | |
|---|---|---|---|---|---|---|---|
| 60b | —H | —$CH_3$ | —$SO_2$Ph | —CN | —H | —H | —H |
| 61b | —H | —$C_2H_5$ | —$SO_2C_8H_{17}$(n) | —CN | —H | —H | —H |
| 62b | —H | —$C_3H_7$(i) | —$SO_2C_8H_{17}$(n) | —CN | —H | —H | —H |
| 63b | —H | -Ph | —$SO_2C_8H_{17}$(n) | —CN | —H | —H | —H |
| 64b | —H | —$C_3H_7$(i) | —$SO_2C_8H_{17}$(n) | -Ms | —H | —H | —H |

-continued

| Compound No. | A | Z | R | $B_1$ | $B_2$ | $B_3$ | $B_4$ |
|---|---|---|---|---|---|---|---|
| | | | 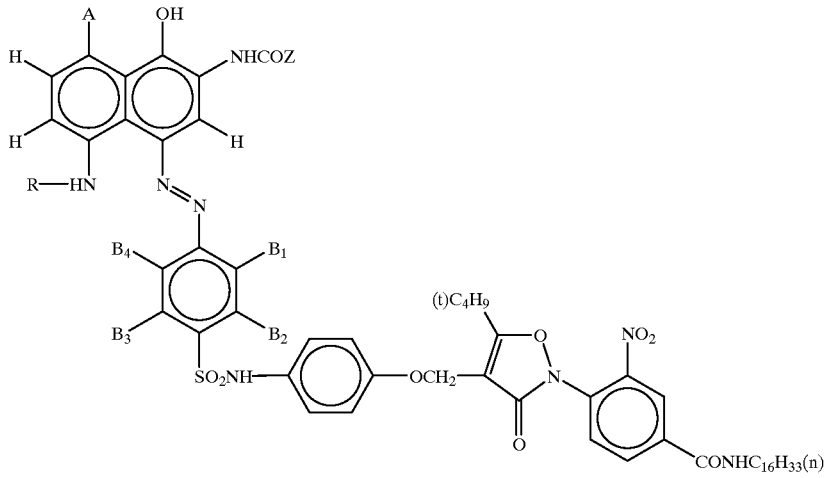 | | | | |
| 65b | —H | —$CH_3$ | —$SO_2Ph$ | —CN | —H | —H | —H |
| 66b | —H | —$C_2H_5$ | —$SO_2C_8H_{17}$(n) | —CN | —H | —H | —H |
| 67b | —H | —$C_3H_7$(i) | —$SO_2C_8H_{17}$(n) | —CN | —H | —H | —H |
| 68b | —H | -Ph | —$SO_2C_8H_{17}$(n) | —CN | —H | —H | —H |
| 69b | —H | —$C_3H_7$(i) | —$SO_2C_8H_{17}$(n) | -Ms | —H | —H | —H |

-Ph = phenyl, -Ms = —$SO_2CH_3$

Synthesis method of the image forming compound used in the present invention is described below.

A dye skeleton of the compound according to the present invention is prepared by a diazo coupling reaction between a naphthol or phenol as a coupling component and an amino body of condensed ring isothiazole as a diazo component. Synthesis of the amino body of condensed ring isothiazole can be conducted by making reference to the methods described in *Dyes and Pigments,* 3, 81–121 (1982) and references cited therein.

Representative synthesis examples of the compound are described below.

SYNTHESIS OF COMPOUND 8a

Compound 8a was synthesized along the route shown below.

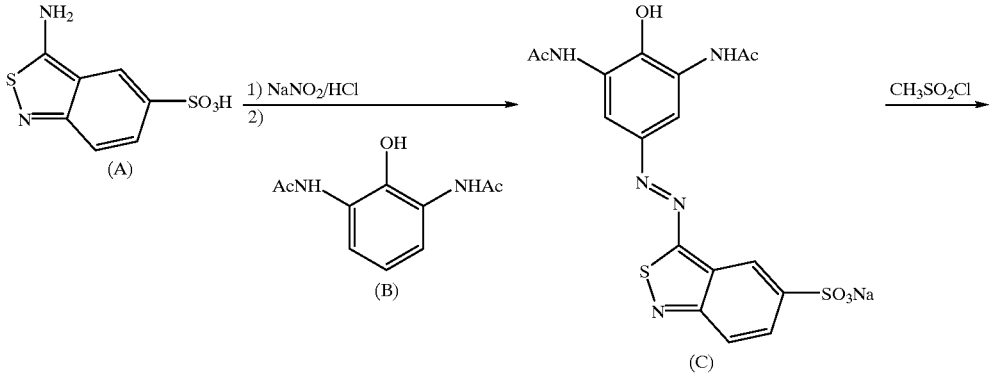

-continued

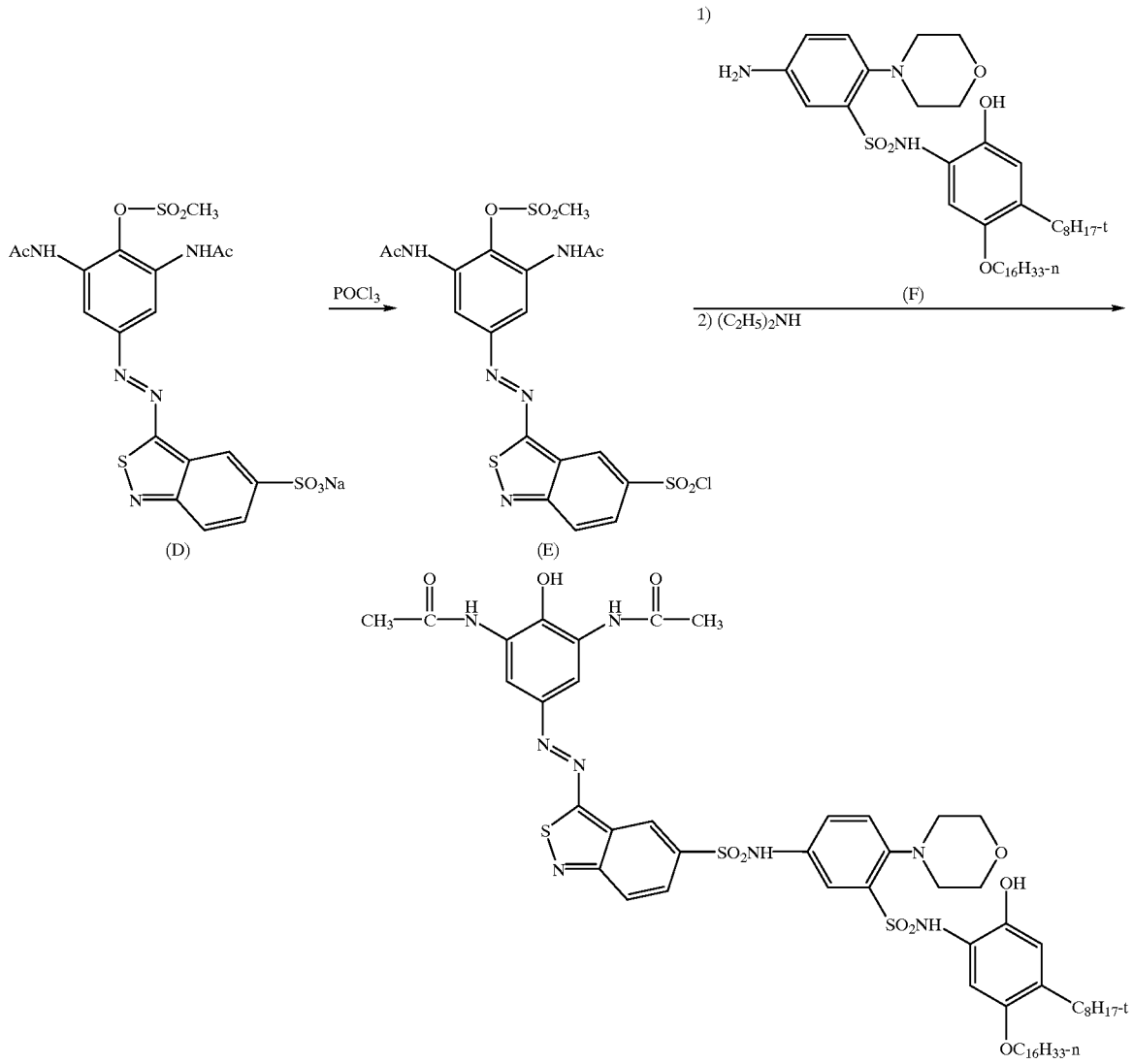

Compound 8a

To 1,000 ml of water were added 115 g of a benzisothizole (Compound (A)) and then 250 ml of concentrated hydrochloric acid. A solution containing 52 g of sodium nitrite dissolved in 160 ml of water was dropwise added thereto at 5° C. or below, followed by stirring for 30 minutes to prepare a diazo solution.

To a mixture of 104 g of Compound (B), 700 ml of acetonitrile, 230 ml of water and 360 ml of triethylamine was gradually added the above described diazo solution at 10° C. After stirring for one hour, 1,000 ml of a 20% aqueous solution of sodium chloride, 430 ml of hydrochloric acid, and 1,000 ml of isopropyl alcohol were added in this order and the crystals thus-deposited were collected by filtration to obtain 177 g of Azo Dye (C).

To a mixture of 200 ml of dimethylacetamide and 30 ml of triethylamine was added 50 g of Azo Dye (C). To the solution was dropwise added 13.2 ml of methanesulfonyl chloride at room temperature, followed by stirring for 30 minutes. Then, 600 ml of acetonitrile was added thereto and the crystals thus-deposited were collected by filtration to obtain 57 g of Compound (D).

To a mixture of 60 ml of dimethylacetamide and 400 ml of acetonitrile was added 57 g of Compound (D) and then 76.3 ml of phosphorous oxychloride was dropwise added under cooling with ice. After allowing to react at 60° C. for one hour, the reaction mixture was poured into ice water and the crystals thus-deposited were collected by filtration to obtain 38 g of Compound (E).

To 50 ml of dimethylacetamide was added 14.7 g of Compound (F). To the solution were added 12 g of Compound (E), and then 16 ml of pyridine dropwise. After allowing to react at 40° C. for one hour, 10 ml of diethylamide was dropwise added thereto, followed by stirring for one hour. Then, the reaction mixture was poured into aqueous hydrochloric acid (22.4 ml of concentrated hydrochloric acid and 300 ml of water) and the crystals thus-deposited were collected by filtration to obtain 22 g of raw crystals. The raw crystals were recrystallized from 20 ml of dimethylacetamide and 50 ml of ethyl acetate to obtain 15 g of Compound 8a having a melting point of 221 to 222° C.

SYNTHESIS OF COMPOUND 1b

Compound 1b was synthesized along the route shown below.

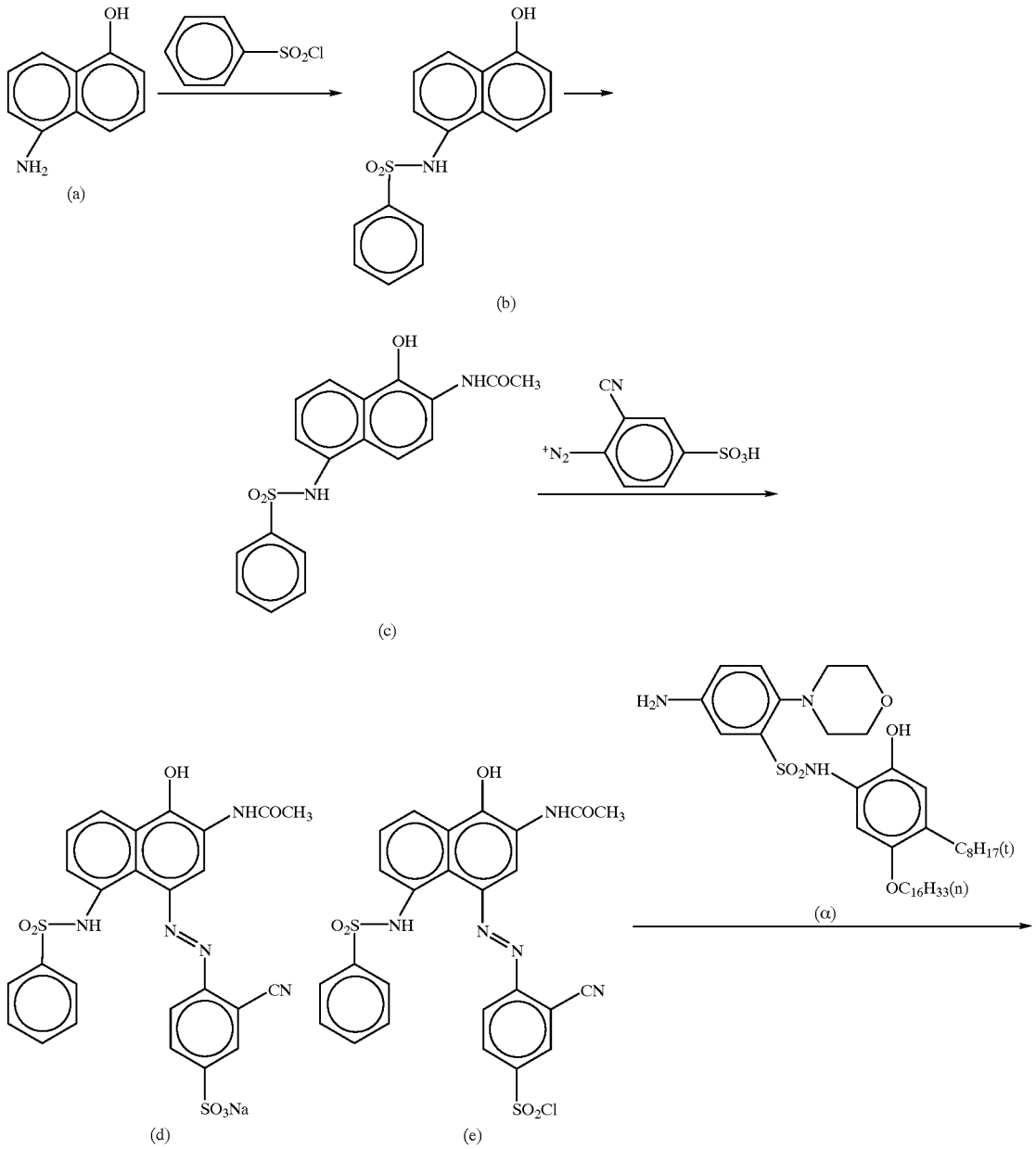
OH
SO2Cl
NH2
(a)
OH
O2S—NH
(b)
OH
NHCOCH3
CN
+N2
SO3H
O2S—NH
(c)
H2N
N
O
OH
SO2NH
C8H17(t)
OC16H33(n)
(α)
OH
NHCOCH3
O2S—NH
N=N
CN
SO3Na
(d)
OH
NHCOCH3
O2S—NH
N=N
CN
SO2Cl
(e)

-continued

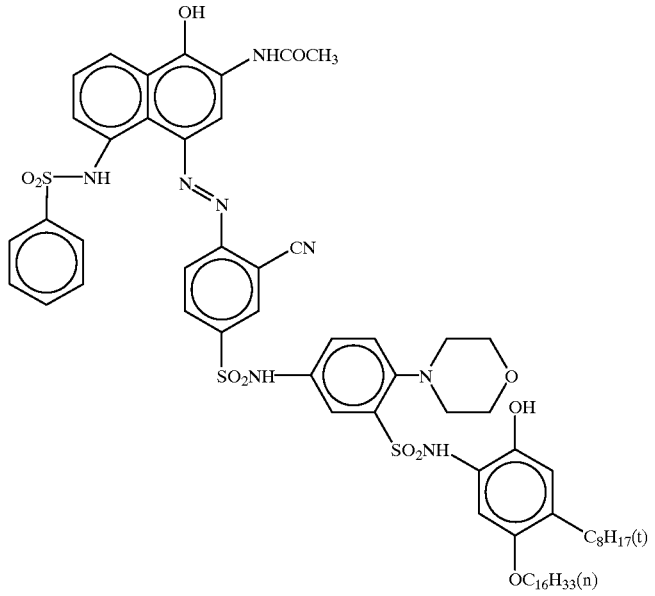

Synthesis of Intermediate (b):

To a solution containing 31.8 g of 5-aminonaphthoic acid (compound (a)), 80 ml of N,N-dimethylacetamide and 80 ml of acetonitrile was dropwise added 32.4 ml of pyridine at 15° C. or below with stirring over a period of 15 minutes. After stirring at the same temperature for 5 minutes, 28.2 ml of benzenesulfonyl chloride was dropwise added thereto at 5° C. with stirring over a period of 30 minutes. After stirring at room temperature for 30 minutes, a solution containing 20 ml of hydrochloric acid and 1,000 ml of water was poured thereto, and the crystals thus-deposited were collected by filtration, washed with water and dried to obtain 56 g of Intermediate (b) having a melting point of 163° C.

Synthesis of Intermediate (c):

To a solution containing 54 g of Intermediate (b) and 500 ml of 1-methoxyethanol was dropwise added 43 ml of hydrochloric acid under cooling with ice with stirring over a period of 5 minutes. Then, a solution containing 18 g of sodium nitrite and 60 ml of water was dropwise added thereto at 10° C. or below over a period of 15 minutes. After stirring at 15° C. for 30 minutes, a solution containing 125.4 g of sodium hydrosulfinate and 1,000 ml of water was dropwise added thereto at 25° C. or below over a period of 30 minutes. After stirring at the same temperature for 20 minutes, 22 ml of acetic anhydride was added thereto at 15° C. or below over a period of 15 minutes. After stirring at room temperature for 60 minutes, the crystals thus-deposited were collected by filtration, washed with water and dried to obtain 57 g of Intermediate (c) having a melting point of 235° C.

Synthesis of Intermediate (d):

To a solution containing 44 g of 4-amino-3-cyanobenzenesulfonic acid (HPLC: 98%) and 500 ml of water was dropwise added 120 ml of hydrochloric acid under cooling with ice with stirring over a period of 5 minutes. Then, a solution containing 19.2 g of sodium nitrite and 100 ml of water was dropwise added thereto at 5° C. or below over a period of 15 minutes to prepare a diazonium salt, followed by stirring at 5° C. or below for 15 minutes. To a solution containing 57 g of Intermediate (c), 500 ml of 1-methoxyethanol and 100 ml of N,N-dimethylacetamide was added the diazonium salt described above at 5° C. or below over a period of 30 minutes with stirring. After stirring at 15° C. for 60 minutes, the mixture was poured into 100 ml of acetonitrile and further stirred at the same temperature for 15 minutes. The reaction mixture was poured into 3,000 ml of a 10% aqueous sodium chloride solution of 40° C., followed by stirring at 30° C. for 90 minutes. The crystals thus-deposited were collected by filtration, washed with a 10% aqueous sodium chloride solution and dried. The crude crystals were refluxed by heating in methanol to obtain 85 g of Intermediate (d) having a melting point of more than 280° C.

Synthesis of Intermediate (e):

To a suspension containing 69 g of Intermediate (d), 35 ml of N,N-dimethylacetamide and 350 ml of acetonitrile was dropwise added 110 ml of phosphorus oxychloride under cooling with ice with stirring. The reaction mixture was stirred at 40 to 50° C. and cooled with water. The reaction mixture was added to 2,000 ml of ice water with stirring and the crystals thus-deposited were collected by filtration, washed with water and dried. The crude crystals were stirred in 300 ml of acetonitrile at room temperature for 60 minutes, collected by filtration, washed with acetonitrile and dried to obtain 59 g of Intermediate (e) having a melting point of 167° C. (decomposed).

Synthesis of Compound 1b:

To a solution containing 63 g of Intermediate (α), 450 ml of ethyl acetate and 90 ml of N,N-dimethylacetamide was added 59 g of Intermediate (e) at 5° C. with stirring under a nitrogen atmosphere. Then, 50 ml of pyridine was dropwise added thereto at the same temperature over a period of 30 minutes. After stirring at room temperature for 60 minutes, the reaction mixture was poured into 1,000 ml of methanol of 40° C., and 450 ml of water of 40° C. was poured therein, followed by stirring at room temperature for 90 minutes. The crystals thus-deposited were collected by filtration, washed with methanol and dried. The crude crystals were dissolved by heating in 350 ml of ethyl acetate, filtered with sellaite, and the filtrate was poured into 2,000 ml of methanol of 40° C. under a nitrogen atmosphere. After stirring at room temperature for 120 minutes, the crystals thus-deposited were collected by filtration, washed with methanol and dried to obtain 96 g of Compound 1b having a melting point of 208° C.

Although the amount of the dye image forming compound used in the present invention can be varied over a wide range, the compound is ordinarily employed in a range of from 0.01 to 4 mol per 1 mol of silver.

The above-described image forming compound and hydrophobic additives such as an image formation accelerator described hereinafter, can be incorporated into layers of the light-sensitive element by a known method described, for example, in U.S. Pat. No. 2,322,027. In this case, a high boiling point organic solvent as described in JP-A-59-83154, JP-A-59-178451, JP-A-59-178452, JP-A-59-178453, JP-A-59-178454, JP-A-59-178455 and JP-A-59-178457 may be used in combination, if desired, with a low boiling point organic solvent having a boiling point of from 50 to 160° C.

The high boiling point organic solvent is used in an amount of 10 g or less, preferably 5 g or less, per 1 g of the dye image forming compound used.

A dispersion method using a polymer material described in JP-B-51-39853 and JP-A-51-59943 may also be used.

In the case of a compound which is substantially insoluble in water, other than the above-descried method, the compound may be incorporated as a fine particle dispersion in a binder.

In dispersing a hydrophobic substance in a hydrophilic colloid, various surfactants may be used. For example, surfactants described in JP-A-59-157636, pages (37) to (38) may be used.

In the present invention, a dye donating compound represented by the following formula (5) can be used in combination.

DYE-Y (5)

wherein DYE represents a dye or a precursor thereof, and Y represents a component which gives a compound different in diffusibility from the compound under an alkaline condition. Depending on the function of Y, the compound is roughly classified into a negative compound which becomes diffusible at the silver developed area, and a positive compound which becomes diffusible at the undeveloped area.

Specific examples of the negative Y include those which are oxidized upon development to cleave, thereby releasing a diffusible dye.

Specific examples of Y are described in U.S. Pat. No. 3,928,312 cited in JP-A-2-32335, from page (15), right upper column, line 18 to page (15), left lower column, line 20.

Among the groups Y as a negative dye releasing redox compound, preferred is an N-substituted sulfamoyl group (the N-substitution group includes groups derived from an aromatic hydrocarbon ring or a heterocyclic ring).

With respect to representative examples of Y, the positive compound and other type of compounds, description in JP-A-2-32335, from page (16), left upper column, to page (17), right lower column, line 7 can be referred to.

In the case where the dye donating compound which can be used in combination in the present invention is a dye donating compound to be reduced, a reducing agent (sometimes referred to as an electron donor) is used.

The reducing agent may be supplied from the exterior or may be previously incorporated into the light-sensitive material. Further, a reducing agent precursor which itself has no reducibility but exerts reducibility by the action of a nucleophilic reagent or heat during the development process, can also be used.

Examples of the electron donor for use in the present invention include electron donors and electron donor precursors described in U.S. Pat. No. 4,500,626, columns 49 to 50, U.S. Pat. No. 4,483,914, columns 30 to 31, U.S. Pat. Nos. 4,330,617 and 4,590,152, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256, and European Patent 220746A2, pages 78 to 96.

Combinations of various electron donors described in U.S. Pat. No. 3,039,869 may also be used.

When the dye donating compound used in the present invention is diffusion-resistant, or when the reducing agent used in combination with the dye donating compound to be reduced used in the present invention is diffusion-resistant, an electron transfer agent may be used.

The electron transfer agent or precursor thereof may be selected from the above-described electron donors and precursors thereof. The electron transfer agent or precursor thereof preferably has mobility greater than that of the diffusion-resistant electron donor. Particularly useful examples of the electron transfer agent include 1-phenyl-3-pyrazolidones and aminophenols.

The diffusion-resistant electron donor for use in combination with the electron transfer agent may be any of the above-described reducing agents as long as it does not substantially move in layers of the light-sensitive material, and preferred examples thereof include hydroquinones, sulfonamidophenols, sulfonamidonaphthols and compounds described as the electron donor in JP-A-53-110827.

The electron transfer agent may be supplied from the exterior or may be previously incorporated into the light-sensitive material.

The dye donating compound which can be used in the present invention is preferably incorporated into the same layer as the light-sensitive silver halide emulsion, however it may be incorporated into any layer if it is in the reactive state directly or through the electron transfer agent. For example, if a colored dye donating compound is incorporated into the lower layer of the silver halide emulsion layer, reduction in the sensitivity can be prevented. In the present invention, the above-described dye donating compound can be used in a wide range of amount, and it is used in an amount of from 0.01 to 5 mol, preferably from 0.05 to 1 mol, per 1 mol of Ag.

The above-described dye donating compound can be used in a diffusion transfer color photographic light-sensitive material. As the development and image formation process thereof, a method of spreading a processing composition in the vicinity of room temperature or a method of performing heat development by supplying a slight amount of water or by incorporating a thermal solvent, may be used.

A color diffusion transfer method is described below.

A representative form of the film unit for use in the color diffusion transfer method is such that an image receiving element (dye fixing element) and a light-sensitive element are laminated on one transparent support and after completion of the transferred image, the light-sensitive element needs not be peeled off from the image receiving element. More specifically, the image receiving element comprises at least one mordant layer and in a preferred embodiment of the light-sensitive element, a combination of a blue-sensitive emulsion layer, a green-sensitive emulsion layer and a red-sensitive emulsion layer, a combination of a green-sensitive emulsion layer, a red-sensitive emulsion layer and an infrared-sensitive emulsion layer, or a combination of a blue-sensitive emulsion layer, a red-sensitive emulsion layer and an infrared-sensitive emulsion layer is used, and a yellow dye donating substance, a magenta dye donating substance and a cyan dye donating substance are contained in respective emulsion layers (the term "infrared-sensitive emulsion layer" as used herein means an emulsion layer having sensitivity to light of 700 nm or more, particularly 740 nm or more). Between the mordant layer and the light-sensitive layer or the dye donating substance-containing layer, a white reflecting layer containing a solid pigment such as titanium oxide is provided so that the transferred image can be viewed through the transparent support.

In order to complete development in a bright room, a light-shielding layer may further be provided between the white reflecting layer and the light-sensitive layer. Further, if desired, in order to achieve peeling of the whole or a part of the light-sensitive element from the image-receiving element, a release layer may be provided at an appropriate position (such an embodiment is described, for example, in JP-A-56-67840 and Canadian Patent 674,082).

Another embodiment of the lamination type material requiring peeling is a color diffusion transfer photographic film unit described in JP-A-63-226649 comprising a white support having thereon at least (a) a layer having a neutralization function, (b) a dye image-receiving layer, (c) a release layer and (d) a layer which comprises a light-sensitive element consisting in sequence of at least one silver halide emulsion layer combined with a dye image forming substance, an alkali processing composition containing a light-shielding agent, and a transparent cover sheet, and has a light-shielding function on the side of the emulsion layer opposite to the side where the processing composition is spread.

In an embodiment dispensed with peeling, the above-described light-sensitive element is coated on one transparent support, a white reflection layer is coated thereon, and an image receiving layer is laminated further thereon. An embodiment where an image receiving element, a white reflection layer, a release layer and a light-sensitive element are laminated on the same support, and the light-sensitive element is intentionally peeled off from the image receiving element, is described in U.S. Pat. No. 3,730,718.

The representative embodiment of separately coating a light-sensitive element and an image receiving element on two respective supports is roughly classified into two groups, one group is a peeling type and another is a non-peeling type. More specifically, in a preferred embodiment of a peeling type film unit, at least one image receiving layer is coated on one support and a light-sensitive element is coated on a support having a light-shielding layer, and although the light-sensitive layer coated surface and the mordant layer coated surface do not face to each other before completion of the exposure, they are designed so that the light-sensitive layer coated surface is turned over after completion of the exposure to be superposed on the image receiving layer coated surface. After completion of the transferred image in the mordant layer, the light-sensitive element is soon peeled off from the image receiving element.

In a preferred embodiment of a non-peeling type film unit, at least one mordant layer is coated on a transparent support, a light-sensitive element is coated on a support having a transparent or light-shielding layer, and the light-sensitive layer coated surface and the mordant layer coated surface are superposed to face each other.

The above-described embodiments each may further be combined with a container (processing element) containing an alkaline processing solution and capable of rupture under pressure. In particular, in the non-peeling type film unit comprising an image receiving element and a light-sensitive element laminated on one support, the processing element is preferably disposed between the light-sensitive element and the cover sheet superposed thereon. In the case of an embodiment where a light-sensitive element and an image receiving element are separately coated on two supports, respectively, the processing element is preferably disposed between the light-sensitive element and the image receiving element at latest at the time of development. The processing element preferably contains, depending upon the form of the film unit, a light-shielding agent (e.g., carbon black, dye capable of color change according to pH) and/or a white pigment (e.g., titanium oxide). Further, in a color diffusion transfer type film unit, a neutralization timing mechanism comprising a combination of a neutralizing layer and a neutralization timing layer is preferably integrated into the cover sheet, the image receiving element or the light-sensitive element.

The image receiving element used in the color diffusion transfer method is described in more detail below.

The image receiving element in the color diffusion transfer method preferably comprises at least one layer containing a mordant (mordant layer). Mordants known in the photographic field can be used. Specific examples thereof are described in British patents 2,011,912, 2,056,101 and 2,093,041, U.S. Pat. Nos. 4,115,124, 4,273,853 and 4,282,305, JP-A-59-232340, JP-A-60-118834, JP-A-60-128443, JP-A-60-122940, JP-A-60-122921 and JP-A-60-235134.

In addition, various additives can be appropriately employed in the image receiving element for the color diffusion transfer method and such additives are described in the item of the dye fixing element (image receiving element) for the heat developable color diffusion transfer method below.

The light-sensitive element in the color diffusion transfer method is described below.

With respect to the silver halide emulsion, the spectral sensitizing dye, the emulsin layer, the superposed layer structure for full color, the processing composition, and the film unit for the color diffusion transfer method and the constituting layers thereof, description in JP-A-2-32335, from page (17), right lower column, line 8 to page (20), right lower column, line 19, can be applied.

The release layer in the color diffusion transfer method is described below.

The release layer for use in the present invention may be provided after processing at any position in the light-sensitive sheet within the unit. Examples of the release material include those described in JP-A-47-8237, JP-A-59-220727, JP-A-49-4653, U.S. Pat. Nos. 3,220,835 and 4,359,518, JP-A-49-4334, JP-A-50-65133, JP-A-45-24075, and U.S. Pat. Nos. 3,227,550, 2,759,825, 4,401,746 and 4,366,227. Specific examples thereof include water-soluble (or alkali-soluble) cellulose derivatives such as hydroxyethyl cellulose, cellulose acetate phthalate, plasticized methyl cellulose, ethyl cellulose, cellulose nitrate and carboxymethyl cellulose, various natural polymers such as alginic acid, pectin and gum arabic, and various modified gelatins such as acetylated gelatin and phthalated gelatin. Further, polyvinyl alcohol, polyacrylate, polymethyl methacrylate and copolymers thereof may also be used.

Among these release materials, cellulose derivatives are preferred and hydroxyethyl cellulose is particularly preferred.

In addition to the water-soluble cellulose derivatives, particulate materials such as an organic polymer can be used as the release material.

Examples of the organic polymer for use in the present invention include polymer latexes having an average particle size of from 0.01 to 10 μm, such as polyethylene, polystyrene, polymethyl methacrylate, polyvinyl pyrrolidone and butyl acrylate. However, a light-reflecting hollow polymer latex with the inside containing air and the outside comprising a material comprising an organic polymer, is preferably used.

The above-described light-reflecting hollow polymer latex can be synthesized by the method described in JP-A-61-151646.

The heat developable color diffusion transfer method is described below.

The heat developable color light-sensitive material of the present invention fundamentally comprises a reducing agent, a binder and a dye donating compound on a support, and if desired, an organic metal salt oxidizing agent may be further contained.

These components are added to the same layer in many cases, however, these components may be dividedly added to separate layers as long as they are in the reactive state. For example, when a colored dye donating compound to be reduced is present in the lower layer of the silver halide emulsion, reduction in sensitivity can be prevented. The electron donor is preferably incorporated into the heat developable light-sensitive material, however, it may be supplied from the exterior, for example, by diffusing it from the dye fixing element described hereinafter.

In order to obtain colors over a wide range within the chromaticity diagram using three primary colors of yellow, magenta and cyan, at least three silver halide emulsion layers having sensitivity in different spectral regions are used in combination. For example, a three layer combination of a blue-sensitive layer, a green-sensitive layer and a red-sensitive layer, and a three layer combination of a green-sensitive layer, a red-sensitive layer and an infrared-sensitive layer may be used. Respective light-sensitive layers may be arranged in any order and various arrangement orders known for conventional type color light-sensitive materials may be used. Further, each of these light-sensitive layers may be divided into two or more layers, if desired, as described in JP-A-1-252954.

The heat developable light-sensitive material may have various auxiliary layers such as a protective layer, a subbing layer, an interlayer, a yellow filter layer, an antihalation layer and a back layer.

Specific examples thereof include a subbing layer as described in U.S. Pat. No. 5,051,335, an interlayer having a solid pigment as described in JP-A-1-167838 and JP-A-61-20943, an interlayer having a reducing agent or a DIR compound as described in JP-A-1-120553, JP-A-5-34884 and JP-A-2-64634, an interlayer having an electron transfer agent as described in U.S. Pat. Nos. 5,017,454 and 5,139,919 and JP-A-2-235044, a protective layer having a reducing agent as described in JP-A-4-249245, and a layer comprising a combination of these layers. The protective layer is preferably divided into two layers. In the heat developable light-sensitive material, various additives need be added also to the protective layer in many cases and accordingly, the layer is reduced in strength and readily scratched. Therefore, in order to increase the layer strength, the protective layer is preferably divided into two layers and the outermost layer is preferably reduced in the amount of additives (particularly oil-soluble components) to the binder and has a binder-rich composition. When the support is a polyethylene laminate paper containing a white pigment such as titanium oxide, the back layer is preferably designed to have an antistatic function and a surface resistivity of $10^{12}$ Ω.cm or less.

The silver halide emulsion (emulsion containing light-sensitive silver halide) of the present invention may have various forms. Examples thereof include regular grains having a regular crystal form such as cubic, octahedral or tetradecahedral form, and grains having an irregular crystal form, such as tabular grain, spherical grain and potato-shaped grain. The light-sensitive silver halide which can be used in respective light-sensitive layers of the present invention may be any of silver chloride, silver bromide, silver iodobromide, silver chlorobromide, silver chloroiodide and silver chloroiodobromide. The silver halide emulsion may be either a surface latent image type emulsion or an internal latent image type emulsion. The internal latent image type emulsion is used as a direct reverse emulsion in combination with a nucleating agent or a light fogging agent. The emulsion also may be a so-called core/shell emulsion having phases different between the grain inside and the grain surface. The silver halide emulsion may be monodispersed or polydispersed, and monodispersed emulsions may be admixed to use. A method of mixing emulsions different in sensitivity (described, for example, in JP-A-1-167744) is preferably used for controlling the gradation. The grain size is from 0.1 to 2 μm, preferably from 0.2 to 1.5 μm.

The light-sensitive silver halide emulsion for use in the present invention is preferably a core/shell emulsion. Further, a monodispersed emulsion having a coefficient of variation of 20% or less as described in JP-A-3-110555 is preferred.

Specific examples thereof include silver halide emulsions described in U.S. Pat. No. 4,500,626, column 50, U.S. Pat. No. 4,628,021, *Research Disclosure* (hereinafter simply referred to as "RD"), 36544 (1994), JP-A-62-253159, JP-A-3-110555, JP-A-2-236546, JP-A-1-167743, JP-A-6-332093, JP-A-6-301129, JP-A-6-230491, JP-A-6-194768, JP-A-6-194766 and European Patent 618484A, and any of them can be used.

During the process for preparing the light-sensitive silver halide emulsion of the present invention, so-called desalting, i.e., removing excessive salts is preferably performed. The desalting may be performed by a noodle washing method where gelatin is gelled, or by a coagulation method using an inorganic salt comprising polyvalent anions (e.g., sodium sulfate), an anionic surfactant, an anionic polymer (e.g., sodium polystyrenesulfonate), or a gelatin derivative (e.g., aliphatic acylated gelatin, aromatic acylated gelatin, or aromatic carbamoylated gelatin). The coagulation method is preferably used.

The light-sensitive silver halide emulsion for use in the present invention may contain a heavy metal such as iridium, rhodium, platinum, cadmium, zinc, thallium, lead, iron and osmium, for various purposes. These compounds may be used individually or in combination of two or more thereof. The amount added varies depending upon the use purpose, however, it is generally on the order of from $10^{-9}$ to $10^{-3}$ mol per 1 mol of silver halide. The compound may be uniformly incorporated into a grain or may be localized in the inside or on the surface of a grain. Specifically, emulsions described in JP-A-2-236542, JP-A-1-116637, JP-A-6-258755, JP-A-6-235992 and Japanese Patent Application No. 4-126629 are preferably used.

In the grain formation step of the light-sensitive silver halide emulsion of the present invention, a rhodanate, an ammonia, a tetra-substituted thioether compound, an organic thioether derivative described in JP-B-47-11386, or a sulfur-containing compound described in JP-A-53-144319 may be used as a silver halide solvent.

With respect to other conditions, description in P. Glafkides, *Chimie et Physique Photographique,* Paul Montel (1967), G. F. Duffin, *Photographic Emulsion Chemistry,* The Focal Press (1966), and V. L. Zelikman et al, *Making and Coating Photographic Emulsion,* The Focal Press (1964), may be referred to. More specifically, any of an acid process, a neutral process and an ammonia process may be used, and a soluble silver salt may be reacted with a soluble halogen salt by a single jet method, a double jet method or a combination thereof. In order to obtain a monodispersed emulsion, a double jet method is preferably used.

A reverse mixing method of forming grains in the presence of excessive silver ions may also be used. Further, as one of the double jet method, a so-called controlled double jet method of maintaining the pAg in the liquid phase where silver halide is produced, constant may be used.

In order to accelerate growth of grains, the concentration, the amount and the addition rate of silver salt and halogen salt added may be increased as described, for example, in JP-A-55-142329, JP-A-55-158124 and U.S. Pat. No. 3,650,757.

The reaction solution may be stirred by any known stirring method. Further, the temperature and the pH of the reaction solution during formation of silver halide grains may be desirably selected depending upon the purpose. The pH is preferably from 2.2 to 7.0, more preferably from 2.5 to 6.0.

The light-sensitive silver halide emulsion is usually a silver halide emulsion subjected to chemical sensitization. The chemical sensitization of the light-sensitive silver halide emulsion of the present invention may be performed using a sulfur sensitization method, a reduction sensitization method, a noble metal sensitization method or a selenium sensitization method, which are known on the emulsion for conventional type light-sensitive materials, and these methods may be used individually or in combination as described, for example, in JP-A-3-110555 and Japanese Patent Application No. 4-75798. The chemical sensitization may also be performed in the presence of a nitrogen-containing heterocyclic compound as described, for example, in JP-A-62-253159).

At the chemical sensitization, the pH is preferably from 5.3 to 10.5, more preferably from 5.5 to 8.5, and the Pag is preferably from 6.0 to 10.5, more preferably from 6.8 to 9.0.

The light-sensitive silver halide for use in the present invention is coated in an amount of from 1 mg/m$^2$ to 10 g/m$^2$ in terms of silver.

The additives for use in these steps and known photographic additives which can be used in the present invention are described in RD No. 36544, ibid., No. 18716 and ibid. No. 307105, and the pertinent portions thereof are shown in the Table below.

| Kinds of Additives | RD36544 | RD18716 | RD307105 |
|---|---|---|---|
| 1. Chemical sensitizer | pp. 510–511 | p. 648, right col. | p. 866 |
| 2. Sensitivity increasing agent | | p. 648, right col. | |
| 3. Spectral sensitizer, supersensitizer | pp. 511–514 | p. 648, right col.–p. 649, right col. | pp. 866–868 |
| 4. Brightening agent | p. 514 | p. 648, right col. | p. 868 |
| 5. Antifoggant. stabilizer | pp. 515–517 | p. 649, right col. | pp. 868–870 |
| 6. Light absorbent. filter dye, UV absorbent | pp. 517–518 | p. 649, right col.–p. 650, left col. | p. 873 |
| 7. Dye image stabilizer | p. 527 | p. 650, left col. | p. 872 |

-continued

| Kinds of Additives | RD36544 | RD18716 | RD307105 |
|---|---|---|---|
| 8. Hardening agent | p. 508 | p. 651, left col. | p. 874–875 |
| 9. Binder | p. 507 | p. 651, left col. | pp. 873–874 |
| 10. Plasticizer, lubricant | p. 519 | p. 650, right col. | p. 876 |
| 11. Coating aid, surfactant | p. 519 | p. 650, right col. | pp. 875–876 |
| 12. Antistatic agent | p. 520 | p. 650, right col. | pp. 876–877 |
| 13. Matting agent | p. 521 | | pp. 878–879 |

Gelatin is advantageously used as protective colloid for use in the preparation of emulsion of the present invention or as a binder in constituent layers of light-sensitive materials or dye fixing elements. However, other hydrophilic binders may be used. Examples thereof include those described in the above-described *Research Disclosures* and JP-A-64-13546, pages (71) to (75). More specifically, a transparent or translucent hydrophilic binder is preferred and examples thereof include natural compounds, for example, protein such as gelatin and a gelatin derivative, cellulose derivatives and polysaccharides including starch, gum arabic, dextran and pluran, and synthesis polymer compounds such as polyvinyl alcohol, polyvinyl pyrrolidone and an acrylamide polymer. Further, highly water-absorptive polymers described in JP-A-62-245260, namely, homopolymers of a vinyl monomer having —COOM or —$SO_3M$ (wherein M represents a hydrogen atom or an alkali metal), and copolymers of these vinyl monomers or of the vinyl monomer with other vinyl monomer (e.g., sodium methacrylate, ammonium methacrylate, Sumikagel L-5H manufactured by Sumitomo Chemical Co., Ltd.) may also be used. These binders may be used in combination of two or more thereof. In particular, a combination of gelatin with the above-described binder is preferred. The gelatin may be selected depending upon various purposes from lime-processed gelatin, acid-processed gelatin, delimed gelatin reduced in the content of calcium or the like, and gelatin subjected to oxidation treatment to reduce the methionine residue, and these may also preferably used in combination.

In using a system where heat development is performed by supplying a slight amount of water, by using the above-described highly water-absorptive polymer, water can be swiftly absorbed. Further, when the highly water-absorptive polymer, a polyvinyl alcohol or a polysaccharide as described in Japanese Patent Application No. 5-181413 is used in the dye fixing layer or a protective layer thereof, the transferred dye is prevented from retransferring from the dye fixing element to others.

In the present invention, the binder is suitably coated in an amount of preferably 20 g/m$^2$ or less, more preferably 10 g/m$^2$ or less, still more preferably 7 g/m$^2$ or less.

The constituent layers (including back layer) of the light-sensitive material or the dye fixing element may contain various polymer latexes for the purpose of improving layer properties, such as dimensional stabilization, curling prevention, adhesion prevention, layer cracking prevention and prevention of increase or reduction in sensitivity due to pressure. Specific examples thereof include polymer latexes described in JP-A-62-245258, JP-A-62-136648 and JP-A-62-110066, and any of these can be used. In particular, when a polymer latex having a low glass transition temperature (40° C. or lower) is used, cracking of the mordant layer can be prevented, and when a polymer latex having a high glass transition temperature is used in the back layer, an effect of curling prevention can be obtained.

In the present invention, a development inhibitor-releasing redox compound can be used. For example, those described in JP-A-61-213847, JP-A-62-260153, JP-A-2-68547, JP-A-2-110557, JP-A-2-253253 and JP-A-1-150135 can be used.

The synthesis example of the development inhibitor-releasing redox compound which can be used in the present invention is described, for example, in JP-A-61-213847, JP-A-62-260153, U.S. Pat. No. 4,684,604, JP-A-1-269936, U.S. Pat. Nos. 3,379,529, 3,620,746, 4,377,634 and 4,332,878, JP-A-49-129536, JP-A-56-153336 and JP-A-56-153342.

The development inhibitor-releasing redox compound of the present invention is used in an amount of from $1\times10^{-6}$ to $5\times10^{-2}$ mol, preferably from $1\times10^{-5}$ to $1\times10^{-2}$ mol, per 1 mol of silver halide. The development inhibitor-releasing redox compound for use in the present invention may be dissolved in an appropriate water-miscible organic solvent such as an alcohol (e.g., methanol, ethanol, propanol, or fluorinated alcohol), a ketone (e.g., acetone, or methyl ethyl ketone), dimethylformamide, dimethylsulfoxide and methyl Cellosolve, before use.

Also, the compound may be dissolved by a well known emulsion dispersion method using an oil such as dibutyl phthalate, tricresyl phosphate, glyceryl triacetate or diethyl phthalate, or an auxiliary solvent such as ethyl acetate or cyclohexanone, and then mechanically formed into an emulsified dispersion before use. Alternatively, according to a so-called solid dispersion method, powder of the development inhibitor-releasing redox compound is dispersed in water by means of a ball mill, a colloid mill or ultrasonic wave, before use.

The development inhibitor-releasing redox compound can be used in combination with a releasing aid. Examples thereof are described in JP-A-3-293666.

In dispersing a hydrophobic compound in a hydrophilic colloid, various surfactants may be used. Examples thereof include surfactants described in JP-A-59-157636, pages (37) to (38).

In the present invention, compounds capable of achieving activation of development of the light-sensitive material and at the same time stabilization of the image can be used. Specific examples of compounds which are preferably used are described in U.S. Pat. No. 4,500,626, columns 51 and 52.

In the system where an image is formed by diffusion transfer of a dye, a dye fixing element is used together with the light-sensitive material. The dye fixing element may be separately coated on a support different from the light-sensitive material or may be coated on the same support as the light-sensitive material. With respect to the interrelation between the light-sensitive material and the dye fixing element, the relation to the support and the relation to the white reflecting layer, the relations described in U.S. Pat. No. 4,500,626, column 57, can be applied also to the present invention.

The dye fixing element which is preferably used in the present invention comprises at least one layer containing a mordant and a binder. The mordant may be one known in the photographic field and specific examples thereof include mordants described in U.S. Pat. No. 4,500,626, columns 58 to 59, and JP-A-61-88256, pages (32) to (41), JP-A-62-244043 and JP-A-62-244036. Also, a dye acceptable polymer compound as described in U.S. Pat. No. 4,463,079 may be used.

The dye fixing element may comprise, if desired, an auxiliary layer such as a protective layer, a release layer and a curling preventive layer. The protective layer is advantageously provided.

The constituent layers of the light-sensitive material and the dye fixing element may contain a plasticizer, a lubricant, or a high boiling point organic solvent as a releasability improver of the light-sensitive material from the dye fixing element. Specific examples thereof include those described in JP-A-62-253159, page (25), and JP-A-62-245253.

Further, for the above-described purposes, various silicone oils (all silicone oils including dimethyl silicone oil and modified silicone oils obtained by introducing various organic groups into dimethyl siloxane) can be used. Effective examples thereof include various modified silicone oils, particularly carboxy-modified silicone (trade name: X-22-3710), described in *Modified Silicone Oil* (*Technical Data*), P6-18B, published by Shin-Etsu Silicone Co., Ltd.

Further, silicone oils described in JP-A-62-215953 and JP-A-63-46449 are also effective.

The light-sensitive material or the dye fixing element may use a color fading preventing agent. Examples of the color fading preventing agent include an antioxidant, an ultraviolet absorber and a certain kind of metal complex.

Examples of the antioxidant include chroman compounds, coumaran compounds, phenol compounds (e.g., hindered phenols), hydroquinone derivatives, hindered amine derivatives and spiroindane compounds. Further, compounds described in JP-A-61-159644 are also effective.

Examples of the ultraviolet absorber include benzotriazole compounds (described, for example, in U.S. Pat. No. 3,533,794), 4-thiazolidone compounds (described, for example, in U.S. Pat. No. 3,352,681), benzophenone compounds (described, for example, in JP-A-46-2784), and the compounds described in JP-A-54-48535, JP-A-62-136641 and JP-A-61-88256. Ultraviolet absorptive polymers described in JP-A-62-260152 are also effective.

Examples of the metal complex include the compounds described in U.S. Pat. Nos. 4,241,155, 4,245,018 (columns 3 to 36) and U.S. Pat. No. 4,254,195 (columns 3 to 8), JP-A-62-174741, JP-A-61-88256, pages (27) to (29), JP-A-63-199248, JP-A-1-75568 and JP-A-1-74272.

Examples of useful color fading preventing agent are described in JP-A-62-215272, pages (125) to (137).

In order to prevent color fading of the dye transferred onto the dye fixing element, the color fading preventing agent may be previously incorporated into the dye fixing element or may be supplied to the dye fixing element from the exterior such as the light-sensitive material.

The above-described antioxidant, ultraviolet absorber and metal complex may be used in combination with one another.

The light-sensitive material or the dye fixing element may contain a fluorescent brightening agent. In particular, the fluorescent brightening agent is preferably incorporated into the dye fixing element or supplied thereto from the exterior such as the light-sensitive material. Examples thereof include the compounds described in K. Veenkataraman (compiler), *The Chemistry of Synthetic Dyes*, Chap. 8, and JP-A-61-143752. Specific examples thereof include stilbene compounds, coumarin compounds, biphenyl compounds, benzoxazolyl compounds, naphthalimide compounds, pyrazoline compounds and carbostyryl compounds.

The fluorescent brightening agent may be used in combination with a color fading preventing agent.

Examples of the hardening agent for use in the constituent layers of the light-sensitive material or the dye fixing element include the hardening agents described in U.S. Pat. No. 4,678,739, column 41, JP-A-59-116655, JP-A-62-245261 and JP-A-61-18942. Specific examples thereof include aldehyde hardening agents (e.g., formaldehyde), aziridine hardening agents, epoxy hardening agents, vinyl sulfone hardening agents (e.g., N,N'-ethylene-bis (vinylsulfonylacetamido)ethane), N-methylol hardening agents (e.g., dimethylolurea) and polymer hardening agents (e.g., the compounds described in JP-A-62-234157). In particular, vinyl sulfone hardening agents described in JP-A-3-114043 are preferably used.

The constituent layers of the light-sensitive material or the dye fixing element can use various surfactants for various purposes, such as to serve as a coating aid, to improve releasability, to improve slipperiness, to prevent electrostatic charge or to accelerate development. Specific examples of the surfactant are described in JP-A-62-173463 and JP-A-62-183457.

The constituent layers of the light-sensitive material or the dye fixing element may contain an organic fluoro compound so as to improve slipperiness, to prevent electrostatic charge or to improve releasability. Representative examples of the organic fluoro compound include fluorine surfactants, oily fluorine compounds such as fluorine oil, and hydrophobic fluorine compounds such as solid fluorine compound resin (e.g., tetrafluoroethylene resin), described in JP-B-57-9053, columns 8 to 17, JP-A-61-20944 and JP-A-62-135826.

The light-sensitive material or the dye fixing element may contain a matting agent. Examples of the matting agent include the compounds described in JP-A-61-88256, page (29), such as silicon dioxide, polyolefin and polymethacrylate, and the compounds described in JP-A-63-274944 and JP-A-63-274952, such as benzoguanamine resin bead, polycarbonate resin bead and AS resin bead.

In addition, the constituent layers of the light-sensitive material or the dye fixing element may contain a thermal solvent, a deforming agent, an antiseptic/antimold or colloidal silica. Specific examples of these additives are described in JP-A-61-88256, pages (26) to (32).

In the present invention, an image formation accelerator may be used in the constituent layers of the light-sensitive material and/or the dye fixing element. The image formation accelerator has functions of accelerating the oxidation-reduction reaction of a silver salt oxidizing agent with a reducing agent, accelerating the reaction such as product ion of a dye from a dye donating material, decomposition of a dye or release of a diffusible dye, or accelerating transfer of a dye from the light-sensitive material layer to the dye fixing layer. The image formation accelerator is classified in view of its physicochemical functions into a base or base precursor, a nucleophilic compound, a high boiling point organic solvent (oil), a thermal solvent, a surfactant and a compound interactive with silver or silver ion. However, these materials each generally has a composite function and usually provides several acceleration effects described above at the same time. This is described in detail in U.S. Pat. No. 4,678,739, columns 38 to 40.

The base precursor includes salts of an organic acid which is decarboxylated by heat, with a base, and compounds which release an amine by intramolecular nucleophilic substitution reaction, Rossen rearrangement or Beckmann rearrangement. Specific examples thereof are described in U.S. Pat. No. 4,511,493 and JP-A-62-65038.

In a system where heat development and transfer of a dye are simultaneously performed in the presence of a slight amount of water, the base and/or the base precursor are preferably incorporated into the dye fixing element so as to increase preservability of the light-sensitive material.

In the present invention, a combination of a difficultly soluble metal compound described in European Unexamined Patent Publication 210,660 and U.S. Pat. No. 4,740,445, with a compound (called a complex forming compound) capable of complex forming reaction with a metal ion constituting the difficultly soluble metal compound, is used. Specific examples of the combination are described in JP-A-2-269338, pages (2) to (6). Particularly preferred compounds as the difficultly soluble metal compound are zinc hydroxide, zinc oxide and a combination of these two compounds.

In the light-sensitive material and/or the dye fixing element, various development stopping agents so as to always obtain a constant image against fluctuation of the processing temperature and the processing time at the development may be used.

The term "development stopping agent" as used herein means a compound which, after proper development, rapidly neutralizes the base or reacts with the base to reduce the base concentration in the layer to thereby stop the development, or a compound which interact with silver or silver salt to inhibit development. Specific examples thereof include acid precursors which release an acid upon heating, electrophilic compounds which undergo substitution reaction with the base present together upon heating, nitrogen atom-containing heterocyclic compounds, mercapto compounds and precursors thereof. The development stopping agent is more specifically described in JP-A-62-253159, pages (31) to (32).

The support used in the light-sensitive material or the dye fixing element of the present invention is one capable of withstanding the processing temperature. In general, paper and synthetic polymer (film) are used. Specific examples thereof include polyethylene terephthalate, polycarbonate, polyvinyl chloride, polystyrene, polypropylene, polyimide, celluloses (e.g., triacetyl cellulose), those obtained by incorporating a pigment such as titanium oxide into the above-described film, film processed synthetic paper formed from polypropylene or the like, mixed paper formed from synthetic resin pulp such as polyethylene, and natural pulp, Yankee paper, baryta paper, coated paper (particularly, cast-coated paper), metals, cloths and glasses.

These may be used individually or may be used as a support having laminated on one surface thereof or on both surfaces thereof a synthetic polymer such as polyethylene.

In addition, the supports described in JP-A-62-253159, pages (29) to (31) can be used.

On the surface of the support, a hydrophilic binder and an antistatic agent such as a semiconductor metal oxide (e.g., alumina sol or tin oxide) or carbon black may be coated.

Examples of the method for exposing and recording an image on the light-sensitive material include a method of directly photographing a scene or a person using a camera, a method of exposing an image through a reversal film or negative film using a printer or an enlarger, a method of scan exposing an original through a slit using an exposing device of a copying machine, a method of exposing image information through electric signals by emitting light from a light emitting diode or various lasers, and a method of outputting image information on an image display apparatus such as CRT, liquid crystal display, electroluminescense display or plasma display and exposing an image directly or through an optical system.

The light source for use in recording an image on the light-sensitive material may be a light source described in U.S. Pat. No. 4,500,626, column 56, such as natural light, a tungsten lamp, a light emitting diode, a laser light source and a CRT light source, as described above.

Further, image exposure may be performed using a wavelength conversion element in which a nonlinear optical material is combined with a coherent light source such as laser. The term "nonlinear optical material" as used herein means a material capable of creating nonlinearity between polarization and electric field, to be generated when a strong photoelectric field such as laser light is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432 are preferably used. Known examples of the shape of the wavelength conversion element include a single crystal optical waveguide type element and a fiber type element, and either element is useful.

The above-described image information can use image signals obtained from a video camera or electronic still camera, television signals such as the Nippon Television Signal Code (NTSC), image signals obtained by dividing an original into plural pixels with a scanner, or image signals formed by using a computer such as CG or CAD.

The light-sensitive material and/or the dye-fixing element may have an electrically conductive heating element layer as a heating means for the heat development or diffusion transfer of a dye. In this case, heating elements described in JP-A-61-145544 may be used as a transparent or opaque heating element. The above-described electrically conductive layer functions also as an antistatic layer.

The heating temperature in the heat development step may be from about 50° C. to about 250° C., but a temperature of from about 80° C. to about 180° C. is particularly useful. The diffusion transfer of a dye may be performed simultaneously with the heat development or after completion of the heat development. In the latter case, the transfer of a dye may be made at a heating temperature in the transfer step of from the temperature in the heat development step to room temperature, however, a temperature of from 50° C. to a temperature about 10° C. lower than the temperature in the heat development step is more preferred.

Transfer of a dye may be effected only by heat, but a solvent may also be used so as to accelerate transfer of a dye. Further, as described in detail in JP-A-59-218443 and JP-A-61-238056, a method of simultaneously or continuously performing development and transfer in the presence of a small amount of a solvent (in particular, water) under heating is also useful. In this method, the heating temperature is preferably from 50° C. to the boiling point of the solvent. For example, when the solvent is water, the temperature is preferably from 50 to 100° C.

Examples of the solvent used for accelerating development and/or transferring a diffusible dye to the dye fixing layer include water and a basic aqueous solution containing an inorganic alkali metal salt or an organic base (examples of the base include those described in the item of the image formation accelerator). In addition, a low boiling point solvent or a mixed solution of a low boiling point solvent with water or a basic aqueous solution can also be used. Further, the solvent may contain a surfactant, an antifoggant or a complex-forming compound with a difficultly soluble metal salt.

The solvent can be used in either or both of the dye fixing element and the light-sensitive material. The amount of the solvent used may be small as equal to or less than the weight of the solvent corresponding to the maximum swollen volume of all coated layers (particularly, equal to or less than the weight obtained by subtracting the weight of all coated layers from the weight of the solvent corresponding to the maximum swollen volume of all coated layers).

The solvent is applied to the light-sensitive layer or the dye fixing layer, for example, by the method described in JP-A-61-147244, page (26). The solvent encapsulated in a microcapsule may be previously incorporated into either or both of the light-sensitive material and the dye-fixing material.

In order to accelerate transfer of a dye, a method of incorporating a hydrophilic thermal solvent which is solid at room temperature but melts at a high temperature, into the light-sensitive material or the dye-fixing element may also be used. The hydrophilic thermal solvent may be incorporated into either or both of the light-sensitive material and the dye-fixing element. The layer to which the solvent is added may be any of the emulsion layer, the interlayer, the protective layer and the dye-fixing layer, but the solvent is preferably incorporated into the dye-fixing layer and/or layer(s) adjacent thereto.

Examples of the hydrophilic thermal solvent include ureas, pyridines, amides, sulfonamides, imides, alcohols, oximes and other heterocyclic compounds.

Also, in order to accelerate transfer of a dye, a high boiling point organic solvent may be incorporated into the light-sensitive material and/or the dye fixing element.

Heating in the development and/or transfer step may be performed by putting the material into contact with a heated block or plate, or with a hot plate, a hot presser, a hot roller, a halogen lamp heater or an infrared or far infrared lamp heater or by passing the material through a high temperature atmosphere.

With respect to the pressurizing conditions and the application method of pressure in superposing the light-sensitive element on the dye fixing element to closely adhere to each other, the method described in JP-A-61-147244, page 27, can be used.

In processing the photographic element of the present invention, any of various heat-developing apparatuses can be used. For example, apparatuses described in JP-A-59-75247, JP-A-59-177547, JP-A-59-181353, JP-A-60-18951, JP-U-A-62-25944 (the term "JP-U-A" as used herein means an "unexamined published Japanese utility model application"), JP-A-3-131856, and JP-A-3-131851 are preferably used.

The silver halide color photographic light-sensitive material containing the cyan dye image forming compound according to the present invention provides a cyan color image excellent in fastness to light, humidity and heat.

The present invention will be described in greater detail with reference to the following examples, however, the present invention should not be construed as being limited thereto.

EXAMPLE 1A

A preparation method of a dispersion of zinc hydroxide is described below.

To 100 ml of a 4% aqueous gelatin solution, 12.5 g of zinc hydroxide having an average particle size of 0.2 μm, 1 g of carboxymethyl cellulose as a dispersant, and 0.1 g of sodium polyacrylate were added, and the mixture was ground in a mill for 30 minutes together with glass beads having an average particle size of 0.75 mm. The glass beads were separated to obtain a zinc hydroxide dispersion.

A preparation method of a dispersion of an electron transfer agent is described below.

To a 5% aqueous gelatin solution, 10 g of an electron transfer agent shown below, 0.4 g of carboxymethyl cellulose (Celogen 6A, trade name, manufactured by Dai-Ichi Kogyo Seiyaku Co., Ltd.) and 0.2 g of an anionic surfactant shown below were added, and the mixture was ground in a mill for 60 minutes together with glass beads having an average particle size of 0.75 mm. The glass beads were separated to obtain an electron transfer agent dispersion having an average particle size of 0.35 μm.

Electron transfer agent:

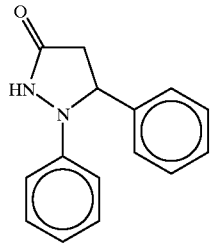

Anionic surfactant:

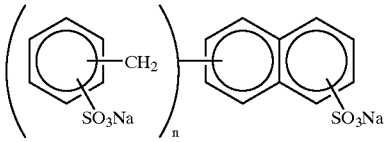

A preparation method of a dye trapping agent dispersion is described below.

To a mixed solution containing 108 ml of a polymer latex (solid content: 13%) shown below, 20 g of a surfactant shown below and 1,232 ml of water, under stirring, 600 ml of a 5% aqueous solution of an anionic surfactant shown below was added over a period of 10 minutes. The thus-obtained dispersion was concentrated and desalted to 500 ml using an ultrafiltration module. Then, 1,500 ml of water was added thereto and the same operation was again repeated to obtain 500 g of a dye trapping agent dispersion.

Polymer Latex:

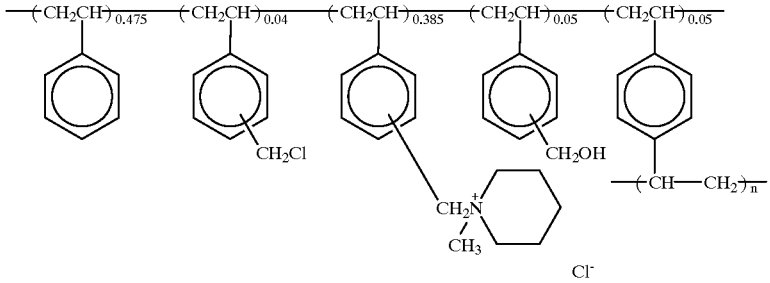

Surfactant:

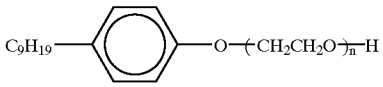

$n = 50$

Anionic Surfactant:

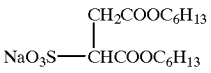

A preparation method of a gelatin dispersion of a hydrophobic additive is described below.

A gelatin dispersion of each of a cyan dye donating compound, a magenta dye donating compound, a yellow dye donating compound and an electron donor is prepared according to the formulation shown in Table 1A below. More specifically, each oil phase component was dissolved under heating at about 60° C. to form a uniform solution, an aqueous phase component heated at about 60° C. was added to the solution, and the components was mixed under stirring and then dispersed in a homogenizer for 13 minutes at 12,000 rpm. Water was added thereto and the mixture was stirred to obtain a homogenous dispersion.

Then, the gelatin dispersion of each of the magenta dye donating compound and the cyan dye donating compound was subjected to repetition of dilution with water and concentration using an ultrafiltration module (Ultra-filtration Module ACV-3050, manufactured by Asahi Chemical Industry Co., Ltd.) to reduce the weights of ethyl acetate and methyl ethyl ketone to ⅙ of the weights shown in Table 1A.

TABLE 1A

| | Composition of Dispersion | | | |
|---|---|---|---|---|
| | Cyan | Magenta | Yellow | Electron Donor |
| Oil phase | | | | |
| Dye Donating Compound (1) | 9.05 g | — | — | — |
| Dye Donating Compound (2) | 6.19 g | — | — | — |
| Dye Donating Compound (3) | — | 15.5 g | — | — |
| Dye Donating Compound (4) | — | — | 9.77 g | — |
| Dye Donating Compound (5) | — | — | 0.027 g | — |
| Electron Donor (1) | 4.36 g | 5.73 g | 4.21 g | — |
| Electron Donor (2) | — | — | — | 13.9 g |
| Electron Donor (3) | — | 0.26 g | 0.54 g | — |
| Electron Transfer Agent Precursor | 1.42 g | 1.42 g | 0.86 g | — |
| Compound (1) | 0.18 g | 0.22 g | 0.21 g | — |
| Compound (2) | 1.53 g | 1.94 g | — | — |
| Compound (3) | 1.52 g | 1.94 g | — | — |
| Development Inhibitor Precursor | — | — | — | 2.63 g |
| High Boiling Point Solvent (1) | 1.91 g | 1.94 g | 3.67 g | — |
| High Boiling Point Solvent (2) | 7.60 g | 7.73 g | 3.67 g | 2.93 g |
| High Boiling Point Solvent (3) | — | — | — | 2.94 g |
| Surfactant (2) | 1.55 g | 0.52 g | 1.50 g | 0.45 g |
| Ethyl acetate | 37.9 ml | 38.0 ml | 25.0 ml | 18.0 ml |
| Methyl ethyl ketone | 58.8 ml | 59.1 ml | — | — |
| Aqueous phase | | | | |
| Lime-processed gelatin | 10.0 g | 10.0 g | 10.0 g | 10.0 g |
| Citric acid | — | — | — | 0.06 g |
| Carboxymethyl cellulose | — | 1.0 g | — | — |
| Sodium hydrogensulfite | — | 0.04 g | — | 0.15 g |
| Water | 150 ml | 150 ml | 120 ml | 100 ml |
| Water | 140 ml | 160 ml | 125 ml | 65 ml |

Dye Donating Compound (1):

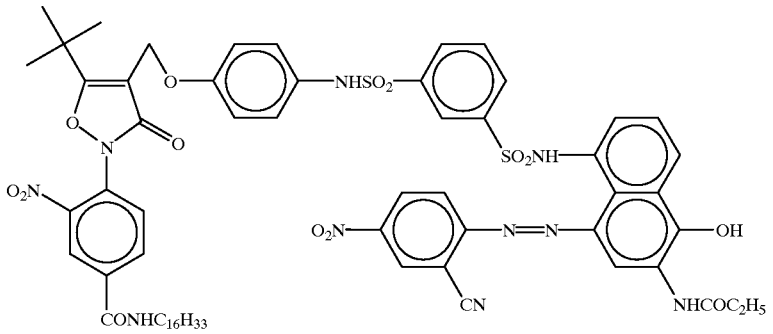

TABLE 1A-continued
Dye Donating Compound (2):
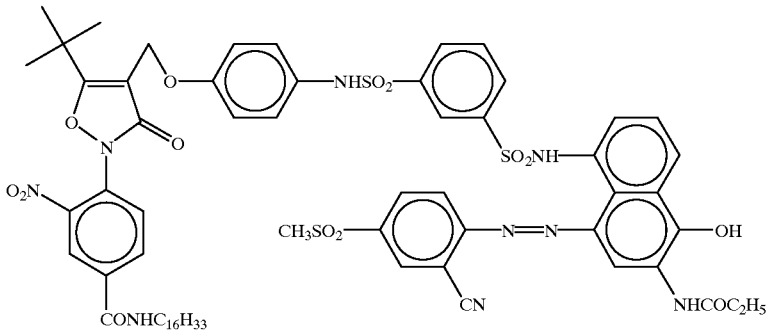
Dye Donating Compound (3):
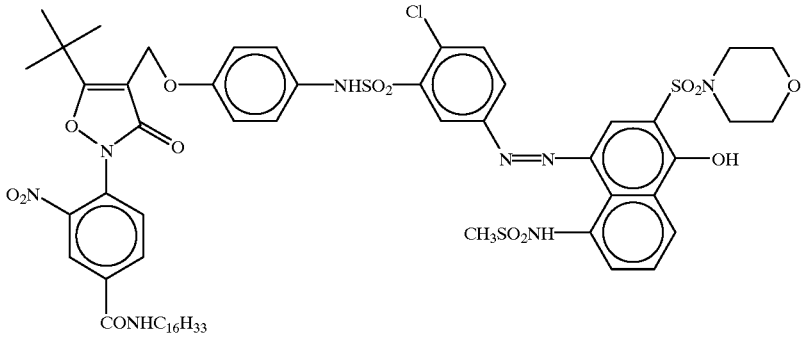
Dye Donating Compound (4):
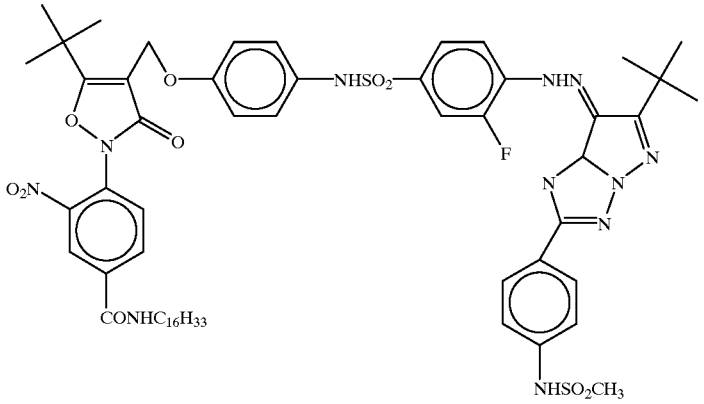
Dye Donating Compound (5):
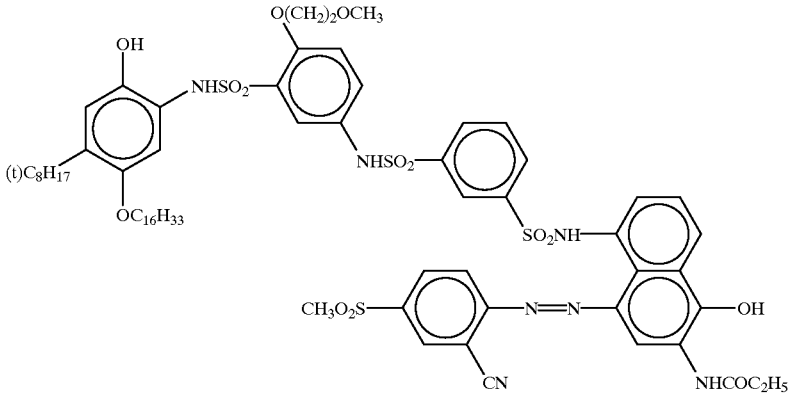

TABLE 1A-continued
Electron Donor (1):
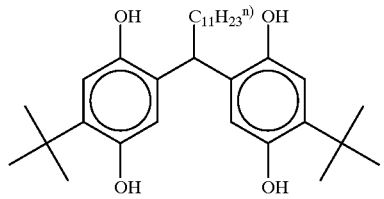
Electron Donor (2):
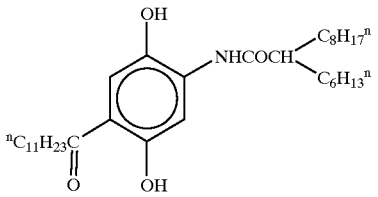
Electron Donor (3):
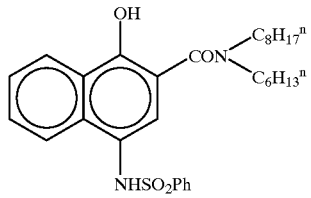
Electron Transfer Agent Precursor:
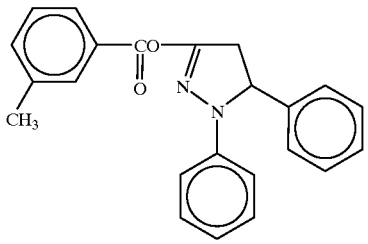
Compound (1):
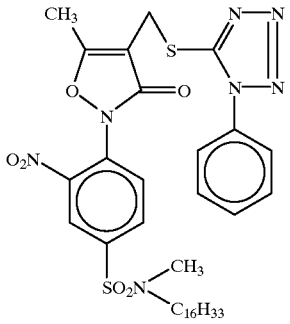
Compound (2):
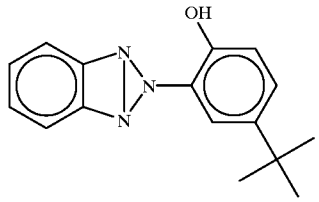

TABLE 1A-continued

Compound (3):

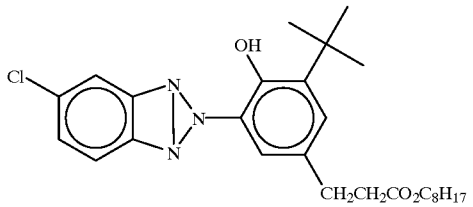

High Boiling Point Solvent (1):

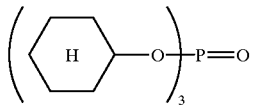

Development Inhibitor Precursor:

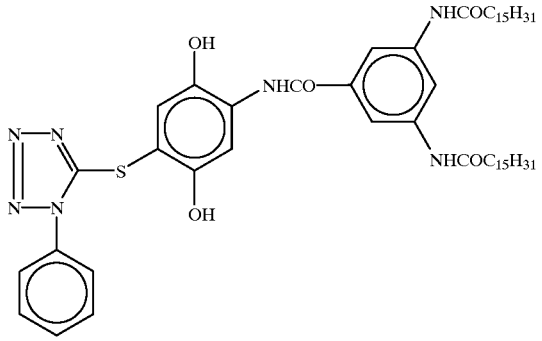

High Boiling Point Solvent (2):

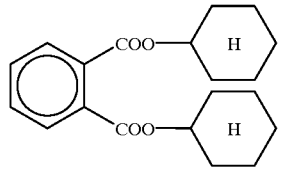

High Boiling Point Solvent (3):

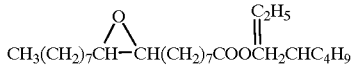

Surfactant (2):

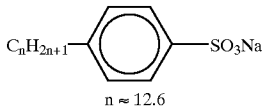

Preparation of a light-sensitive silver halide emulsion is described below.

Light-Sensitive Silver Halide Emulsion (1) (for red-sensitive emulsion layer):

To a well stirred aqueous gelatin solution (obtained by adding 20 g of gelatin, 0.5 g of potassium bromide, 2.5 g of sodium chloride and 15 mg of Chemical (A) shown below to 700 ml of water and kept at 42° C.), Solution (I) and Solution (II) shown in Table 2A below were added simultaneously at a constant flow rate over a period of 8 minutes. Eight minutes after completion of the addition of Solution (I) and Solution (II), an aqueous solution of a gelatin dispersion of dyes (containing 1.9 g of gelatin, 127 mg of Dye (a) shown below, 253 mg of Dye (b) shown below and 8 mg of Dye (c) shown below in 160 ml of water and kept at 35° C.) was added. After 2 minutes, Solution (III) and Solution (IV) shown in Table 2A below were further added simultaneously at a constant flow rate over a period of 32 minutes.

The mixture was washed with water and desalted by a conventional method, 22 g of a lime-processed ossein gelatin and 50 mg of Chemical (B) shown below were added thereto, the pH and the pAg were adjusted to 6.2 and 7.8, respectively, 4-hydroxy-6-methyl-1,3,3a,7-tetrazaindene was added thereto, then sodium thiosulfate and chloroauric acid were added thereto, optimal chemical sensitization was conducted at 68° C., and after adding Antifoggant (1) shown below, 80 mg of Chemical (C) shown below and 3 g of Chemical (D) shown below, the mixture was cooled. As a result, 635 g of a monodispersed cubic silver chlorobromide emulsion having an average grain size of 0.21 μm was obtained.

TABLE 2

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.19 g | — | 0.19 g | — |
| KBr | — | 9.9 g | — | 45.1 g |
| NaCl | — | 2.1 g | — | 5.4 g |
| | Water to make 110 ml | Water to make 110 ml | Water to make 250 ml | Water to make 250 ml |

Chemical (A):

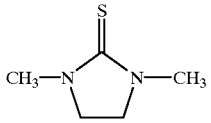

Chemical (B):

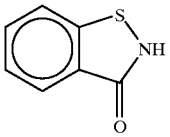

Chemical (C):

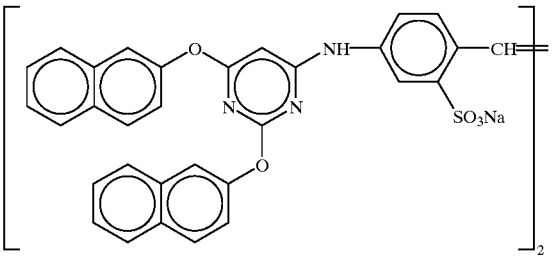

Chemical (D):

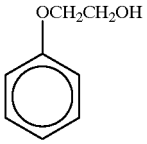

Dye (a):

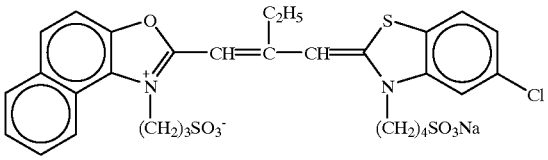

Dye (b):

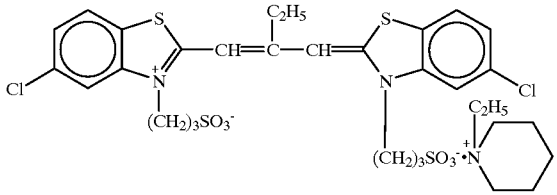

TABLE 2-continued

| | Solution (I) | Solution (II) | Solution (III) | Solution (IV) |
|---|---|---|---|---|

Dye (c):

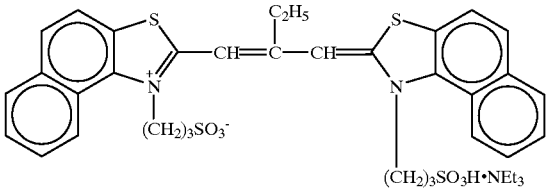

Light-Sensitive Silver Halide Emulsion (2) (for red-sensitive emulsion layer):

To a well stirred aqueous gelatin solution (obtained by adding 20 g of gelatin, 0.3 g of potassium bromide, 9 g of sodium chloride and 15 mg of Chemical (A) described above to 700 ml of water and kept at 53° C.), Solution (I) and Solution (II) shown in Table 3A below were added simultaneously at a constant flow rate over a period of 10 minutes. Six minutes after completion of the addition of Solution (I) and Solution (II), an aqueous solution of a gelatin dispersion of dyes (containing 1.2 g of gelatin, 77 mg of Dye (a) described above, 153 mg of Dye (b) described above, and 5 mg of Dye (c) described above, in 115 ml of water and kept at 45° C.) was added. After 4 minutes, Solution (III) and Solution (IV) shown in Table 3A below were further added simultaneously at a constant flow rate over a period of 30 minutes.

The mixture was washed with water and desalted by a conventional method, 33 g of a lime-processed ossein gelatin and 50 mg of Chemical (B) described above were added, the pH and the pAg were adjusted to 6.2 and 7.8, respectively, 4-hydroxy-6-methyl-1,3,3a,7-tetrazaindene was added thereto, then sodium thiosulfate and chloroauric acid were added thereto, optimal chemical sensitization was conducted at 68° C. and after adding Antifoggant (1) shown below, 80 mg of Chemical (C) described above and 3 g of Chemical (D) described above, the mixture was cooled. As a result, 635 g of a monodispersed cubic silver chlorobromide emulsion having an average grain size of 0.45 μm was obtained.

TABLE 3A

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.19 g | — | 0.19 g | — |
| KBr | — | 12.2 g | — | 42.0 g |
| NaCl | — | 2.6 g | — | 5.2 g |
| | Water to make 120 ml | Water to make 120 ml | Water to make 225 ml | Water to make 225 ml |

Light-Sensitive Silver Halide Emulsion (3) (for green-sensitive emulsion layer):

To a well stirred aqueous gelatin solution (obtained by adding 20 g of gelatin, 0.5 g of potassium bromide, 5 g of sodium chloride and 15 mg of Chemical (A) described above to 690 ml of water and kept at 41° C.), Solution (I) and Solution (II) shown in Table 4A below were added simultaneously at a constant flow rate over a period of 8 minutes. After 10 minutes, Solution (III) and Solution (IV) shown in Table 4A below were further added simultaneously at a constant flow rate over a period of 32 minutes. One minute after completion of the addition of Solution (III) and Solution (IV), a methanol solution of a dye (containing 280 mg of Dye (d) shown below in 47 ml of methanol and kept at 30° C.) was added collectively.

The mixture was washed with water and desalted by a conventional method, 22 g of a lime-processed ossein gelatin, 50 mg of Chemical (B) described above and 3 g of Chemical (D) described above were added, the pH and the pAg were adjusted to 6.0 and 7.1, respectively, 4-hydroxy-6-methyl-1,3,3a,7-tetrazaindene was added thereto, then sodium thiosulfate was added thereto, optimal chemical sensitization was conducted at 60° C. and after adding Antifoggant (1) shown below, the mixture was cooled. As a result, 635 g of a monodispersed cubic silver chlorobromide emulsion having an average grain size of 0.23 μm was obtained.

TABLE 4A

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.06 g | — | 0.06 g | — |
| KBr | — | 4.9 g | — | 22.6 g |
| NaCl | — | 4.5 g | — | 16.6 g |
| $K_2IrCl_4$ | | 0.008 mg | — | |
| | Water to make 110 ml | Water to make 110 ml | Water to make 240 ml | Water to make 240 ml |

Dye (d):

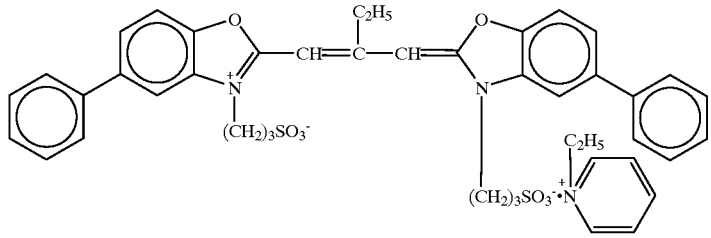

Light-Sensitive Silver Halide Emulsion (4) (for green-sensitive emulsion layer):

To a well stirred aqueous gelatin solution (obtained by adding 20 g of gelatin, 0.3 g of potassium bromide, 9 g of sodium chloride and 7.5 mg of Chemical (A) described above to 710 ml of water and kept at 63° C.), Solution (I) and Solution (II) shown in Table 5A below were added simultaneously at a constant flow rate over a period of 10 minutes. After 10 minutes, Solution (III) and Solution (IV) shown in Table 5A below were further added simultaneously at a constant flow rate over a period of 20 minutes. One minute after completion of the addition of Solution (III) and Solution (IV), a methanol solution of a dye (containing 170 mg of Dye (d) described above in 35 ml of methanol and kept at 46° C.) was added collectively.

The mixture was washed with water and desalted by a conventional method, 33 g of a lime-processed ossein gelatin, 50 mg of Chemical (B) described above and 3 g of Chemical (D) described above were added, the pH and the pAg were adjusted to 6.0 and 7.2, respectively, 4-hydroxy-6-methyl-1,3,3a,7-tetrazaindene was added thereto, then sodium thiosulfate and chloroauric acid were added thereto, optimal chemical sensitization was conducted at 60° C. and after adding Antifoggant (1) shown below, the mixture was cooled. As a result, 635 g of a monodispersed cubic silver chlorobromide emulsion having an average grain size of 0.45 μm was obtained.

TABLE 5A

| | Solution (I) | Solution (II) | Solution (III) | Solution (IV) |
|---|---|---|---|---|
| $AgNO_3$ | 25.0 g | — | 75.0 g | — |
| $NH_4NO_3$ | 0.06 g | — | 0.06 g | — |
| KBr | — | 6.2 g | — | 21.1 g |
| NaCl | — | 5.6 g | — | 15.5 g |
| $K_4[Fe(CN)_6]$ | — | — | — | 4 mg |
| | Water to make 120 ml | Water to make 120 ml | Water to make 225 ml | Water to make 225 ml |

Light-Sensitive Silver Halide Emulsion (5) (for blue-sensitive emulsion layer):

To a well stirred aqueous gelatin solution (obtained by adding 20 g of gelatin, 0.5 g of potassium bromide, 5 g of sodium chloride and 15 mg of Chemical (A) described above to 690 ml of water and kept at 46° C.), Solution (I) and Solution (II) shown in Table 6A below were added simultaneously at a constant flow rate over a period of 8 minutes. After 10 minutes, Solution (III) and Solution (IV) shown in Table 6A below were further added simultaneously at a constant flow rate over a period of 18 minutes. One minute after completion of the addition of Solution (III) and Solution (IV), an aqueous solution of dyes (containing 225 mg of Dye (e) shown below and 225 mg of Dye (f) shown below in 95 ml of water and 5 ml of methanol and kept at 30° C.) was added collectively.

The mixture was washed with water and desalted by a conventional method, 22 g of a lime-processed ossein gelatin, 50 mg of Chemical (B) described above and 3 g of Chemical (D) described above were added, the pH and the pAg were adjusted to 6.0 and 7.7, respectively, 4-hydroxy-6-methyl-1,3,3a,7-tetrazaindene was added thereto, then sodium thiosulfate were added thereto, optimal chemical sensitization was conducted at 65° C. and after adding Antifoggant (1) shown below, the mixture was cooled. As a result, 635 g of a monodispersed cubic silver chlorobromide emulsion having an average grain size of 0.27 μm was obtained.

TABLE 6A

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.06 g | — | 0.06 g | — |
| KBr | — | 9.9 g | — | 45.0 g |
| NaCl | — | — | — | 7.6 g |
| $K_4[Fe(CN)_6]$ | — | — | — | 7 mg |
| | Water to make 110 ml | Water to make 110 ml | Water to make 240 ml | Water to make 240 ml |

Dye (e):

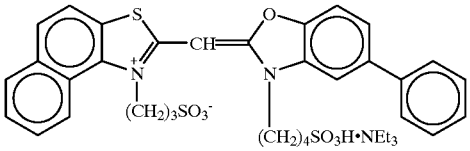

Dye (f):

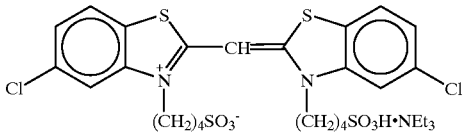

Light-Sensitive Silver Halide Emulsion (6) (for blue-sensitive emulsion layer):

To a well stirred aqueous gelatin solution (obtained by adding 20 g of gelatin, 0.3 g of potassium bromide, 9 g of sodium chloride and 15 mg of Chemical (A) described above to 710 ml of water and kept at 59° C.), Solution (I) and Solution (II) shown in Table 7A below were added simultaneously at a constant flow rate over a period of 8 minutes. After 10 minutes, Solution (III) and Solution (IV) shown in Table 7A below were further added simultaneously at a constant flow rate over a period of 18 minutes. One minute after completion of the addition of Solution (III) and Solution (IV), an aqueous solution of dyes (containing 113 mg of Dye (e) described above and 113 mg of Dye (f) described above in 82 ml of water and 6 ml of methanol and kept at 40° C.) was added collectively.

The mixture was washed with water and desalted by a conventional method, 33 g of a lime-processed ossein gelatin, 50 mg of Chemical (B) described above and 3 g of Chemical (D) described above were added, the pH and the pAg were adjusted to 6.0 and 7.7, respectively, 4-hydroxy-6-methyl-1,3,3a,7-tetrazaindene was added thereto, then sodium thiosulfate and chloroauric acid were added thereto, optimal chemical sensitization was conducted at 65° C. and after adding Antifoggant (1) shown below, the mixture was cooled. As a result, 635 g of a monodispersed cubic silver chlorobromide emulsion having an average grain size of 0.47 $\mu$m was obtained.

TABLE 7A

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.06 g | — | 0.06 g | — |
| KBr | — | 10.0 g | — | 45.0 g |
| NaCl | — | 4.2 g | — | 5.5 g |
| | Water to make 100 ml | Water to make 100 ml | Water to make 260 ml | Water to make 260 ml |

Light-Sensitive Material K101 having a composition shown in Table 8A below was prepared.

TABLE 8A

Composition of Light-Sensitive Material K101

| Layer | Name of Layer | Additives | | Coating Amount ($mg/m^2$) |
|---|---|---|---|---|
| Seventh Layer | Protective Layer II | Acid-processed gelatin | | 340 |
| | | PMMA Latex (size 3 $\mu$m) | | 13.3 |
| | | Colloid silver | | 0.8 |
| | | Surfactant (3) | | 15.8 |
| | | Fluorine Surfactant | | 5 |
| | | Calcium nitrate | | 6 |
| Sixth Layer | Protective Layer I | Lime-processed gelatin | | 590 |
| | | Zinc hydroxide | | 490 |
| | | Electron Donor (2) | | 100 |
| | | Development Inhibitor Precursor | | 18.8 |
| | | High Boiling Point Solvent (2) | | 21 |
| | | High Boiling Point Solvent (3) | | 21 |
| | | Dextran | | 17 |
| | | Water-Soluble Polymer (1) | | 3 |
| | | Polymer Latex (1) | | 33 |
| | | Surfactant (4) | | 18 |
| | | Surfactant (2) | | 3 |
| Fifth Layer | Blue-Sensitive Emulsion Layer | Light-Sensitive Silver Halide Emulsion (5) | as Ag | 440 |
| | | Light-Sensitive Silver Halide Emulsion (6) | as Ag | 135 |
| | | Dye Donating Compound (4) | | 300 |
| | | Gelatin | | 631 |
| | | Electron Donor (1) | | 130 |
| | | Electron Donor (3) | | 17 |
| | | Electron Transfer Agent Precursor | | 27 |
| | | Compound (1) | | 6 |
| | | High Boiling Point Solvent (1) | | 114 |
| | | High Boiling Point Solvent (2) | | 114 |
| | | Surfactant (2) | | 45 |

TABLE 8A-continued

| | | | | |
|---|---|---|---|---|
| | | Antifoggant (1) | | 1.2 |
| | | Water-Soluble Polymer (1) | | 23 |
| Fourth Layer | Interlayer | Lime-processed gelatin | | 520 |
| | | Electron Donor (2) | | 151 |
| | | Development Inhibitor Precursor | | 29 |
| | | High Boiling Point Solvent (2) | | 32 |
| | | High Boiling Point Solvent (3) | | 32 |
| | | Surfactant (2) | | 5 |
| | | Polymer Latex (1) | | 19 |
| | | Electron Transfer Agent | | 77 |
| | | Dextran | | 36 |
| | | Hardening Agent (1) | | 43 |
| | | Surfactant (4) | | 10 |
| | | Water-Soluble Polymer (1) | | 20 |
| | | Carboxymethyl cellulose | | 3 |
| | | Surfactant (1) | | 1.5 |
| Third Layer | Green-Sensitive Emulsion Layer | Light-Sensitive Silver Halide Emulsion (3) | as Ag | 280 |
| | | Light-Sensitive Silver Halide Emulsion (4) | as Ag | 110 |
| | | Dye Donating Compound (3) | | 366 |
| | | Lime-processed gelatin | | 460 |
| | | Electron Donor (1) | | 136 |
| | | Electron Donor (3) | | 6 |
| | | Electron Transfer Agent Precursor | | 34 |
| | | Compound (1) | | 6 |
| | | Compound (2) | | 46 |
| | | Compound (3) | | 46 |
| | | High Boiling Point Solvent (1) | | 46 |
| | | High Boiling Point Solvent (2) | | 183 |
| | | Antifoggant (1) | | 1.0 |
| | | Water-Soluble Polymer (1) | | 16 |
| | | Surfactant (2) | | 8 |
| | | Carboxymethyl cellulose | | 23.6 |
| Second Layer | Interlayer | Lime-processed gelatin | | 970 |
| | | Zinc hydroxide | | 800 |
| | | Electron Donor (2) | | 165 |
| | | Development Inhibitor Precursor | | 31 |
| | | High Boiling Point solvent (2) | | 35 |
| | | High Boiling Point Solvent (3) | | 35 |
| | | Surfactant (2) | | 5 |
| | | Dextran | | 28 |
| | | Water-Soluble Polymer (1) | | 5 |
| | | Polymer Latex (1) | | 55 |
| | | Surfactant (4) | | 30 |
| First Layer | Red-Sensitive Emulsion Layer | Light-Sensitive Silver Halide Emulsion (1) | as Ag | 145 |
| | | Light-Sensitive Silver Halide Emulsion (2) | as Ag | 80 |
| | | Dye Donating Compound (1) | | 188 |
| | | Dye Donating Compound (2) | | 128 |
| | | Lime-processed gelatin | | 322 |
| | | Electron Donor (1) | | 90 |
| | | Electron Transfer Agent Precursor | | 29 |
| | | Compound (1) | | 4 |
| | | Compound (2) | | 31 |
| | | Compound (3) | | 31 |
| | | High Boiling Point Solvent (1) | | 39 |
| | | High Boiling Point Solvent (2) | | 158 |
| | | Antifoggant (1) | | 0.7 |
| | | Water-Soluble Polymer (1) | | 12 |
| | | Surfactant (2) | | 22 |
| Support (1) | | Polyethylene-laminated paper support (thickness: 131 μm) | | |

Support (1)

| Layer | Composition | Thickness (μm) |
|---|---|---|
| Front Surface Subbing Layer | Gelatin | 0.1 |
| Front Surface PE Layer (glossy) | Low-density polyethylene (density: 0.923): 89.2 parts Surface-treated titanium oxide: 10.0 parts | 36.0 |
| Pulp Layer | Wood free paper (LBKP/NBKP = 1/1, density: 1.080) | 64.0 |
| Back Surface PE Layer (mat) | High-density polyethylene (density: 0.960) | 31.0 |
| Back Surface Subbing Layer | Gelatin | 0.05 |

TABLE 8A-continued
| | | |
|---|---|---|
| Colloidal Silica | | 0.05 |
| | Total | 131.2 |
Surfactant (3):
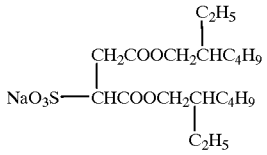
Surfactant (4):
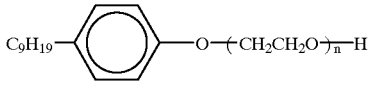
n = 50
Antifoggant (1):
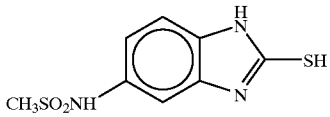
Fluorine Surfactant:
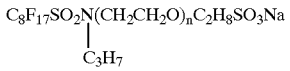
n = 4.5
Water-Soluble Polymer (1):
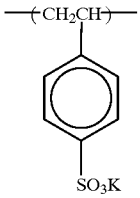
Hardening Agent (1):
$CH_2{=}CHSO_2CH_2SO_2CH{=}CH_2$
Polymer Latex (1):
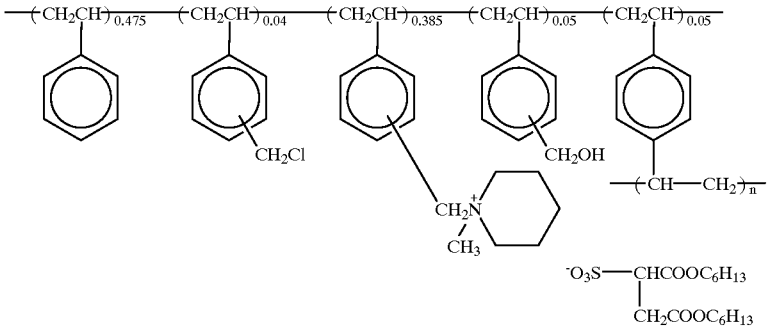

Light-Sensitive Materials K102 to K104 were prepared in the same manner as in Light-Sensitive Material K101 except for using the dye donating compound according to the present invention shown in Table 9A below in place of Dye Donating Compound (1) in the first layer, respectively.

TABLE 9A

| Light-Sensitive Material | Dye Donating Compound | Remarks |
|---|---|---|
| K101 | Dye Donating Compound (1) | Comparison |
| K102 | Compound 12a | Invention |
| K103 | Compound 13a | Invention |
| K104 | Compound 24a | Invention |

Preparation of an image receiving material is described below.

Image Receiving Material R101 having a composition shown in Table 10A below was prepared.

TABLE 10A

Composition of Image Receiving Material R101

| Layer | Additives | Coating Amount ($mg/m^2$) |
|---|---|---|
| Sixth Layer | Water-Soluble Polymer (1) | 130 |
| | Water-Soluble Polymer (2) | 35 |
| | Water-Soluble Polymer (3) | 45 |
| | Potassium nitrate | 20 |
| | Anionic Surfactant (1) | 6 |
| | Anionic Surfactant (2) | 6 |
| | Amphoteric Surfactant (1) | 50 |
| | Stain Inhibitor (1) | 7 |
| | Stain Inhibitor (2) | 12 |
| | Matting Agent (1) | 7 |
| Fifth Layer | Gelatin | 250 |
| | Water-Soluble Polymer (1) | 25 |
| | Anionic Surfactant (3) | 9 |
| | Hardening Agent (1) | 185 |
| Fourth Layer | Mordant (1) | 1,850 |
| | Water-Soluble Polymer (2) | 260 |
| | Water-Soluble Polymer (4) | 1,400 |
| | Latex Dispersion (1) | 600 |
| | Anionic Surfactant (3) | 25 |
| | Nonionic Surfactant (1) | 18 |
| | Guanidine picolinate | 2,550 |
| | Sodium quinolinate | 350 |
| Third Layer | Gelatin | 370 |
| | Mordant (1) | 300 |
| | Anionic Surfactant (3) | 12 |
| Second Layer | Gelatin | 700 |
| | Mordant (1) | 290 |
| | Water-Soluble Polymer (1) | 55 |
| | Water-Soluble Polymer (2) | 330 |
| | Anionic Surfactant (3) | 30 |
| | Anionic Surfactant (4) | 7 |
| | High Boiling Point Organic Solvent (1) | 700 |
| | Fluorescent Brightening Agent (1) | 30 |
| | Stain inhibitor (3) | 32 |
| | Guanidine picolinate | 360 |
| | Potassium quinolinate | 45 |
| First Layer | Gelatin | 280 |
| | Water-Soluble Polymer (1) | 12 |
| | Anionic Surfactant (1) | 14 |
| | Sodium metaborate | 35 |
| | Hardening Agent (1) | 185 |
| Support (2) | Polyethylene-laminated paper support (thickness: 215 μm) | |

TABLE 10A-continued

Support (2)

| Layer | Composition | Thickness (μm) |
|---|---|---|
| Front Surface Subbing Layer | Gelatin | 0.1 |
| Front Surface PE Layer (glossy) | Low-density polyethylene (density: 0.923): 90.2 parts<br>Surface-treated titanium oxide: 9.8 parts<br>Ultramarine: 0.001 part | 36.0 |
| Pulp Layer | Wood free paper (LBKP/NBKP = 6/4, density: 1.053) | 152.0 |
| Back Surface PE Layer (mat) | High-density polyethylene (density: 0.955) | 27.0 |
| Back Surface | Styrene/acrylate copolymer | 0.1 |
| Subbing Layer | Colloidal silica<br>Sodium polystyrenesulfonate | |
| | Total | 215.2 |

Anionic Surfactant (1):

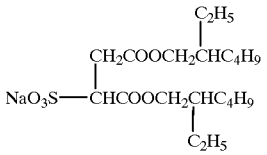

Anionic Surfactant (2):

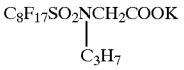

Anionic Surfactant (3):

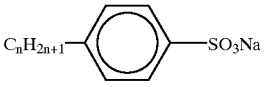

n ≈ 12.6

Anionic Surfactant (4):

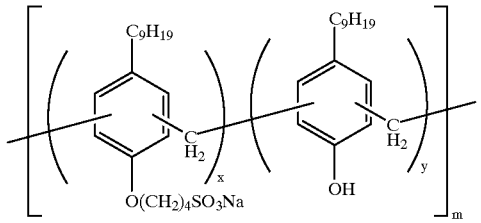

x:y = 4:6
m ≈ 6.8

Nonionic Surfactant (1):

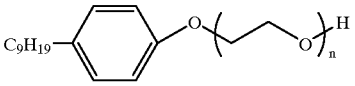

n = 85

Amphoteric Surfactant (1):

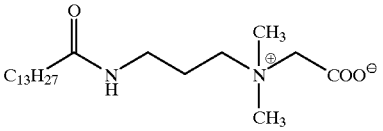

TABLE 10A-continued

Fluorescent Brightening Agent (1):

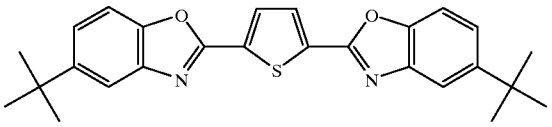

Mordant (1):

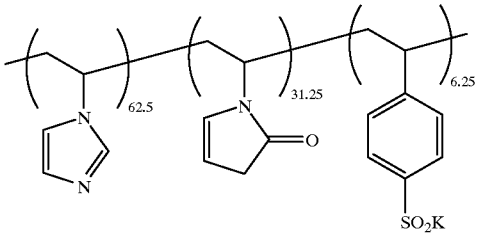

Stain Inhibitor (1):

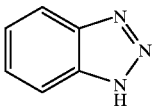

Stain Inhibitor (2):

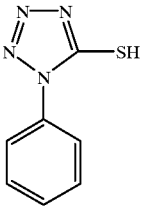

Stain Inhibitor (3):

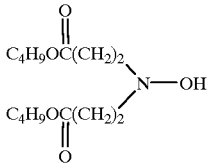

High-Boiling Point Organic Solvent (1):
$C_{26}H_{46.9}Cl_{7.1}$
Empara40 (manufactured by Ajinomoto Co., Inc.)
High-Boiling Point Organic Solvent (2):

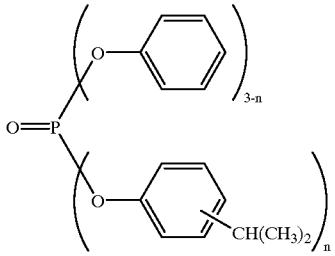

n ≈ 3

Water-Soluble Polymer (1):
Sumikagel L5-H (manufactured by Sumitomo Chemical Co., Ltd.)
Water-Soluble Polymer (2):
Dextran (molecular weight: 70,000)
Water-Soluble Polymer (3):
κ-Carrageenan (manufactured by Taito Co., Ltd.)
Water-Soluble Polymer (4):
MP Polymer MP-102 (manufactured by Kuraray Co., Ltd.)

TABLE 10A-continued

Latex Dispersion (1):
LX-438 (manufactured by Nippon Zeon Co., Ltd.)
Matting Agent (1):
SYLOID79 (manufactured by Fuji Devison Co., Ltd.)

Hardening Agent (1):

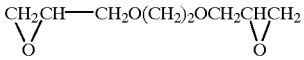

A clear color image was obtained using a processed positive film of Fuji Color Belvia on which a standard image was photographed, each of Light-Sensitive Materials K101 to K104 and Image-Receiving Material R101 by means of Pictrostat 300 manufactured by Fuji Photo Film Co., Ltd. For evaluation of fastness to light, each image obtained was covered with an ultraviolet cut filter and allowed to stand in a xenon light fading tester (Weather-Ometer manufactured by ATLAS Co., Ltd.) for 7 days under intermittent light irradiation (intermittence cycle: irradiation of light of 85,000 lux: 3.8 hours, dark time: 1 hour). For evaluation of fastness to humidity and heat, each image obtained was allowed to stand in an atmosphere of 80° C. and 70% RH for 10 days. Under the above two kinds of conditions, color image densities before and after the aging test were measured using a reflection densitometer (X-Rite 31OTR, manufactured by X-Rite Co., Ltd.) and change in a cyan density was evaluated.

The results obtained are shown in Table 11A.

TABLE 11A

| Light-Sensitive Material | Density Immediately After Image Formation: Cyan in Mono-chromatic Area | Density after Aging Test: Aging under Irradiation of Xe Light | Density after Aging Test: Aging under High Temperature and High Humidity (80° C.-70% RH) | Remarks |
|---|---|---|---|---|
| K101 | 1.15 | 0.80 | 0.95 | Comparison |
| K102 | 1.11 | 0.88 | 1.03 | Invention |
| K103 | 1.14 | 0.91 | 1.04 | Invention |
| K104 | 1.10 | 0.90 | 0.98 | Invention |

As can be seen from the results shown above, the cyan dye image forming compounds of the present invention provide images having high fastness to light, heat and humidity.

EXAMPLE 2A

Preparation of Light-Sensitive Silver Halide Emulsion:

Light-Sensitive Silver Halide Emulsion (1) (for red-sensitive emulsion layer):

To a well stirred aqueous gelatin solution (obtained by adding 800 g of gelatin, 12 g of potassium bromide, 80 g of sodium chloride and 1.2 g of Compound (a) shown below to 26.3 l of water and kept at 53° C.), Solution (I) shown in Table 12A below was added at a constant flow rate over a period of 9 minutes and Solution (II) was added at a constant flow rate starting from 10 seconds before the addition of Solution (I) over a period of 19 minutes and 10 seconds. After 36 minutes, Solution (III) shown in Table 12A was added at a constant flow rate over a period of 24 minutes and Solution (IV) was added simultaneously with Solution (III) at a constant flow rate over a period of 25 minutes.

The mixture was washed with water and desalted according to a conventional method, 880 g of a lime-processed ossein gelatin and 2.8 g of Compound (b) shown below were added, the pH was adjusted to 6.0, 12.8 g of a ribonucleic acid decomposed product and 32 mg of trimethylthiourea were added thereto, optimal chemical sensitization was conducted at 60° C. for 71 minutes, and after adding in sequence 2.6 g of 4-hydroxy-6-methyl-1,3,3a,7-tetrazaindene, 3.2 g of Dye (a) shown below, 5.1 g of KBr and 2.6 of a stabilizer described below, the mixture was cooled. As a result, 28.1 kg of a monodispersed cubic silver chlorobromide emulsion having an average grain size of 0.35 μm was obtained.

TABLE 12A

| | Solution (I) | Solution (II) | Solution (III) | Solution (IV) |
|---|---|---|---|---|
| $AgNO_3$ | 1,200 g | — | 2,800 g | — |
| $NH_4NO_3$ | 2.5 g | — | 2.5 g | — |
| KBr | — | 546 g | — | 1,766 g |
| NaCl | — | 144 g | — | 96 g |
| $K_2IrCl_6$ | — | 3.6 mg | — | — |
| | Water to make 6.5 l | Water to make 6.5 l | Water to make 10 l | Water to make 10 l |

Compound (a):

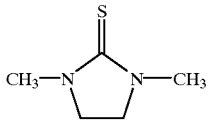

Compound (b):

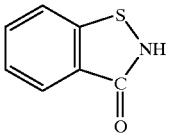

TABLE 12A-continued

| | Solution (I) | Solution (II) | Solution (III) | Solution (IV) |
|---|---|---|---|---|

Dye (a):

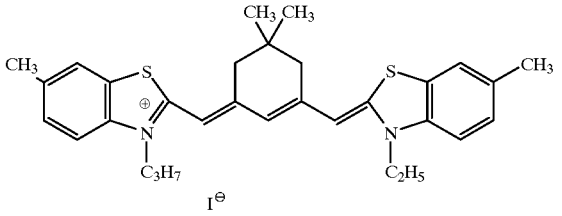

Light-Sensitive Silver Halide Emulsion (2) (for green-sensitive emulsion layer):

To a well stirred aqueous gelatin solution (obtained by adding 20 g of gelatin, 0.3 g of potassium bromide, 2 g of sodium chloride and 30 mg of Compound (a) to 600 ml of water and kept at 46° C.), Solution (I) and Solution (II) shown in Table 13A below were added simultaneously at a constant flow rate over a period of 9 minutes. After 5 minutes, Solution (III) and Solution (IV) shown in Table 13A below were further added simultaneously at a constant flow rate over a period of 32 minutes. One minute after the completion of the addition of Solution (III) and Solution (IV), 60 ml of a methanol solution of dyes (containing 360 mg of Dye (b1) shown below and 73.4 mg of Dye (b2) shown below) was added collectively.

The mixture was washed with water and desalted (performed using Flocculant (a) shown below at a pH of 4.0) according to a conventional method, 22 g of a lime-processed ossein gelatin was added, the pH and the pAg were adjusted to 6.0 and 7.6, respectively, by adding NaCl and NaOH each in an appropriate amount, 1.8 mg of sodium thiosulfate and 180 mg of 4-hydroxy-6-methyl-1,3,3a,7-tetrazaindene were added thereto, optimal chemical sensitization was conducted at 60° C., and after adding 90 mg of Antifoggant (1) shown below, the mixture was cooled. Further, 70 mg of Compound (b) and 3 ml of Compound (c) shown below were added as antiseptics. As a result, 635 g of a monodispersed cubic silver chlorobromide emulsion having an average grain size of 0.30 μm was obtained.

TABLE 13A

| | Solution (I) | Solution (II) | Solution (III) | Solution (IV) |
|---|---|---|---|---|
| $AgNO_3$ | 10.0 g | — | 90.0 g | — |
| $NH_4NO_3$ | 0.06 g | — | 0.38 g | — |
| KBr | — | 3.50 g | — | 57.1 g |
| NaCl | — | 1.72 g | — | 3.13 g |
| $K_2IrCl_6$ | — | — | — | 0.03 mg |
| | Water to make 126 ml | Water to make 131 ml | Water to make 280 ml | Water to make 289 ml |

Dye (b1):

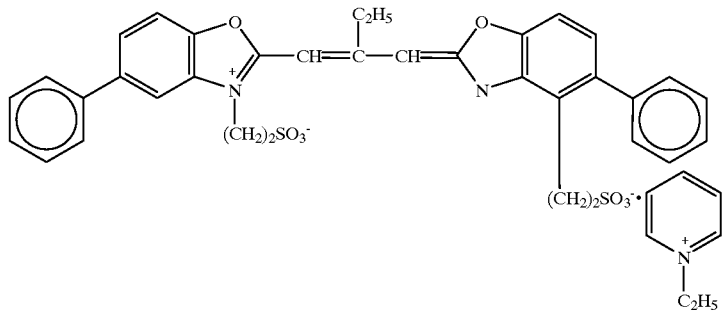

TABLE 13A-continued

| | Solution (I) | Solution (II) | Solution (III) | Solution (IV) |
|---|---|---|---|---|

Dye (b2):

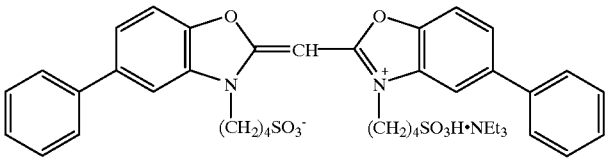

Flocculant (a):

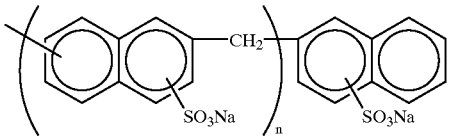

Antifoggant (1):

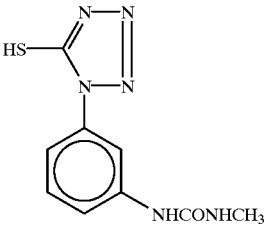

Compound (c):

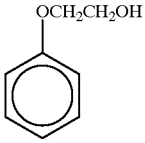

Light-Sensitive Silver Halide Emulsion (3) (for blue-sensitive emulsion layer):

To a well stirred aqueous gelatin solution (obtained by adding 1,582 g of gelatin, 127 g of KBr and 660 mg of Compound (a) to 29.2 l of water and kept at 72° C.), Solution (I) and Solution (II) each having the composition shown in Table 14A below were added such that Solution (I) was added 10 seconds after the initiation of the addition of Solution (II) and each solution was added over a period of 30 minutes. Two minutes after the completion of the addition of Solution (I), Solution (V) was added, 5 minutes after the completion of the addition of Solution (II), Solution (IV) was added, and 10 seconds after then, Solution (III) was added. Solution (III) was added over a period of 27 minutes and 50 seconds and Solution (IV) was added over a period of 28 minutes.

Thereafter, the mixture was washed with water and desalted (conducted using 32.4 g of Flocculant (b) shown below at a pH of 3.9) according to a conventional method, 1,230 g of a lime-processed ossein gelatin and 2.8 mg of Compound (b) was added thereto and the pH and the pAg were adjusted to 6.1 and 8.4. Then, 24.9 mg of sodium thiosulfate was added thereto, optimal chemical sensitization was performed at 65° C. for about 70 minutes and after adding 13.1 g of Dye (c) shown below and 118 ml of Compound (c) in sequence, the mixture was cooled. The silver halide grains of the thus-obtained emulsion were potato-shaped grains, the grain size thereof was 0.53 μm, and the yield was 30.7 kg.

TABLE 14A

| | Solution (I) | Solution (II) | Solution (III) | Solution (IV) | Solution (V) |
|---|---|---|---|---|---|
| $AgNO_3$ | 939 g | — | 3,461 g | — | — |
| $NH_4NO_3$ | 3.4 g | — | 15.4 g | — | — |
| KBr | — | 572 g | — | 2,464 g | — |
| KI | — | — | — | — | 22.0 g |
| | Water to make 6.69 l | Water to make 6.68 l | Water to make 9.70 l | water to make 9.74 l | Water to make 4.40 l |

Flocculant (b):

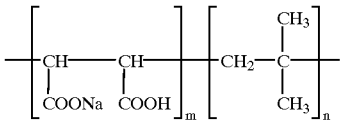

m + n = 1

TABLE 14A-continued

| | Solution (I) | Solution (II) | Solution (III) | Solution (IV) | Solution (V) |
|---|---|---|---|---|---|

Dye (c):

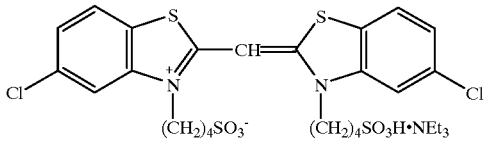

Preparation of a gelatin dispersion of Compound (d) is described below.

Compound (d), High Boiling Point Organic Solvent (1), Compound (f), Compound (g), Compound (h) and Surfactant (1) each shown below were weighed to 0.4 g, 1.2 g, 0.12 g, 0.25 g, 0.05 g and 0.2 g, respectively, and 9.5 ml of ethyl acetate was added thereto and dissolved under heating at about 60° C. to obtain a uniform solution. The resulting solution and 29.1 g of a 18% aqueous solution of a lime-processed gelatin were mixed while stirring and dispersed in a homogenizer for 10 minutes at 10,000 rpm. After the dispersion, 18.5 ml of water for dilution was added. The dispersion solution obtained was designated as the dispersion of Compound (d).

Compound (d):

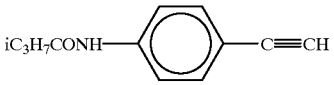

High Boiling Point Organic Solvent (1):

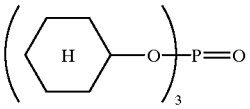

Compound (f):

$C_{26}H_{46.9}Cl_{7.1}$

Compound (g):

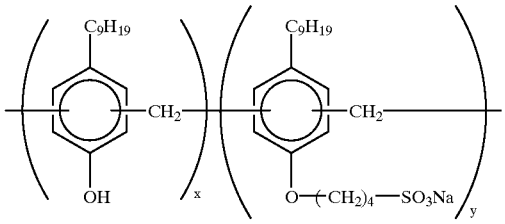

$x/y \approx 58/42$

-continued

Surfactant (1):

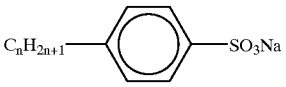

$n \approx 12.6$

Compound (h):

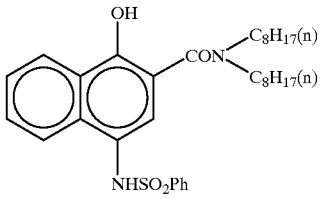

A preparation method of a dispersion of zinc hydroxide is described below.

To 100 ml of a 4% aqueous gelatin solution, 12.5 g of zinc hydroxide having an average particle size of 0.2 μm, 1 g of carboxymethyl cellulose as a dispersant and 0.1 g of sodium polyacrylate were added, and the mixture was ground in a mill together with glass beads having an average particle size of 0.75 mm for 30 minutes. The glass beads were separated to obtain a dispersion of zinc hydroxide.

Preparation of a gelatin dispersion of a dye donating compound is described below.

Cyan Dye Donating Compound (A1) shown below, Cyan Dye Donating Compound (A2) shown below, Surfactant (1), Compound (h), Compound (i) shown below, High Boiling Point Organic Solvent (1) and High Boiling Point Organic Solvent (2) shown below were weighed to 7.3 g, 11.0 g, 0.8 g, 1 g, 2.2 g, 7 g and 3 g, respectively, and 26 ml of ethyl acetate and 1.2 ml of water were added thereto and dissolved under heating at about 60° C. to obtain a uniform solution. The resulting solution, 65 g of a 16% aqueous solution of a lime-processed gelatin and 87 ml of water were mixed while stirring and dispersed in a homogenizer for 10 minutes at 10,000 rpm. After the dispersion, 216 ml of water for dilution was added. The resulting dispersion solution was designated as the dispersion of cyan dye donating compound.

Cyan Dye Donating Compound (A1)

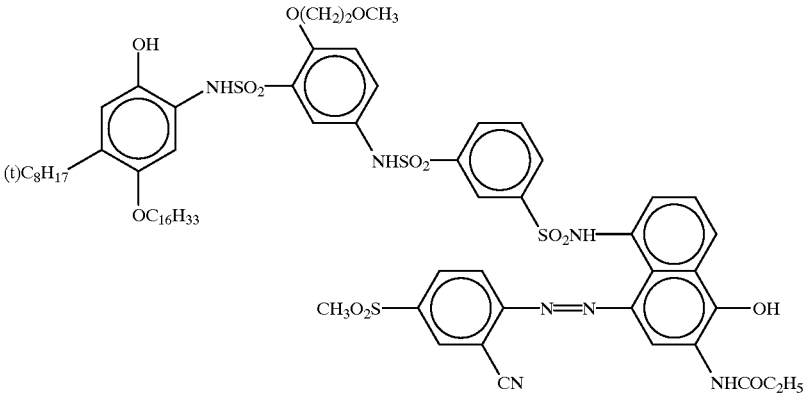

Cyan Dye Donating Compound (A2)

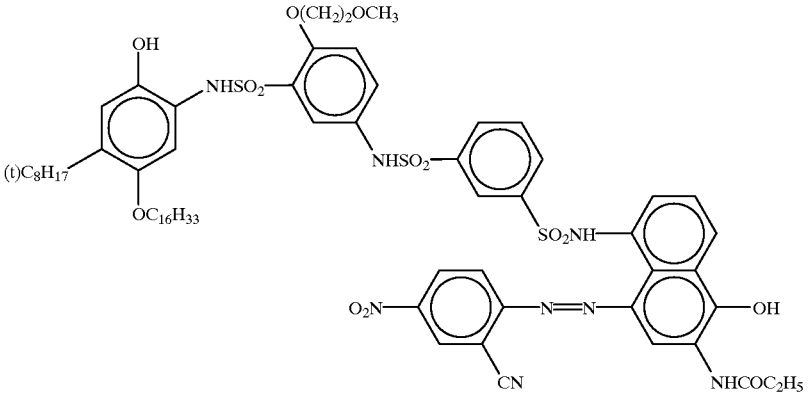

Compound (i)

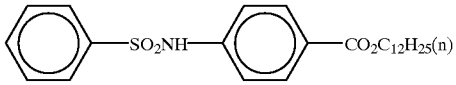

High Boiling Point Solvent (2)

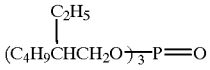

Magenta Dye Donating Compound (B) shown below, Compound (m) shown below, Compound (h), Surfactant (1) and High Boiling Point Organic Solvent (2) were weighed to 4.50 g, 0.05 g, 0.05 g, 0.094 g and 2.25 g, respectively, and 10 ml of ethyl acetate was added thereto and dissolved under heating at about 60° C. to obtain a uniform solution. The resulting solution, 15.2 g of a 16% aqueous solution of a lime-processed gelatin and 23.5 ml of water were mixed while stirring and dispersed in a homogenizer for 10 minutes at 10,000 rpm. Thereafter, 42 ml of water for dilution was added. The resulting dispersion solution was designated as the dispersion of magenta dye donating compound.

Magenta Dye Donating Compound (B):

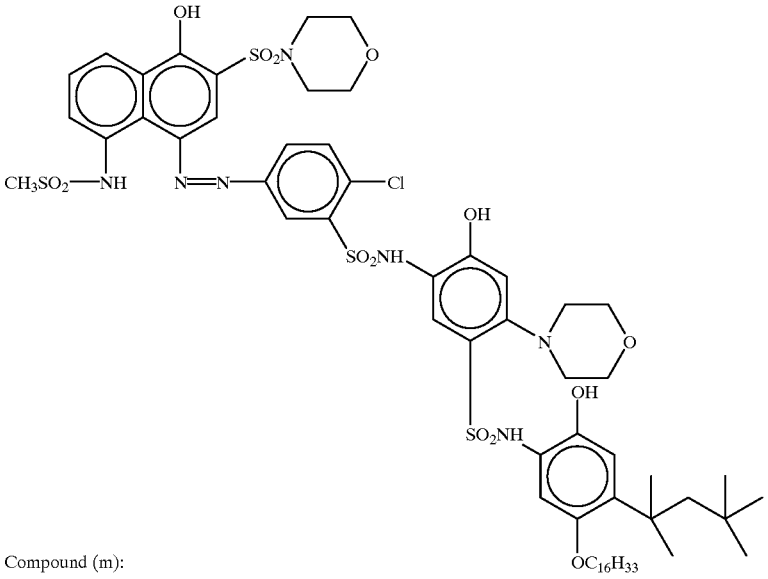

Compound (m):

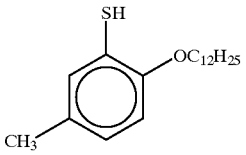

Yellow Dye Donating Compound (C) shown below, Compound (d), Compound (h), Surfactant (1), compound (j) shown below, Compound (k) shown below and High Boiling Point Organic Solvent (1) were weighed to 15 g, 2.3 g, 0.9 g, 0.88 g, 3.9 g, 1.9 g and 16.9 g, respectively, and 49 ml of ethyl acetate was added thereto and dissolved under heating at about 60° C. to obtain a uniform solution. The resulting solution, 63.5 g of a 16% aqueous solution of a lime-processed gelatin and 103 ml of water were mixed while stirring and dispersed in a homogenizer for 10 minutes at 10,000 rpm. Thereafter, 94 ml of water for dilution was added. The resulting dispersion solution was designated as the dispersion of yellow dye-donating compound.

Yellow Dye Donating Compound (C):

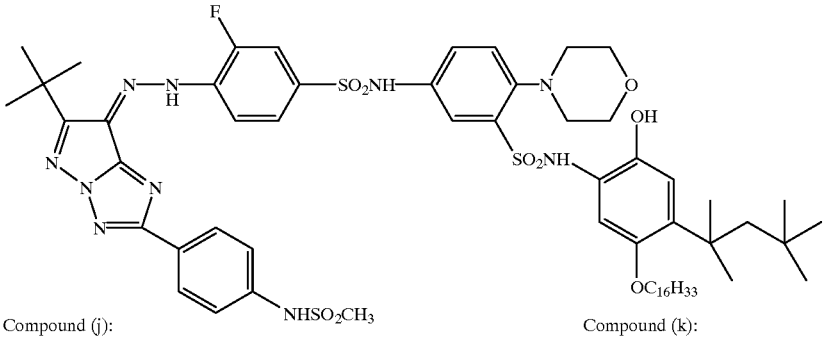

Compound (j):

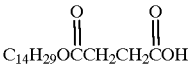

Compound (k):

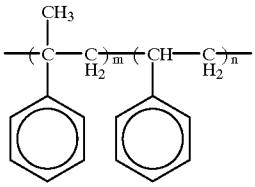

Using these, Heat Developable Light-Sensitive Material K201 having a composition shown in Table 15A was prepared.

TABLE 15

Composition of Light-Sensitive Material (Light-Sensitive Material K201)

| Layer | Name of Layer | Additives | | Coating Amount (mg/m$^2$) |
|---|---|---|---|---|
| Seventh Layer | Protective Layer | Acid-processed gelatin | | 0.387 |
| | | PMMA Matting agent | | 0.017 |
| | | Surfactant (2) | | 0.006 |
| | | Surfactant (3) | | 0.016 |
| Sixth Layer | Interlayer | Gelatin | | 0.763 |
| | | $Zn(OH)_2$ | | 0.558 |
| | | Surfactant (3) | | 0.002 |
| | | Compound (d) | | 0.036 |
| | | Compound (f) | | 0.011 |
| | | Compound (g) | | 0.022 |
| | | Compound (h) | | 0.005 |
| | | High Boiling Point Organic Solvent (1) | | 0.107 |
| | | $Ca(NO_3)_2$ | | 0.012 |
| | | Surfactant (1) | | 0.022 |
| | | Water-Soluble Polymer (1) | | 0.003 |
| Fifth Layer | Blue-sensitive Layer | Silver Halide Emulsion (3) | as Ag | 0.399 |
| | | Gelatin | | 0.532 |
| | | Yellow Dye Donating Compound (c) | | 0.348 |
| | | Compound (d) | | 0.054 |
| | | Compound (h) | | 0.021 |
| | | Compound (j) | | 0.091 |
| | | Compound (k) | | 0.045 |
| | | High Boiling Point Organic Solvent (1) | | 0.391 |
| | | Surfactant (1) | | 0.021 |
| | | Water-Soluble Polymer (1) | | 0.006 |
| Fourth Layer | Interlayer | Gelatin | | 0.467 |
| | | $Zn(OH)_2$ | | 0.341 |
| | | Surfactant (3) | | 0.001 |
| | | Compound (d) | | 0.022 |
| | | Compound (f) | | 0.007 |
| | | Compound (g) | | 0.014 |
| | | Compound (h) | | 0.003 |
| | | High Boiling Point Organic Solvent (1) | | 0.066 |
| | | $Ca(NO_3)_2$ | | 0.008 |
| | | Surfactant (1) | | 0.014 |
| | | Water-Soluble Polymer (1) | | 0.002 |
| Third Layer | Green-Sensitive Layer | Silver Halide Emulsion (2) | as Ag | 0.234 |
| | | Gelatin | | 0.311 |
| | | Magenta Dye Donating Compound (B) | | 0.357 |
| | | Compound (m) | | 0.004 |
| | | Compound (h) | | 0.004 |
| | | High Boiling Point Organic Solvent (2) | | 0.178 |
| | | Surfactant (1) | | 0.010 |
| | | Water-Soluble Polymer (1) | | 0.008 |
| Second Layer | Interlayer | Gelatin | | 0.513 |
| | | Surfactant (4) | | 0.069 |
| | | Surfactant (3) | | 0.007 |
| | | Compound (d) | | 0.022 |
| | | Compound (f) | | 0.007 |
| | | Compound (g) | | 0.014 |
| | | Compound (h) | | 0.003 |
| | | High Boiling Point Organic Solvent (1) | | 0.066 |
| | | $Ca(NO_3)_2$ | | 0.004 |
| | | Water-Soluble Polymer (1) | | 0.020 |
| First Layer | Red-Sensitive Layer | Silver Halide Emulsion (1) | as Ag | 0.160 |
| | | Gelatin | | 0.294 |
| | | Cyan Dye Donating Compound (A1) | | 0.141 |
| | | Cyan Dye Donating Compound (A2) | | 0.211 |
| | | Compound (i) | | 0.041 |

TABLE 15-continued

| | | | |
|---|---|---|---|
| | | Compound (h) | 0.020 |
| | | High Boiling Point Organic Solvent (1) | 0.060 |
| | | High Boiling Point Organic Solvent (2) | 0.138 |
| | | Surfactant (1) | 0.015 |
| | | Water-Soluble Polymer (1) | 0.017 |
| | | Stabilizer | 0.005 |
| | | Hardening agent | 0.035 |
| Support (1) | Polyethylene-laminated paper support (thickness: 131 μm) | | |

Support (1)

| Layer | Composition | Thickness (μm) |
|---|---|---|
| Front Surface Subbing Layer | Gelatin | 0.1 |
| Front Surface PE Layer (glossy) | Low-density polyethylene (density: 0.923): 89.2 parts Surface-treated titanium oxide: 10.0 parts Ultramarine: 0.8 part | 36.0 |
| Pulp Layer | Wood free paper (LBKP/NBKP = 1/1, density: 1.080) | 64.0 |
| Back Surface PE Layer (mat) | High-density polyethylene (density: 0.960) | 31.0 |
| Back Surface Subbing Layer | Gelatin | 0.05 |
| | Colloidal silica | 0.05 |
| | Total | 131.2 |

Surfactant (2):

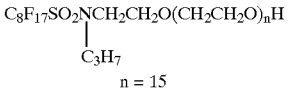

Surfactant (3):
Aerosol OT
Surfactant (4):

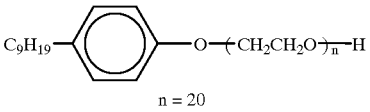

Water-Soluble Polymer (1):

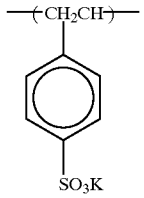

Hardening Agent (1):
$CH_2{=}CHSO_2CH_2SO_2CH{=}CH_2$
Stabilizer:

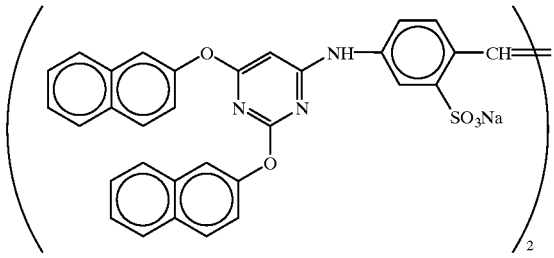

Light-Sensitive Materials K202 to K204 were prepared in the same manner as in Light-Sensitive Material K201 except for using the dye donating compound according to the present invention shown in Table 16A below in place of Dye Donating Compound (A-2) in the first layer, respectively.

TABLE 16A

| Light-Sensitive Material | Dye Donating Compound | Remarks |
|---|---|---|
| K201 | Cyan Dye Donating Compound (A2) | Comparison |
| K202 | Compound 2a | Invention |
| K203 | Compound 6a | Invention |
| K204 | Compound 18a | Invention |

A clear color image was obtained using a processed negative film of Fuji Color Super G400ACE on which a standard image was photographed, each of Light-Sensitive Materials K201 to K204, and Image-Receiving Material R101 by means of Pictrostat 330 manufactured by Fuji Photo Film Co., Ltd. Each color image obtained was examined in the same manner as in Example 1A and almost the same results as in Example 1A were obtained. The results obtained are shown in Table 17A below.

TABLE 17A

| Light-Sensitive Material | Density Immediately After Image Formation: Cyan in Monochromatic Area | Density after Aging Test: Aging under Irradiation of Xe Light | Density after Aging Test: Aging under High Temperature and High Humidity (80° C.-70% RH) | Remarks |
|---|---|---|---|---|
| K201 | 1.15 | 0.80 | 1.01 | Comparison |
| K202 | 1.22 | 0.98 | 1.08 | Invention |
| K203 | 1.20 | 1.03 | 1.09 | Invention |
| K204 | 1.18 | 0.99 | 1.07 | Invention |

EXAMPLE 3

Preparation of light-sensitive silver halide emulsions is described below.

Light-Sensitive Silver Halide Emulsion (1) (emulsion for the fifth layer (680 nm light-sensitive layer)):

To an aqueous solution having a composition shown in Table 18A below under well stirring, Solution (I) and Solution (II) each having a composition shown in Table 19A below were simultaneously added over a period of 13 minutes, and 10 minutes after then, Solution (III) and Solution (IV) each having a composition shown in Table 19A below were added over a period of 33 minutes.

TABLE 18A

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 45° C. |

TABLE 19A

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_2IrCl_2$ | — | — | — | 0.039 mg |
| Total | Water to make 126 ml | Water to make 132 ml | Water to make 254 ml | Water to make 252 ml |

Silver Halide Solvent (1):

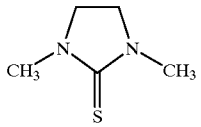

Then, 13 minutes after the initiation of the addition of Solution (III), 150 ml of an aqueous solution containing 0.350% of Sensitizing Dye (a) shown below was added over a period of 27 minutes.

Sensitizing Dye (a):

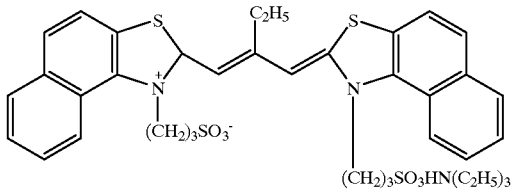

The mixture was washed with water and desalted (performed using Flocculant (a) shown below at a pH of 4.1) according to a conventional method, the pH and the pAg were adjusted to 6.0 and 7.9, respectively, 22 g of a lime-processed ossein gelatin was added thereto, and chemical sensitization was performed at 60° C. The compounds used in the chemical sensitization are shown in Table 20A below. The resulting emulsion in a yield of 630 g was a monodispersed cubic silver chlorobromide emulsion having a coefficient of variation of 10.2% and an average grain size of 0.20 μm.

Flocculant (a):

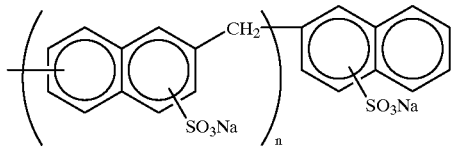

Flocculant (b):

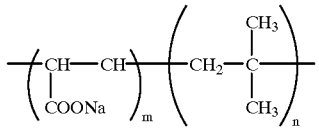

TABLE 20A

| Chemicals used in Chemical Sensitization | Amount added |
|---|---|
| 4-Hydroxy-6-methyl-1,3,3a,7-tetrazaindene | 0.36 g |
| Sodium thiosulfate | 6.75 mg |
| Antifoggant (1) | 0.11 g |
| Antiseptic (1) | 0.07 g |
| Antiseptic (2) | 3.13 g |

Antifoggant (1):

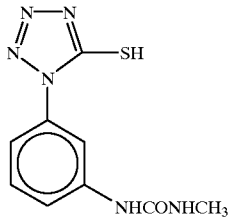

Antiseptic (1):

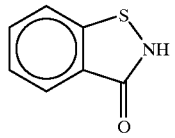

Antiseptic (2):

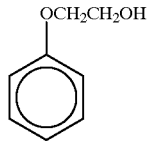

Antiseptic (3):

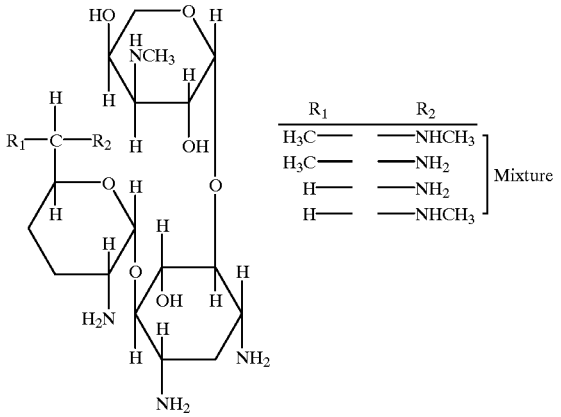

Light-Sensitive Silver Halide Emulsion (2) (emulsion for the third layer (750 nm light-sensitive layer)):

To an aqueous solution having a composition shown in Table 21A below under well stirring, Solution (I) and Solution (II) each having a composition shown in Table 22A below were simultaneously added over a period of 18 minutes, and 10 minutes after then, Solution (III) and Solution (IV) each having a composition shown in Table 22A below were added over a period of 24 minutes.

TABLE 21A

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 45° C. |

TABLE 22A

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_4[Fe(CN)_6].H_2O$ | | | | 0.07 g |
| $K_2IrCl_6$ | — | — | — | 0.040 mg |
| | Water to make 188 ml | Water to make 188 ml | Water to make 250 ml | Water to make 250 ml |

The mixture was washed with water and desalted (performed using Flocculant (b) at a pH of 3.9) according to a conventional method, 22 g of a lime-processed ossein gelatin subjected to removal of calcium (calcium content: 150 ppm or less) was added and redispersed at 40° C., 0.39 g of 4-hydroxy-6-methyl-1,3,3a,7-tetrazaindene was added thereto, and the pH and the pAg were adjusted to 5.9 and 7.8, respectively. Thereafter, chemical sensitization was performed at 70° C. using chemicals shown in Table 23A below. At the final of the chemical sensitization, Sensitizing Dyes (2) and (3) as a methanol solution (solution having a composition shown in Table 24A below) were added. Further, after the chemical sensitization, the temperature was lowered to 40° C., 200 g of a gelatin dispersion of Stabilizer (1) shown below was added and well stirred, and then the mixture was stored. The resulting emulsion in a yield of 938 g was a monodispersed cubic silver chlorobromide emulsion having a coefficient of variation of 12.6% and an average grain size of 0.25 $\mu$m.

TABLE 23A

| Chemicals used in Chemical Sensitization | Amount added |
|---|---|
| 4-Hydroxy-6-methyl-1,3,3a,7-tetrazaindene | 0.39 g |
| Triethylthiourea | 3.3 mg |
| Nucleic acid decomposition product | 0.39 g |
| NaCl | 0.15 g |
| KI | 0.12 g |
| Antifoggant (2) | 0.10 g |
| Antiseptic (1) | 0.07 g |

TABLE 24A

| Composition of Dye Solution | Amount added |
|---|---|
| Sensitizing Dye (2) | 0.12 g |
| Sensitizing Dye (3) | 0.06 g |
| p-Toluenesulfonic acid | 0.71 g |
| Methanol | 18.7 ml |

Antifoggant (2):

TABLE 24A-continued

| Composition of Dye Solution | Amount added |
|---|---|

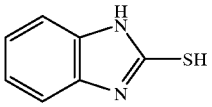

Sensitizing Dye (2):

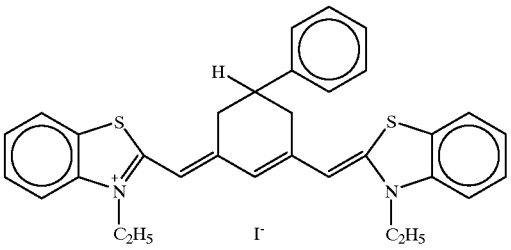

Sensitizing Dye (3):

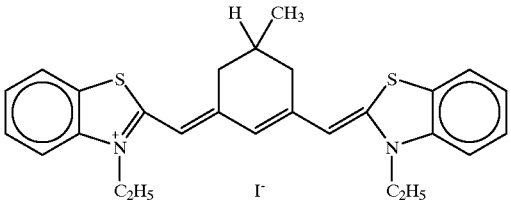

Stabilizer (1):

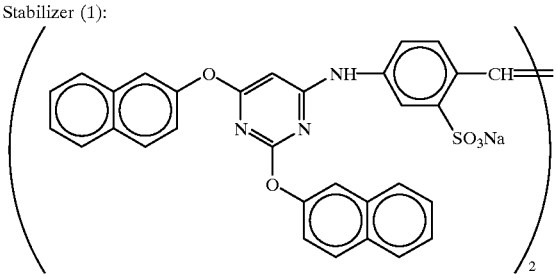

Light-Sensitive Silver Halide Emulsion (3) (emulsion for the first layer (810 nm light-sensitive layer)):

To an aqueous solution having a composition shown in Table 25A below under well stirring, Solution (I) and Solution (II) each having a composition shown in Table 26A below were simultaneously added over a period of 18 minutes, and 10 minutes after then, Solution (III) and Solution (IV) each having a composition shown in Table 26A below were added over a period of 24 minutes.

TABLE 25A

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 50° C. |

TABLE 26A

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| | Water to make 180 ml | Water to make 181 ml | Water to make 242 ml | Water to make 250 ml |

The mixture was washed with water and desalted (performed using Flocculant (a) at a pH of 3.8) according to a conventional method, 22 g of a lime-processed ossein gelatin was added, the pH and the pAg were adjusted to 7.4 and 7.8, respectively, and chemical sensitization was performed at 60° C. The chemicals used in the chemical sensitization are shown in Table 27A below. The resulting emulsion in a yield of 680 g was a monodispersed cubic silver chlorobromide emulsion having a coefficient of variation of 9.7% and an average grain size of 0.32 μm.

TABLE 27A

| Chemicals used in Chemical Sensitization | Amount added |
|---|---|
| 4-Hydroxy-6-methyl-1,3,3a,7-tetrazaindene | 0.38 g |
| Triethylthiourea | 3.10 mg |
| Antifoggant (2) | 0.19 g |
| Antiseptic (1) | 0.07 g |
| Antiseptic (2) | 3.13 g |

A preparation method of a gelatin dispersion of colloidal silver is described below.

To a well stirred aqueous solution having a composition shown in Table 28A below, a solution having a composition shown in Table 29A below was added over a period of 24 minutes. Thereafter, the mixture was washed with water using Flocculant (a), then 43 g of a lime-processed ossein gelatin was added, and the pH was adjusted to 6.3. The average grain size thereof was 0.02 μm and the yield was 512 g (dispersion containing 2% of silver and 6.8% of gelatin).

TABLE 28A

| Composition | |
|---|---|
| $H_2O$ | 620 ml |
| Dextrin | 16 g |
| NaOH (5N) | 41 ml |
| Temperature | 30° C. |

TABLE 29A

| Composition | |
|---|---|
| $H_2O$ | 135 ml |
| $AgNO_3$ | 17 g |

A preparation method of a gelatin dispersion of each hydrophobic additive is described below.

A gelatin dispersion of each of a yellow dye donating compound, a magenta dye donating compound and a cyan dye donating compound was prepared according to the formulation shown in Table 30A below. More specifically, each oil phase component was dissolved under heating at about 70° C. to form a uniform solution, an aqueous phase component heated at about 60° C. was added to the solution, and the components were mixed under stirring and then dispersed in a homogenizer for 10 minutes at 10,000 rpm. Water was added thereto and the mixture was stirred to obtain a homogenous dispersion. Then, the gelatin dispersion of the cyan dye donating compound was subjected to repetition of dilution with water and concentration using an ultrafiltration module (Ultrafiltration Module ACV-3050, manufactured by Asahi Chemical Industry Co., Ltd.) to reduce the weight of ethyl acetate to 1/17.6 of the weight of ethyl acetate shown in Table 30A below.

TABLE 30A

| | Composition of Dispersion | | |
|---|---|---|---|
| | Yellow | Magenta | Cyan |
| Oil phase | | | |
| Cyan Dye Donating Compound (1) | — | — | 7.3 g |
| Cyan Dye Donating Compound (2) | — | — | 10.7 g |
| Magenta Dye Donating Compound (1) | — | 18.1 g | — |
| Yellow Dye Donating Compound (1) | 12.3 g | — | — |
| Reducing Agent (1) | 0.9 g | 0.2 g | 1.0 g |
| Antifoggant (3) | 0.1 g | — | 0.2 g |
| Antifoggant (4) | — | 0.7 g | — |
| Surfactant (1) | 1.1 g | — | — |
| High Boiling Point Solvent (1) | 6.2 g | 25.1 g | 4.6 g |
| High Boiling Point Solvent (2) | — | — | 4.9 g |
| High boiling Point Solvent (3) | — | — | 1.2 g |
| Dye (a) | 1.1 g | — | 0.5 g |
| Water | 0.4 ml | — | — |
| Ethyl acetate | 9.6 ml | 50.1 ml | 55.2 ml |
| Aqueous phase | | | |
| Lime-processed gelatin | 10.0 g | 10.0 g | 10.0 g |
| Calcium nitrate | 0.1 g | 0.1 g | — |
| Surfactant (1) | — | 0.2 g | 0.8 g |
| Sodium hydroxide aq. soln. (1N) | — | 1.9 ml | — |
| Carboxymethyl cellulose | — | — | 0.3 g |
| Water | 26.1 ml | 139.7 ml | 95.9 ml |
| Water added | 99.9 ml | 157.3 ml | 209.0 ml |
| Antiseptic (1) | 0.004 g | 0.04 g | 0.1 g |

A gelatin dispersion of Reducing Agent (2) was prepared according to the formulation shown in Table 31A below. More specifically, each oil phase component was dissolved under heating at about 60° C., an aqueous phase component heated at about 60° C. was added to the solution, and the components were mixed under stirring and then dispersed in a homogenizer for 10 minutes at 10,000 rpm to obtain a homogenous dispersion. From the resulting dispersion, ethyl acetate was removed using a reduced-pressure organic solvent-removing device.

TABLE 31A

| Composition of Dispersion | |
|---|---|
| Oil phase | |
| Reducing Agent (2) | 7.5 g |
| High Boiling Point Solvent (1) | 4.7 g |

TABLE 31A-continued

| Composition of Dispersion | |
|---|---|
| Surfactant (1) | 1.9 g |
| Ethyl acetate | 14.4 ml |
| Aqueous phase | |
| Acid-processed gelatin | 10.0 g |
| Antiseptic (1) | 0.02 g |
| Antiseptic (3) | 0.04 g |
| Sodium hydrogensulfite | 0.1 g |
| Water | 136.7 ml |

A gelatin dispersion of Stabilizer (1) was prepared according to the formulation shown in Table 32A below. More specifically, each oil phase component was dissolved at room temperature, an aqueous phase component heated at about 40° C. was added to the solution, and the components were mixed while stirring and dispersed in a homogenizer for 10 minutes at 10,000 rpm. Water was added thereto and stirred to obtain a homogenous dispersion.

TABLE 32A

| Composition of Dispersion | |
|---|---|
| Oil phase | |
| Stabilizer (1) | 4.0 g |
| Sodium hydroxide | 0.3 g |
| Methanol | 62.8 g |
| High Boiling Point Solvent (4) | 0.9 g |
| Aqueous phase | |
| Gelatin subjected to removal of calcium (Ca content: 100 ppm or less) | 10.0 g |
| Antiseptic (1) | 0.04 g |
| Water | 320.5 ml |

A gelatin dispersion of zinc hydroxide was prepared according to the formulation shown in Table 33A below. More specifically, respective components were mixed, dissolved and dispersed for 30 minutes in a mill together with glass beads having an average particle size of 0.75 mm. The glass beads were separated and removed to obtain a homogenous dispersion. The zinc hydroxide used had an average particle size of 0.25 μm.

TABLE 33A

| Composition of Dispersion | |
|---|---|
| Zinc hydroxide | 15.9 g |
| Carboxy methyl cellulose | 0.7 g |
| Sodium polyacrylate | 0.07 g |
| Lime-processed gelatin | 4.2 g |
| Water | 100 ml |
| High Boiling Point Solvent (4) | 0.4 g |

A preparation method of a gelatin dispersion of a matting agent added to the protective layer is described below. PMMA was dissolved in methylene chloride and the resulting solution was added to gelatin together with a slight amount of a surfactant and dispersed while stirring at a high revolution speed. Then, methylene chloride was removed using a reduced-pressure solvent-removing device to obtain homogenous dispersion having an average particle size of 4.3 μm.

Cyan Dye Donating Compound (1):
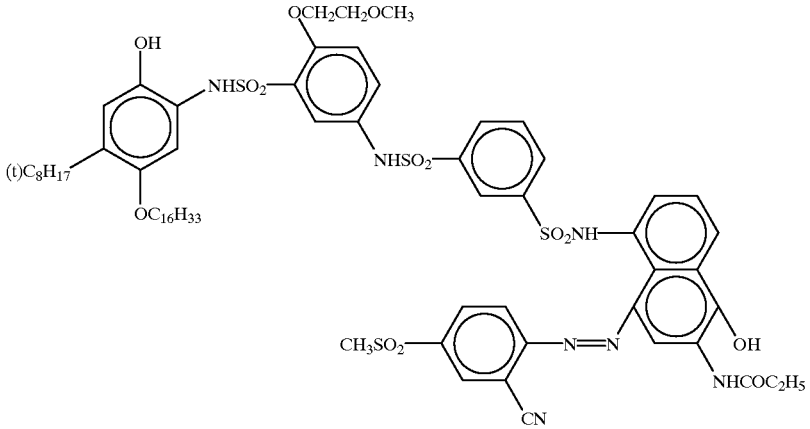
Cyan Dye Donating Compound (2):
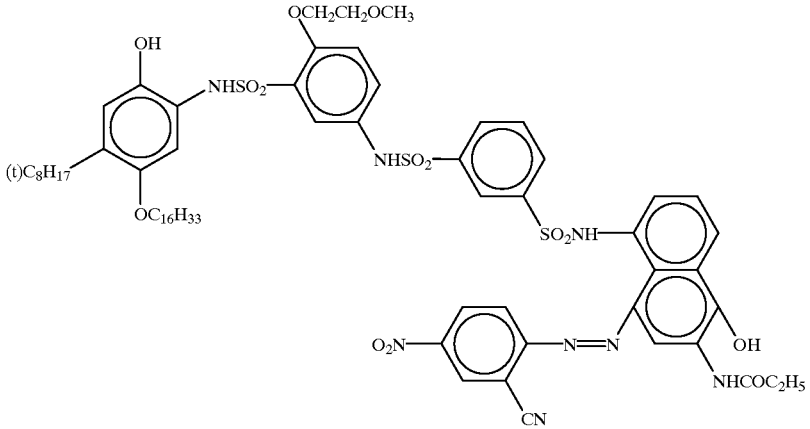
Magenta Dye Donating Compound (1):
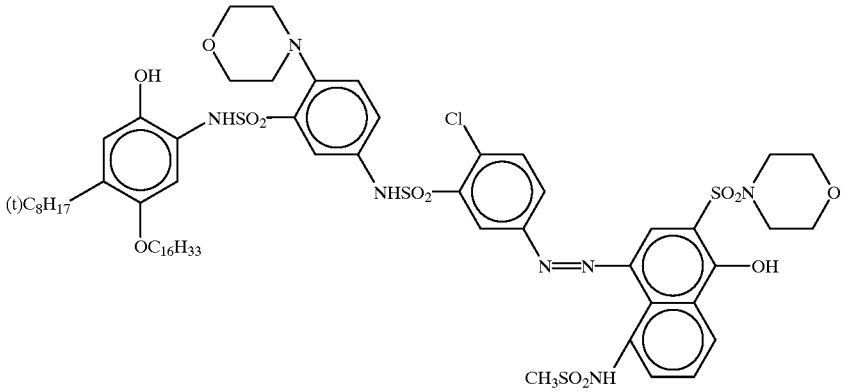

-continued
Yellow Dye Donating Compound (1):
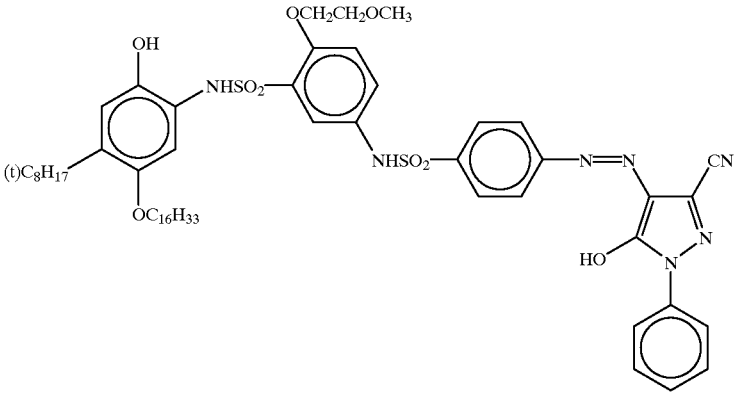
Reducing Agent (1):
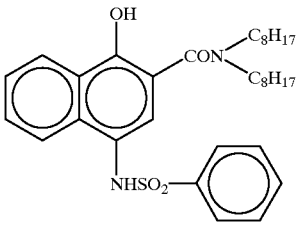
Antifoggant (3):
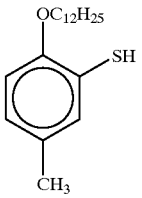
Antifoggant (4):
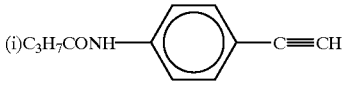
Surfactant (1):
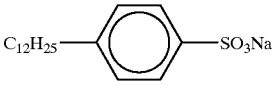
High Boiling Point Solvent (1):
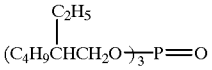
High Boiling Point Solvent (2):
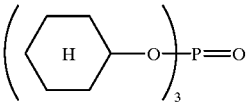
High Boiling Point Solvent (3):
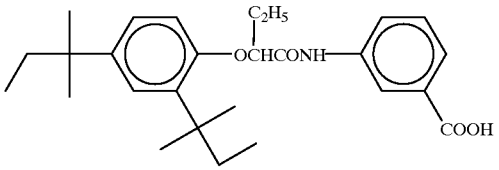
Dye (a):
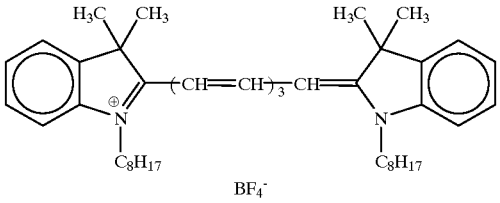
Reducing Agent (2):
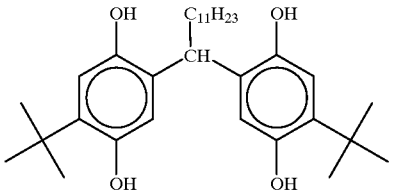
High Boiling Point Solvent (4):
(the same compound as Antiseptic (2))
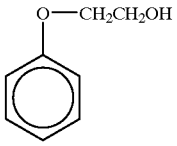

Using the above-described compounds and additives, Heat Developable Light-Sensitive Material K301 shown in Table 34A below was prepared.

TABLE 34A

Main Construction of Heat Developable Light-Sensitive Material K301

| Layer | Name of Layer | Additives | Coating Amount ($mg/m^2$) |
|---|---|---|---|
| Seventh Layer | Protective Layer | Acid-processed gelatin | 442 |
| | | Reducing Agent (2) | 47 |
| | | High Boiling Point Solvent (1) | 30 |
| | | Colloidal silver grain | 2 |
| | | Matting agent (PMMA resin) | 17 |
| | | Surfactant (2) | 16 |
| | | Surfactant (1) | 9 |
| | | Surfactant (3) | 2 |
| Sixth Layer | Interlayer | Lime-processed gelatin | 862 |
| | | Zinc hydroxide | 480 |
| | | Water-soluble Polymer (1) | 4 |
| | | Surfactant (2) | 0.4 |
| | | Calcium nitrate | 14 |
| Fifth Layer | Red-Sensitive Layer | Lime-processed gelatin | 452 |
| | | Light-Sensitive Silver Halide Emulsion (1) | as Ag 301 |
| | | Magenta Dye Donating Compound (1) | 441 |
| | | High Boiling Point Solvent (2) | 221 |
| | | Reducing Agent (1) | 6 |
| | | Antifoggant (4) | 20 |
| | | Surfactant (1) | 0.3 |
| | | Water-Soluble Polymer (1) | 11 |
| Fourth Layer | Interlayer | Lime-processed gelatin | 485 |
| | | Zinc hydroxide | 270 |
| | | Water-Soluble Polymer (1) | 2 |
| | | Surfactant (2) | 0.3 |
| | | Calcium nitrate | 8 |
| Third Layer | Second Infrared-Sensitive Layer | Lime-processed gelatin | 373 |
| | | Light-Sensitive Silver Halide Emulsion (2) | as Ag 106 |
| | | Stabilizer (1) | 9 |
| | | Cyan Dye Donating Compound (2) | 233 |
| | | Cyan Dye Donating Compound (1) | 159 |
| | | Dye (a) | 10 |
| | | High Boiling Point Solvent (1) | 101 |
| | | High Boiling Point Solvent (2) | 108 |
| | | High Boiling Point Solvent (3) | 27 |
| | | Reducing Agent (1) | 22 |
| | | Antifoggant (3) | 4 |
| | | Surfactant (1) | 0.9 |
| | | Carboxymethyl cellulose | 5 |
| | | Water-Soluble Polymer (1) | 11 |
| Second Layer | Interlayer | Lime-processed gelatin | 438 |
| | | Surfactant (2) | 4 |
| | | Surfactant (4) | 123 |
| | | Water-Soluble Polymer (1) | 26 |
| | | Antifoggant (5) | 6 |
| | | Calcium nitrate | 8 |
| First Layer | First Infrared-Sensitive Layer | Lime-processed gelatin | 587 |
| | | Light-Sensitive Silver Halide Emulsion (3) | as Ag 311 |
| | | Stabilizer (1) | 8 |
| | | Yellow Dye Donating Compound (1) | 504 |
| | | Sensitizing Dye (4) | 0.1 |
| | | Dye (a) | 44 |
| | | High-Boiling Point Solvent (1) | 252 |
| | | Reducing Agent (1) | 35 |
| | | Antifoggant (3) | 4 |
| | | Surfactant (1) | 32 |
| | | Water-Soluble Polymer (1) | 46 |
| | | Hardening Agent (1) | 45 |
| Support | Polyethylene-laminated paper support (thickness: 131 μm) | | |

Note: Trace additives such as an antiseptic were omitted in the Tables above.

TABLE 34A-continued

Main Construction of Heat Developable Light-Sensitive Material K301

Surfactant (2):

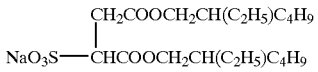

Surfactant (3):

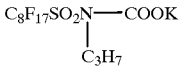

Surfactant (4):

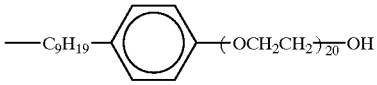

Water-Soluble Polymer (1):

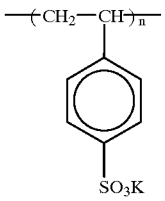

Limiting viscosity number [η] = 1.6 (0.1N NaCl, 30° C.)

Molecular weight ≈ 1,000,000

Sensitizing Dye (4):

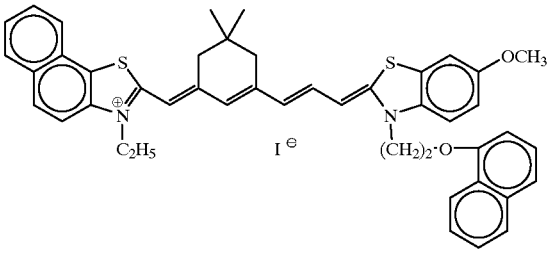

Antifoggant (5):

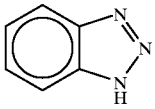

Hardening Agent (1):

$CH_2{=}CHSO_2CH_2SO_2CH{=}CH_2$

Light-Sensitive Materials K302 to K306 were prepared in the same manner as in Light-Sensitive Material K301 except for using the dye donating compound according to the present invention shown in Table 35A below in place of Dye Donating Compound (2) in the third layer, respectively.

TABLE 35A

| Light-Sensitive Material | Dye Donating Compound | Remarks |
|---|---|---|
| K301 | Cyan Dye Donating Compound (2) | Comparison |
| K302 | Compound 1a | Invention |
| K303 | Compound 8a | Invention |
| K304 | Compound 10a | Invention |
| K305 | Compound 18a | Invention |
| K306 | Compound 23a | Invention |

A self-contained calibration pattern was output using each of Light-Sensitive Materials K-301 to 306, and Image-Receiving Material R101 by means of a digital color printer (Pictrography 3000 manufactured by Fuji Photo Film Co., Ltd.). Each color image obtained was examined in the same manner as in Example 1A and almost the same results as in Example 1A were obtained. The results obtained are shown in Table 36A below.

TABLE 36A

| Light-Sensitive Material | Density Immediately After Image Formation: Cyan in Mono-chromatic Area | Density after Aging Test: Aging under Irradiation of Xe Light | Density after Aging Test: Aging under High Temperature and High Humidity (80° C.-70% RH) | Remarks |
|---|---|---|---|---|
| K301 | 1.17 | 0.82 | 1.00 | Comparison |
| K302 | 1.21 | 0.99 | 1.12 | Invention |
| K303 | 1.23 | 1.03 | 1.11 | Invention |
| K304 | 1.18 | 0.94 | 1.04 | Invention |
| K305 | 1.19 | 0.98 | 1.10 | Invention |
| K306 | 1.16 | 0.90 | 1.01 | Invention |

EXAMPLE A4

Comparative Light-Sensitive Material K401 was prepared by coating on a 150 μm-thick transparent polyethylene terephthalate film support layers having compositions shown in Tables 37A and 38A below.

TABLE 37A

Construction of Comparative Light-Sensitive Material K401

| Layer | Name of Layer | Additives | | Coating Amount (g/m²) |
|---|---|---|---|---|
| 24th Layer | Protective Layer | Gelatin | | 0.26 |
| | | Additive (1) | | 0.08 |
| | | Matting Agent (1) | | 0.05 |
| | | Hardening Agent (1) | | 0.07 |
| 23rd Layer | Ultra-violet-Absorbing Layer | Gelatin | | 0.48 |
| | | Ultraviolet Absorber (1) | | 0.09 |
| | | Ultraviolet Absorber (2) | | 0.08 |
| | | Additive (3) | | 0.08 |
| 22nd Layer | Blue-Sensitive Layer (high-sensitive) | Internal Latent Image Type Direct Positive Emulsion: A | as Ag | 0.67 |
| | | Sensitizing Dye (4) | | $1.4 \times 10^{-3}$ |
| | | Sensitizing Dye (5) | | $3.6 \times 10^{-4}$ |
| | | Nucleating Agent (1) | | $8.9 \times 10^{-6}$ |
| | | Additive (2) | | $4.1 \times 10^{-2}$ |
| | | Additive (4) | | $1.1 \times 10^{-3}$ |
| | | Additive (5) | | $7.0 \times 10^{-6}$ |
| | | Gelatin | | 1.00 |
| 21st Layer | Blue-Sensitive Layer (medium-sensitive) | Internal Latent Image Type Direct Positive Emulsion: B | as Ag | 0.11 |
| | | Sensitizing Dye (4) | | $3.3 \times 10^{-4}$ |
| | | Sensitizing Dye (5) | | $8.5 \times 10^{-5}$ |
| | | Nucleating Agent (1) | | $2.0 \times 10^{-6}$ |
| | | Additive (2) | | $9.2 \times 10^{-3}$ |
| | | Additive (4) | | $2.4 \times 10^{-4}$ |
| | | Additive (5) | | $1.7 \times 10^{-6}$ |
| | | Gelatin | | 0.20 |
| 20th Layer | Blue-Sensitive Layer (low-sensitive) | Internal Latent Image Type Direct Positive Emulsion: C | as Ag | 0.18 |
| | | Sensitizing Dye (4) | | $3.3 \times 10^{-4}$ |
| | | Sensitizing Dye (5) | | $1.5 \times 10^{-4}$ |
| | | Nucleating Agent (1) | | $7.8 \times 10^{-6}$ |
| | | Additive (2) | | $2.0 \times 10^{-6}$ |
| | | Additive (4) | | $2.7 \times 10^{-4}$ |
| | | Additive (5) | | $2.4 \times 10^{-6}$ |
| | | Gelatin | | 0.43 |

TABLE 37A-continued

Construction of Comparative Light-Sensitive Material K401

| Layer | Name of Layer | Additives | | Coating Amount (g/m²) |
|---|---|---|---|---|
| 19th Layer | White Reflecting Layer | Titanium dioxide | | 1.10 |
| | | Additive (1) | | $2.5 \times 10^{-2}$ |
| | | Gelatin | | 0.32 |
| 18th Layer | Yellow Coloring Material Layer | Yellow Dye Releasing Compound (1) | | 0.47 |
| | | High Boiling Point Organic Solvent (1) | | $9.4 \times 10^{-2}$ |
| | | Gelatin | | 0.42 |
| 17th Layer | Interlayer | Gelatin | | 0.23 |
| 16th Layer | Color Mixing Preventing Layer | Additive (1) | | 0.90 |
| | | Polymethyl methacrylate | | 0.25 |
| | | Gelatin | | 0.51 |
| 15th Layer | Green-Sensitive Layer (high-sensitive) | Internal Latent Image Type Direct Positive Emulsion: D | as Ag | 0.60 |
| | | Sensitizing Dye (2) | | $1.3 \times 10^{-3}$ |
| | | Sensitizing Dye (3) | | $1.1 \times 10^{-3}$ |
| | | Nucleating Agent (1) | | $2.7 \times 10^{-6}$ |
| | | Additive (2) | | $5.7 \times 10^{-2}$ |
| | | Additive (4) | | $2.8 \times 10^{-3}$ |
| | | Additive (5) | | $6.0 \times 10^{-6}$ |
| | | Gelatin | | 1.14 |
| 14th Layer | Green-Sensitive Layer (medium-sensitive) | Internal Latent Image Type Direct Positive Emulsion: E | as Ag | 0.09 |
| | | Sensitizing Dye (2) | | $9.0 \times 10^{-5}$ |
| | | Sensitizing Dye (3) | | $7.0 \times 10^{-5}$ |
| | | Nucleating Agent (1) | | $1.6 \times 10^{-6}$ |
| | | Additive (2) | | $1.9 \times 10^{-2}$ |
| | | Additive (4) | | $2.4 \times 10^{-4}$ |
| | | Gelatin | | 0.19 |
| 13th Layer | Green-Sensitive Layer (low-sensitive) | Internal Latent Image Type Direct Positive Emulsion: F | as Ag | 0.11 |
| | | Sensitizing Dye (2) | | $7.0 \times 10^{-5}$ |
| | | Sensitizing Dye (3) | | $5.0 \times 10^{-5}$ |
| | | Nucleating Agent (1) | | $1.3 \times 10^{-6}$ |
| | | Additive (2) | | $2.3 \times 10^{-2}$ |
| | | Additive (4) | | $2.3 \times 10^{-4}$ |
| | | Gelatin | | 0.18 |
| 12th Layer | White Reflecting Layer | Titanium dioxide | | 1.20 |
| | | Additive (1) | | $4.8 \times 10^{-2}$ |
| | | Additive (3) | | $2.7 \times 10^{-2}$ |
| | | Gelatin | | 0.36 |
| 11th Layer | Magenta Coloring Material Layer | Magenta Dye Releasing Compound (1) | | 0.33 |
| | | Additive (1) | | $1.6 \times 10^{-4}$ |
| | | Gelatin | | 0.19 |
| 10th Layer | Interlayer | Gelatin | | 0.29 |
| 9th Layer | Color Mixing Preventing Layer | Additive (1) | | 1.70 |
| | | Polymethyl methacrylate | | 0.43 |
| | | Gelatin | | 0.86 |
| 8th Layer | Red-Sensitive Layer (high-sensitive) | Internal Latent Image Type Direct Positive Emulsion: G | as Ag | 0.52 |
| | | Additive (6) | | $1.2 \times 10^{-4}$ |
| | | Sensitizing Dye (1) | | $6.4 \times 10^{-4}$ |
| | | Nucleating Agent (1) | | $3.5 \times 10^{-6}$ |
| | | Additive (2) | | $3.9 \times 10^{-2}$ |
| | | Additive (4) | | $2.8 \times 10^{-3}$ |
| | | Gelatin | | 0.52 |
| 7th Layer | Red-Sensitive Layer (medium-sensitive) | Internal Latent Image Type Direct Positive Emulsion: H | as Ag | 0.15 |
| | | Sensitizing Dye (1) | | $2.3 \times 10^{-4}$ |
| | | Nucleating Agent (1) | | $5.1 \times 10^{-6}$ |
| | | Additive (2) | | $2.5 \times 10^{-2}$ |
| | | Additive (4) | | $7.9 \times 10^{-4}$ |
| | | Gelatin | | 0.62 |

TABLE 37A-continued

Construction of Comparative Light-Sensitive Material K401

| Layer | Name of Layer | Additives | Coating Amount ($g/m^2$) |
|---|---|---|---|
| 6th Layer | Red-Sensitive Layer (low-sensitive) | Internal Latent Image Type Direct Positive Emulsion: I as Ag | 0.12 |
| | | Sensitizing Dye (1) | $2.9 \times 10^{-4}$ |
| | | Nucleating Agent (1) | $2.1 \times 10^{-5}$ |
| | | Additive (2) | $2.0 \times 10^{-2}$ |
| | | Additive (4) | $6.5 \times 10^{-4}$ |
| | | Gelatin | 0.51 |
| 5th Layer | White Reflecting Layer | Titanium dioxide | 3.40 |
| | | Gelatin | 0.84 |
| 4th Layer | Cyan Coloring | Cyan Dye Releasing Compound (1) | 0.36 |

TABLE 37A-continued

Construction of Comparative Light-Sensitive Material K401

| Layer | Name of Layer | Additives | Coating Amount ($g/m^2$) |
|---|---|---|---|
| | Material Layer | High Boiling Point Organic Solvent (1) | $3.0 \times 10^{-2}$ |
| | | Additive (2) | $3.0 \times 10^{-2}$ |
| | | Gelatin | 0.4 |
| 3rd Layer | Opaque Layer | Carbon black | 1.70 |
| | | Gelatin | 1.70 |
| 2nd Layer | White Reflecting Layer | Titanium dioxide | 22.00 |
| | | Gelatin | 2.75 |
| 1st Layer | Image-Receiving Layer | Polymer Mordant (1) | 3.00 |
| | | Gelatin | 3.00 |
| Support | Polyethylene terephthalate film (thickness: 120 $\mu$m) | | |

TABLE 38

Characteristics of Emulsion

| Emulsion | Halogen Composition | Core/Shell Ratio | Average Grain Size (um)*1) |
|---|---|---|---|
| Emulsion A | $AgBr_{100}$ | 1/5 | 1.40 |
| Emulsion B | $AgBr_{100}$ | 1/20 | 1.10 |
| Emulsion C | $AgBr_{100}$ | 1/11 | 0.83 |
| Emulsion D*2) | $AgBr_{100}$ | 1/5 | 1.40 |
| Emulsion E | $AgBr_{100}$ | 1/20 | 1.00 |
| Emulsion F | $AgBr_{100}$ | 1/5 | 0.83 |
| Emulsion G | $AgBr_{100}$ | 1/5 | 1.40 |
| Emulsion H | $AgBr_{100}$ | 1/5 | 1.00 |
| Emulsion I | $AgBr_{100}$ | 1/10 | 0.56 |

*1)sphere-corresponding diameter

*2)aspect ratio 6.34 (average grain diameter/average grain thickness)

Nucleating Agent (1):

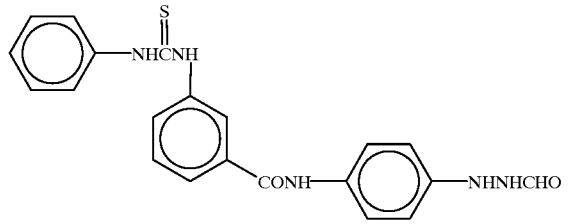

Sensitizing Dye (1):

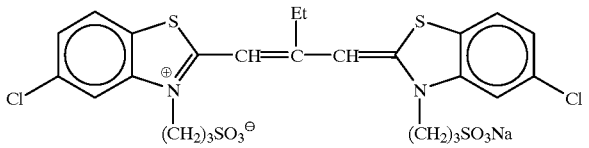

TABLE 38-continued
| Characteristics of Emulsion |
|---|
Sensitizing Dye (2):
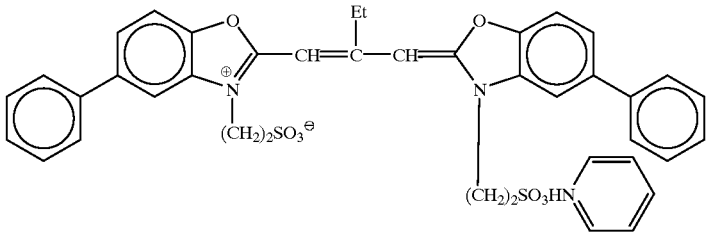
Sensitizing Dye (3):
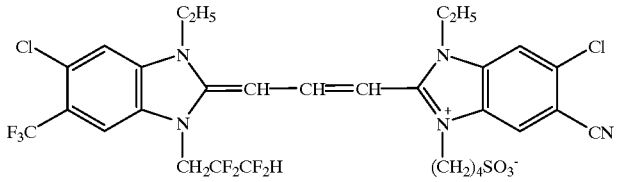
Yellow Dye Releasing Compound (1):
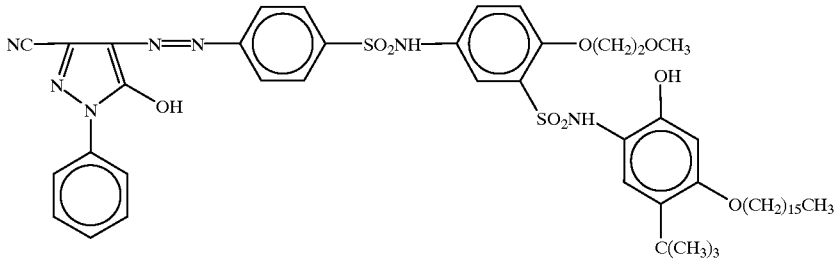
Additive (1):
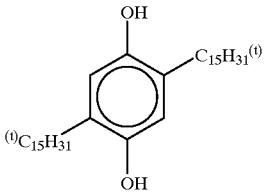
Additive (2):
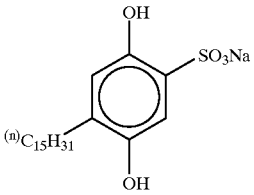

TABLE 38-continued
| Characteristics of Emulsion |
|---|
Additive (3):
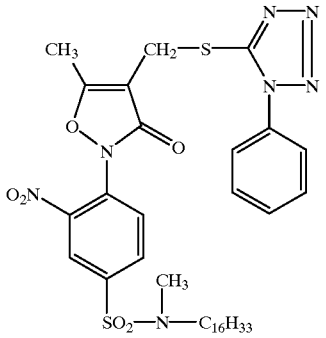
Additive (4):
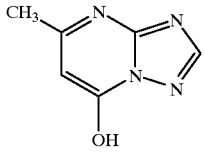
Additive (5):
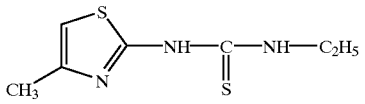
Additive (6):
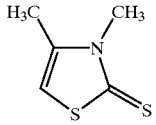
High Boiling Point Organic Solvent (1):
Tricyclohexyl phosphate
Hardening Agent (1):
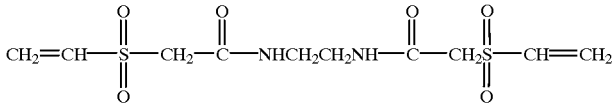
Sensitizing Dye (4):
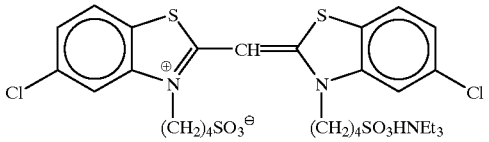
Sensitizing Dye (5):
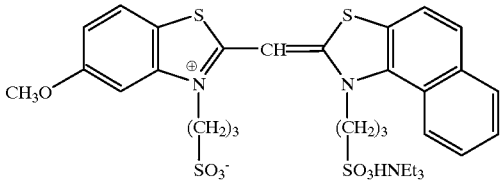

TABLE 38-continued
| Characteristics of Emulsion |
| --- |
Cyan Dye Releasing Compound (1):
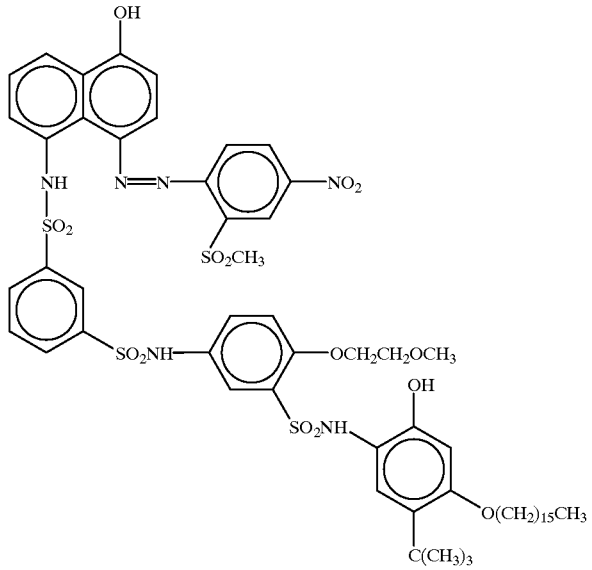
Magenta Dye Releasing Compound (1):
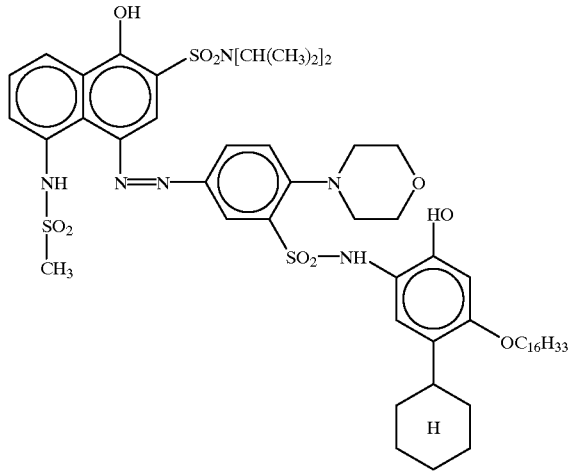
Polymer Mordant (1);
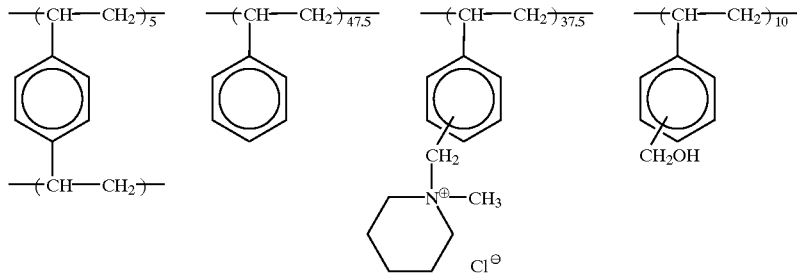

TABLE 38-continued

Characteristics of Emulsion

Ultraviolet Absorber (1):

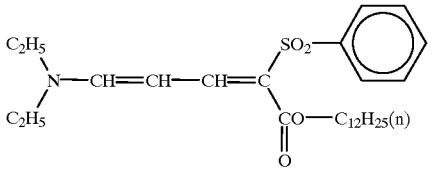

Ultraviolet Absorber (2):

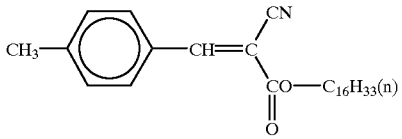

Matting Agent (1):
Polymethyl methacrylate spherical latex
(average particle size: 4 μm)
Accelerator (1):

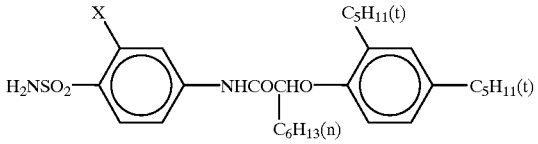

X = H or $CH_3$
molar ratio: 1:1

Light-Sensitive Materials K402 to K405 were prepared in the same manner as in Comparative Light-Sensitive Material K401 except for replacing Cyan Dye Releasing Compound (1) of the fourth layer (cyan dye releasing layer) with the dye donating compounds shown in Table 39A below, respectively.

TABLE 39A

| Light-Sensitive Material | Dye Donating Compound | Remarks |
|---|---|---|
| K401 | Dye Releasing Compound (1) | Comparison |
| K402 | Compound 14a | Invention |
| K403 | Compound 15a | Invention |
| K404 | Compound 27a | Invention |

A cover sheet was prepared as follows.

The following layers were coated on a polyethylene terephthalate transparent support subbed with gelatin and containing a light piping preventing dye:

(1) a neutralization layer containing 10.4 g/m$^2$ of an acrylic acid/butyl acrylate (molar ratio: 8:2) copolymer having an average molecular weight of 50,000 and 0.1 g/m$^2$ of 1,4-bis(2,3-epoxypropoxy)butane;

(2) a neutralization timing layer containing 4.3 g/m$^2$ of acetyl cellulose having an acetylation degree of 51% and 0.2 g/m$^2$ of poly(methyl vinyl ether-co-monomethyl maleate); and (3) a layer containing a 6:4 (as a solid content ratio) blend of a polymer latex obtained by emulsion polymerization of styrene/butyl acrylate/acrylic acid/N-methylolacrylamide at a weight ratio of 49.7:42.3:4:4, with a polymer latex obtained by emulsion polymerization of methyl methacrylate/acrylic acid/N-methylolacrylamide at a weight ratio of 93:3:4, and having a total solid content of 1.0 g/m$^2$.

Formulation of an alkali processing composition is shown below.

A processing solution (0.8 g) having the following composition was packed in a rupturable container.

| | |
|---|---|
| 1-p-Tolyl-4-hydroxymethyl-4-methyl-3-pyrazolidone | 10.0 g |
| Methyl hydroquinone | 0.18 g |
| 5-Methylbenzotriazole | 3.0 g |
| Sodium sulfite (anhydrous) | 0.2 g |
| Benzyl alcohol | 1.5 ml |
| Carboxymethyl cellulose Na salt | 58 g |
| Carbon black | 150 g |
| Potassium hydroxide (28% aqueous solution) | 200 ml |
| Water | 680 ml |

The processing solution having the above-described composition was packed in a container rupturable by pressure in an amount of 0.8 g.

Each of the above-described light-sensitive materials was exposed through a gray filter from the emulsion layer side and superposed on the cover sheet described above, and the processing solution described above was spread between these materials by means of a pressure roller at 25° C. to have a thickness of 75 μm.

Evaluation of fastness to light, humidity and heat was performed in the same manner as in Example 1A. As a result, in the case of using the compound of the present invention, a cyan image having high fastness to light, humidity and heat could be obtained as compared with the comparative example.

EXAMPLE 1B

Image Receiving Material M101 having a Composition shown in Tables 1B and 2B below was prepared.

TABLE 1B

Composition of Image Receiving Material M101

| Layer | Additives | Coating Amount ($mg/m^2$) |
|---|---|---|
| Sixth Layer | Water-Soluble Polymer (1) | 130 |
| | Water-Soluble Polymer (2) | 35 |
| | Water-Soluble Polymer (3) | 45 |
| | Potassium nitrate | 20 |
| | Anionic Surfactant (1) | 6 |
| | Anionic Surfactant (2) | 6 |
| | Amphoteric Surfactant (1) | 50 |
| | Stain Inhibitor (1) | 7 |
| | Stain Inhibitor (2) | 12 |
| | Matting Agent (1) | 7 |
| Fifth Layer | Acid-processed gelatin | 170 |
| | Water-Soluble Polymer (5) | 35 |
| | Anionic Surfactant (3) | 6 |
| | Matting Agent (2) | 140 |
| | Hardening Agent (1) | 60 |
| Fourth Layer | Mordant (1) | 1,850 |
| | Water-Soluble Polymer (2) | 260 |
| | Water-Soluble Polymer (4) | 1,400 |
| | Latex Dispersion (1) | 600 |
| | Anionic Surfactant (3) | 25 |
| | Nonionic Surfactant (1) | 18 |
| | Guanidine picolinate | 2,550 |
| | Sodium quinolinate | 350 |
| Third Layer | Gelatin | 370 |
| | Mordant (1) | 300 |
| | Anionic Surfactant (3) | 12 |
| Second Layer | Gelatin | 700 |
| | Mordant (1) | 290 |
| | Water-Soluble Polymer (1) | 55 |
| | Water-Soluble Polymer (2) | 330 |
| | Anionic Surfactant (3) | 30 |
| | Anionic Surfactant (4) | 7 |
| | High Boiling Point Organic Solvent (1) | 700 |
| | Fluorescent Brightening Agent (1) | 30 |
| | Stain Inhibitor (3) | 32 |
| | Guanidine picolinate | 360 |
| | Potassium quinolinate | 45 |
| First Layer | Acid-processed gelatin | 290 |
| | Anionic Surfactant (1) | 16 |
| | Sodium metaborate | 45 |
| | Matting Agent (2) | 490 |
| | Hardening Agent (1) | 310 |
| Support (1) | Polyethylene-laminated paper support (thickness: 215 $\mu$m) | |

Note: The coating amount of Latex Dispersion (1) means a coating amount of solid component of the latex.

TABLE 2B

Support (1)

| Layer | Composition | Thickness ($\mu$m) |
|---|---|---|
| Front Surface Subbing Layer | Gelatin | 0.1 |
| Front Surface PE Layer (glossy) | Low-density polyethylene (density: 0.923): 90.2 parts Surface-treated titanium oxide: 9.8 parts | 36.0 |
| Pulp Layer | Wood free paper (LBKP/NBKP = 1/1, density: 1.080) | 152.0 |

TABLE 2B-continued

Support (1)

| | | |
|---|---|---|
| Back Surface PE Layer | High-density polyethylene (density: 0.955) | 27.0 |
| Back | Styrene/acrylate copolymer | 0.1 |
| Surface Subbing Layer | Colloidal silica Sodium polystyrenesulfonate | |
| | Total | 215.2 |

Anionic Surfactant (1):

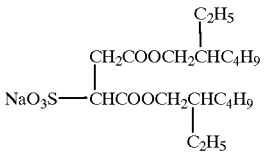

Anionic Surfactant (2):

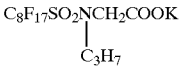

Anionic Surfactant (3):

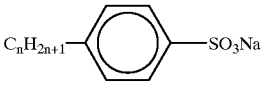

n ≈ 12.6

Anionic Surfactant (4):

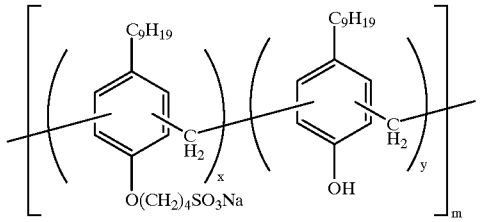

x:y = 4:6
m ≈ 6.8

Nonionic Surfactant (1):

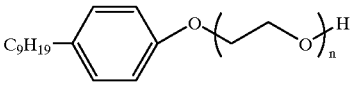

n = 85

Amphoteric Surfactant (1):

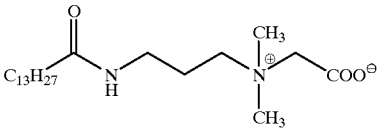

Fluorescent Brightening Agent (1):

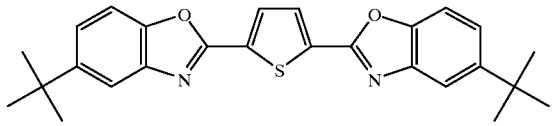

TABLE 2B-continued

| Support (1) |
|---|

Mordant (1):

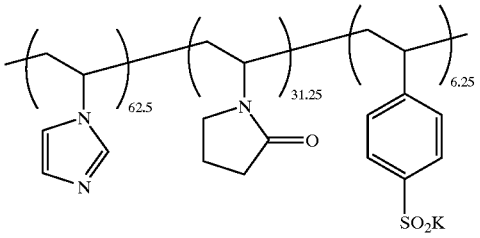

Stain Inhibitor (1):

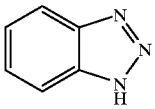

Stain Inhibitor (2):

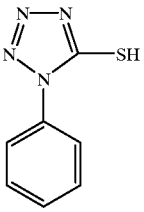

Stain Inhibitor (3):

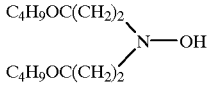

High-Boiling Point Organic Solvent (1):
$C_{26}H_{46.9}Cl_{7.1}$
Emparad40 (manufactured by Ajinomoto Co., Inc.)
Water-Soluble Polymer (1):
Sumikagel L5-H (manufactured by Sumitomo Chemical Co., Ltd.)
Water-Soluble Polymer (2):
Dextran (molecular weight: 70,000)
Water-Soluble Polymer (3):
κ-Carrageenan (manufactured by Taito Co., Ltd.)
Water-Soluble Polymer (4):
MP Polymer MP-102 (manufactured by Kuraray Co., Ltd.)
Water-Soluble Polymer (5):
Acryl-modified polyvinyl alcohol copolymer (degree of modification: 17%)
Latex Dispersion (1):
LX-438 (manufactured by Nippon Zeon Co., Ltd.)
Matting Agent (1):
SYLOID79 (manufactured by Fuji Devison Co., Ltd.)
Matting Agent (2):
PMMA particle (average particle size: 4 μm)
Hardening Agent (1):

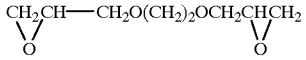

Preparation of a heat developable color light-sensitive material is described below.

Preparation of light-sensitive silver halide emulsions is described below.

Light-Sensitive Silver Halide Emulsion (1) (emulsion for the fifth layer (680 nm light-sensitive layer)):

To an aqueous solution having a composition shown in Table 3B below under well stirring, Solution (I) and Solution (II) each having a composition shown in Table 4B below were simultaneously added over a period of 13 minutes, and 10 minutes after then, Solution (III) and Solution (IV) each having a composition shown in Table 4B below were added over a period of 33 minutes.

TABLE 3B

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 45° C. |

TABLE 4B

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_2IrCl_6$ | — | — | — | 0.039 mg |
| Total | Water to make 126 ml | Water to make 132 ml | Water to make 254 ml | Water to make 252 ml |

Silver Halide Solvent (1):

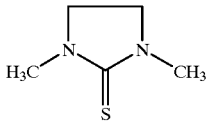

Further, 13 minutes after the initiation of the addition of Solution (III), 150 ml of an aqueous solution containing 0.350% of Sensitizing Dye (1) was added over a period of 27 minutes.

Sensitizing Dye (1):

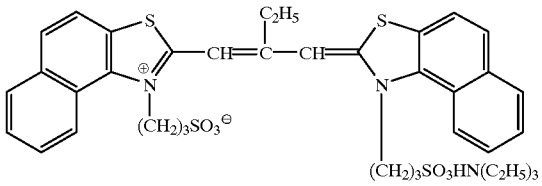

The mixture was washed with water and desalted (performed using Flocculant (a) at a pH of 4.1) according to a conventional method, 22 g of a lime-processed ossein gelatin was added thereto, the pH and the pAg were adjusted to 6.0 and 7.9, respectively, and chemical sensitization was performed at 60° C. The compounds used in the chemical sensitization are shown in Table 5B below. The resulting emulsion in a yield of 630 g was a monodispersed cubic silver chlorobromide emulsion having a coefficient of variation of 10.2% and an average grain size of 0.20 μm.

Flocculant (a):

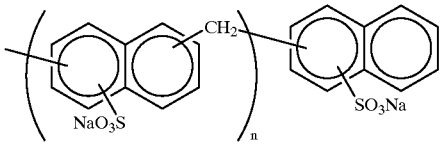

Flocculant (b):

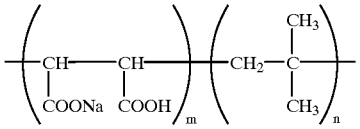

TABLE 5B

| Chemicals used in Chemical Sensitization | Amount added |
|---|---|
| 4-Hydroxy-6-methyl-1,3,3a,7-tetrazaindene | 0.36 g |
| Sodium thiosulfate | 6.75 mg |
| Antifoggant (1) | 0.11 g |
| Antiseptic (1) | 0.07 g |
| Antiseptic (2) | 3.13 g |

Antifoggant (1)

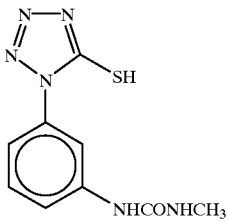

Antiseptic (1)

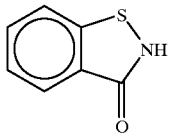

Antiseptic (2)

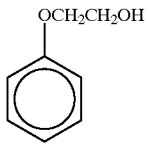

Light-Sensitive Silver Halide Emulsion (2) (emulsion for the third layer (750 nm light-sensitive layer)):

To an aqueous solution having a composition shown in Table 6B below under well stirring, Solution (I) and Solution (II) each having a composition shown in Table 7B below were simultaneously added over a period of 18 minutes, and 10 minutes after then, Solution (III) and Solution (IV) each having a composition shown in Table 7B below were added over a period of 24 minutes.

TABLE 6B

| Composition | |
|---|---|
| $H_2O$ | 620 ml |
| Lime-processed gelatin | 20 g |

TABLE 6B-continued

| Composition | |
|---|---|
| KBr | 0.3 g |
| NaCl | 2 g |
| Silver Halide Solvent (1) | 0.030 g |
| Sulfuric acid (1N) | 16 ml |
| Temperature | 45° C. |

TABLE 7B

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_4[Fe(CN)_6].H_2O$ | | | | 0.07 g |
| $K_2IrCl_6$ | — | — | — | 0.040 mg |
| Total | Water to make 188 ml | Water to make 188 ml | Water to make 250 ml | Water to make 250 ml |

The mixture was washed with water and desalted (performed using Flocculant (b) at a pH of 3.9) according to a conventional method, 22 g of a lime-processed ossein gelatin subjected to removal of calcium (calcium content: 150 ppm or less) was added and redispersed at 40° C., 0.39 g of 4-hydroxy-6-methyl-1,3,3a,7-tetrazaindene was added thereto, and the pH and the pAg were adjusted to 5.9 and 7.8, respectively. Thereafter, chemical sensitization was performed at 70° C. using chemicals shown in Table 8B below. At the final of the chemical sensitization, Sensitizing Dyes (2) as a methanol solution (solution having a composition shown in Table 9B below) was added. Further, after the chemical sensitization, the temperature was lowered to 40° C., 200 g of a gelatin dispersion of Stabilizer (1) shown below was added and well stirred, and then the mixture was stored. The resulting emulsion in a yield of 938 g was a monodispersed cubic silver chlorobromide emulsion having a coefficient of variation of 12.6% and an average grain size of 0.25 $\mu$m.

TABLE 8B

| Chemicals used in Chemical Sensitization | Amount added |
|---|---|
| 4-Hydroxy-6-methyl-1,3,3a,7-tetrazaindene | 0.39 g |
| Triethylthiourea | 3.3 mg |
| Nucleic acid decomposition product | 0.39 g |
| NaCl | 0.15 g |
| KI | 0.12 g |
| Antifoggant (2) | 0.10 g |
| Antiseptic (1) | 0.07 g |

TABLE 9B

| Composition of Dye Solution | Amount added |
|---|---|
| Sensitizing Dye (2) | 0.19 g |
| Methanol | 18.7 ml |

TABLE 9B-continued

| Composition of Dye Solution | Amount added |
|---|---|

Stabilizer (1):

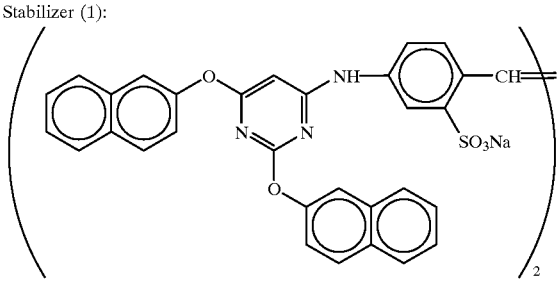

Antifoggant (2):

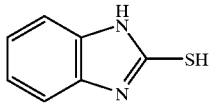

Sensitizing Dye (2):

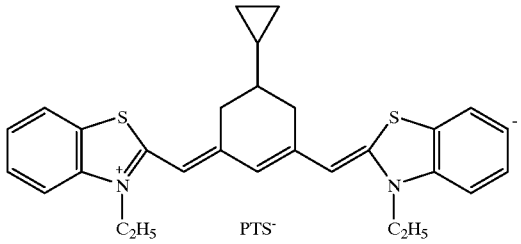

PTS: p-toluenesulfonic acid

Light-Sensitive Silver Halide Emulsion (3) (emulsion for the first layer (810 nm light-sensitive layer)):

To an aqueous solution having a composition shown in Table 10B below under well stirring, Solution (I) and Solution (II) each having a composition shown in Table 11B below were simultaneously added over a period of 18 minutes, and 10 minutes after then, Solution (III) and Solution (IV) each having a composition shown in Table 11B below were added over a period of 24 minutes.

TABLE 10B

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 50° C. |

TABLE 11B

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total | Water to make 180 ml | Water to make 181 ml | Water to make 242 ml | Water to make 250 ml |

The mixture was washed with water and desalted (performed using Flocculant (a) at a pH of 3.8) according to a conventional method, 22 g of a lime-processed ossein gelatin was added, the pH and the pAg were adjusted to 7.4 and 7.8, respectively, and chemical sensitization was performed at 60° C. The chemicals used in the chemical sensitization are shown in Table 12B below. The resulting emulsion in a yield of 683 g was a monodispersed cubic silver chlorobromide emulsion having a coefficient of variation of 9.7% and an average grain size of 0.32 μm.

TABLE 12B

| Chemicals used in Chemical Sensitization | Amount added |
|---|---|
| 4-Hydroxy-6-methyl-1,3,3a,7-tetrazaindene | 0.38 g |
| Triethylthiourea | 3.10 mg |
| Antifoggant (2) | 0.19 g |
| Antiseptic (1) | 0.07 g |
| Antiseptic (2) | 3.13 g |

A preparation method of fine grain silver chloride particles incorporated into the first layer (810 nm light-sensitive layer) is described below.

To an aqueous solution having a composition shown in Table 13B below under well stirring, Solution (I) and Solution (II) each having a composition shown in Table 14B were simultaneously added over a period of 4 minutes, and 3 minutes after then, Solution (III) and Solution (IV) each having a composition shown in Table 14B were added over a period of 8 minutes.

TABLE 13B

| Composition | |
|---|---|
| $H_2O$ | 3,770 ml |
| Lime-processed gelatin | 60 g |
| NaCl | 0.8 g |
| Temperature | 38° C. |

TABLE 14B

| | Solution (I) | Solution (II) | Solution (III) | Solution (IV) |
|---|---|---|---|---|
| $AgNO_3$ | 300 g | — | 300 g | — |
| $NH_4NO_3$ | 10 g | — | 10 g | — |
| NaCl | — | 108 g | — | 104 g |
| Total | Water to make 940 ml | Water to make 940 ml | Water to make 1,170 ml | Water to make 1,180 ml |

The mixture was washed with water and desalted (performed using Flocculant (a) at a pH of 3.9) according to a conventional method, 132 g of lime-processed gelatin was added thereto, redispersed at 35° C., 4 g of 4-hydroxy-6-methyl-1,3,3a,7-tetraazaindene was added thereto, and the pH was adjusted to 5.7. The yield of the resulting fine grain silver chloride emulsion was 3,200 g and the average grain size thereof was 0.10 μm.

A preparation method of a gelatin dispersion of colloidal silver is described below.

To a well stirred aqueous solution having a composition shown in Table 15B below, a solution having a composition shown in Table 16B below was added over a period of 24 minutes. Thereafter, the mixture was washed with water using Flocculant (a), then 43 g of a lime-processed ossein gelatin was added, and the pH was adjusted to 6.3. The average grain size was 0.02 μm and the yield was 512 g (dispersion containing 2% of silver and 6.8% of gelatin).

TABLE 15B

| Composition | |
|---|---|
| $H_2O$ | 620 ml |
| Dextrin | 16 g |
| NaOH (5N) | 41 ml |
| Temperature | 30° C. |

TABLE 16B

| Composition | |
|---|---|
| $H_2O$ | 135 ml |
| $AgNO_3$ | 17 g |

A preparation method of a gelatin dispersion of each hydrophobic additive is described below.

A gelatin dispersion of each of a yellow dye donating compound, a magenta dye donating compound and a cyan dye donating compound was prepared according to the formulation shown in Table 17B below. More specifically, each oil phase component was dissolved under heating at about 70° C. to form a uniform solution, an aqueous phase component heated at about 60° C. was added to.the solution, and the components were mixed under stirring and then dispersed in a homogenizer for 10 minutes at 10,000 rpm. Water was added thereto and the mixture was stirred to obtain a homogenous dispersion. Then, the gelatin dispersion of the cyan dye donating compound was subjected to repetition of dilution with water and concentration using an ultrafiltration module (Ultrafiltration Module ACV-3050, manufactured by Asahi Chemical Industry Co., Ltd.) to reduce the weight of ethyl acetate to 1/17.6 of the weight of ethyl acetate shown in Table 17B below.

TABLE 17B

| | Composition of Dispersion | | |
|---|---|---|---|
| | Yellow | Magenta | Cyan |
| Oil phase | | | |
| Cyan Dye Donating Compound (1) | — | — | 10.3 g |
| Cyan Dye Donating Compound (2) | — | — | 7.2 g |
| Magenta Dye Donating Compound (1) | — | 16.3 g | — |
| Yellow Dye Donating Compound (1) | 9.8 g | — | — |
| Reducing Agent (1) | 0.9 g | 0.2 g | 1.0 g |
| Antifoggant (3) | 0.1 g | — | 0.2 g |
| Antifoggant (4) | — | 0.7 g | — |
| Surfactant (1) | 1.1 g | — | — |
| High Boiling Point Solvent (1) | — | — | 4.6 g |
| High Boiling Point Solvent (2) | 4.9 | 7.4 | 4.9 g |
| High boiling Point Solvent (3) | — | — | 1.2 g |
| Development Accelerator (1) | 2.5 | 2.9 | — |
| Dye (a) | 1.1 g | — | 0.5 g |
| Water | 0.4 ml | — | — |
| Ethyl acetate | 9.6 ml | 50.1 ml | 55.2 ml |
| Aqueous phase | | | |
| Lime-processed gelatin | 10.0 g | 10.0 g | 10.0 g |
| Calcium nitrate | 0.1 g | 0.1 g | — |
| Surfactant (1) | — | 0.2 g | 0.8 g |
| Sodium hydroxide aq. soln. (1N) | — | 1.9 ml | — |
| Carboxymethyl cellulose | — | — | 0.3 g |
| Water | 26.1 ml | 139.7 ml | 95.9 ml |
| Water added | 99.9 ml | 157.3 ml | 209.0 ml |
| Antiseptic (1) | 0.004 g | 0.04 g | 0.1 g |

A gelatin dispersion of Antifoggant (4) was prepared according to the formulation shown in Table 18B below. more specifically, each oil phase component was dissolved under heating at about 60° C., an aqueous phase component heated at about 60° C. was added to the solution, and the components were mixed under stirring and then dispersed in a homogenizer for 10 minutes at 10,000 rpm to obtain a homogenous dispersion.

TABLE 18B

| Composition of Dispersion | |
|---|---|
| Oil phase | |
| Antifoggant (4) | 0.8 g |
| Reducing Agent (1) | 0.1 g |
| High Boiling Point Solvent (2) | 2.3 g |
| High Boiling Point Solvent (5) | 0.2 g |
| Surfactant (1) | 0.5 g |
| Surfactant (4) | 0.5 g |
| Ethyl acetate | 10.0 ml |
| Aqueous phase | |
| Acid-processed gelatin | 10.0 g |
| Antiseptic (1) | 0.004 g |
| Calcium nitrate | 0.1 g |
| Water | 35.0 ml |
| Water added | 104.0 ml |

A gelatin dispersion of Reducing Agent (2) was prepared according to the formulation shown in Table 19B below. More specifically, each oil phase component was dissolved under heating at about 60° C., an aqueous phase component heated at about 60° C. was added to the solution, and the components were mixed under stirring and then dispersed in a homogenizer for 10 minutes at 10,000 rpm to obtain a homogenous dispersion. From the resulting dispersion, ethyl acetate was removed using a reduced-pressure organic solvent-removing device.

TABLE 19B

| Composition of Dispersion | |
|---|---|
| Oil phase | |
| Reducing Agent (2) | 7.5 g |
| High Boiling Point Solvent (1) | 4.7 g |
| Surfactant (1) | 1.9 g |
| Ethyl acetate | 14.4 ml |
| Aqueous phase | |
| Acid-processed gelatin | 10.0 g |
| Antiseptic (1) | 0.02 g |
| Antiseptic (3) | 0.04 g |
| Sodium hydrogensulfite | 0.1 g |
| Water | 136.7 ml |

A dispersion of Polymer Latex (a) was prepared according to the formulation shown in Table 20B. More specifically, to a mixture of Polymer Latex (a), Surfactant (5) and water was added an aqueous solution of Anionic Surfactant (6) over a period of 10 minutes with stirring to obtain a homogenous dispersion. Then, the dispersion was subjected to repetition of dilution with water and concentration using an ultrafiltration module (Ultrafiltration Module ACV-3050, manufactured by Asahi Chemical Industry Co., Ltd.) to reduce the concentration of salt to 1/9 of the concentration of salt in Table 20B.

TABLE 20B

| Composition of Dispersion | |
|---|---|
| Aqueous solution of Polymer Latex (a) (solid content: 13%) | 108.0 ml |
| Surfactant (5) | 20.0 g |
| Aqueous solution (5%) of Anionic Surfactant (6) | 600.0 ml |
| Water | 1,232.0 ml |

A gelatin dispersion of Stabilizer (1) was prepared according to the formulation shown in Table 21B below. More specifically, each oil phase component was dissolved at room temperature, an aqueous phase component heated at about 40° C. was added to the solution, and the components were mixed while stirring and dispersed in a homogenizer for 10 minutes at 10,000 rpm. Water was added thereto and stirred to obtain a homogenous dispersion.

TABLE 21B

| Composition of Dispersion | |
|---|---|
| Oil phase | |
| Stabilizer (1) | 4.0 g |
| Sodium hydroxide | 0.3 g |
| Methanol | 62.8 g |
| High Boiling Point Solvent (4) | 0.9 g |
| Aqueous phase | |
| Gelatin subjected to removal of calcium | 10.0 g |

TABLE 21B-continued

| Composition of Dispersion | |
|---|---|
| (Ca content: 100 ppm or less) | |
| Antiseptic (1) | 0.04 g |
| Water | 320.5 ml |

A gelatin dispersion of zinc hydroxide was prepared according to the formulation shown in Table 22B below. More specifically, respective components were mixed, dissolved and dispersed for 30 minutes in a mill together with glass beads having an average particle size of 0.75 mm. The glass beads were separated and removed to obtain a homogenous dispersion. The zinc hydroxide used had an average particle size of 0.25 μm.

TABLE 22B

| Composition of Dispersion | |
|---|---|
| Zinc hydroxide | 15.9 g |
| Carboxy methyl cellulose | 0.7 g |
| Sodium polyacrylate | 0.07 g |
| Lime-processed gelatin | 4.2 g |
| Water | 100 ml |
| High Boiling Point Solvent (4) | 0.4 g |

A preparation method of a gelatin dispersion of a matting agent added to the protective layer is described below. PMMA was dissolved in methylene chloride and the resulting solution was added to gelatin together with a slight amount of a surfactant and dispersed while stirring at a high revolution speed. Then, methylene chloride was removed using a reduced-pressure solvent-removing device to obtain a homogenous dispersion having an average particle size of 4.3 μm.

Cyan Dye Donating Compound (1):

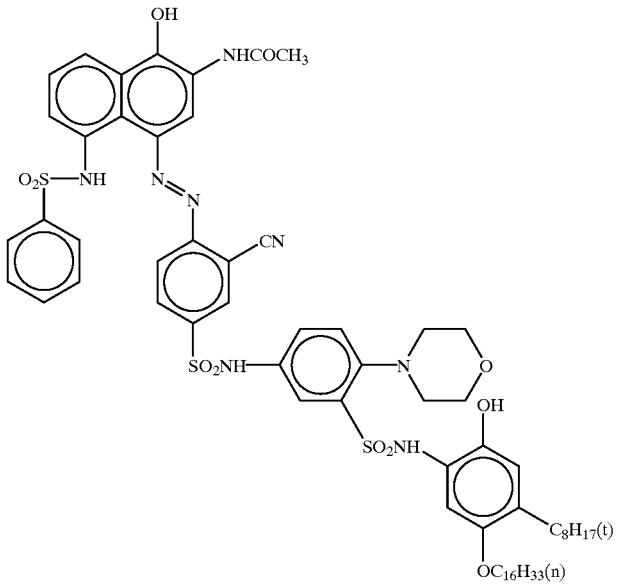

-continued
Cyan Dye Donating Compound (2):
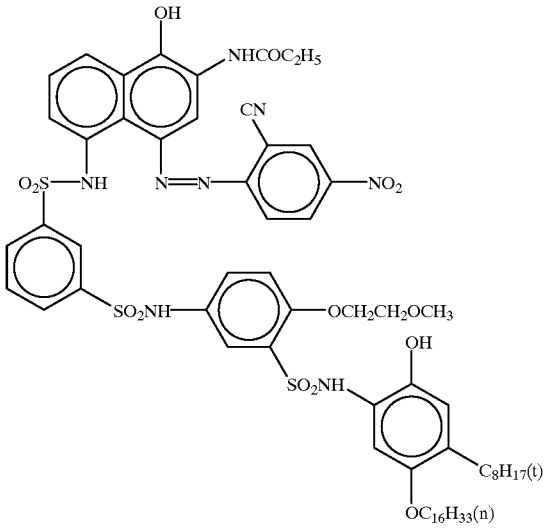
Dye (a):
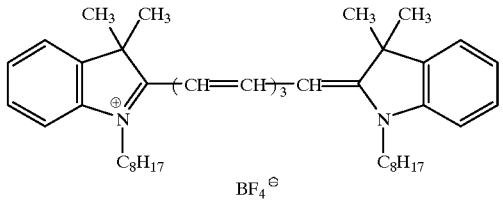
Magenta Dye Donating Compound (1):
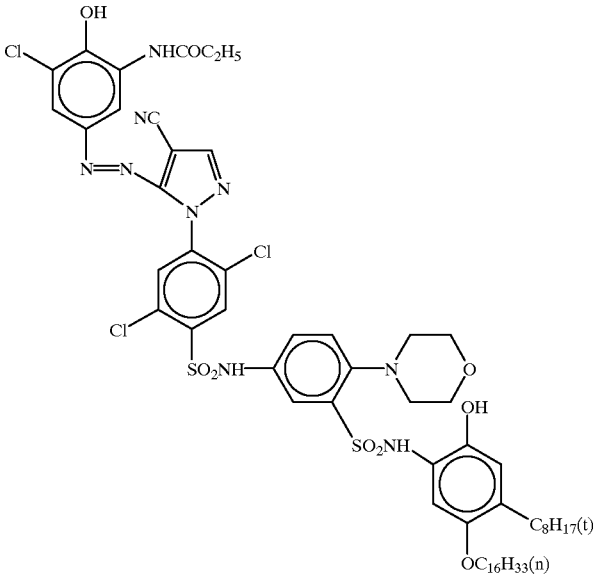
Yellow Dye Donation Compound:
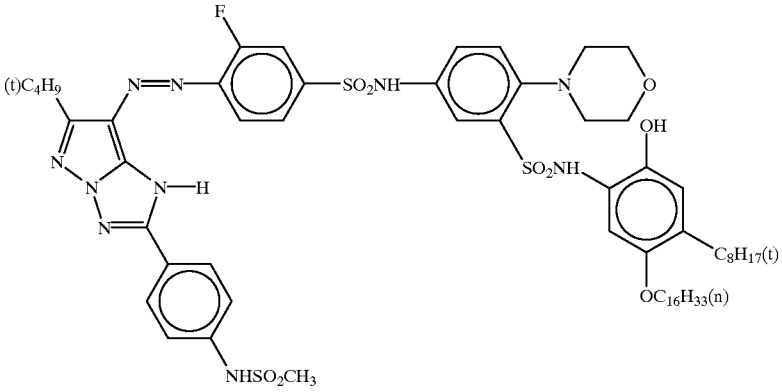

-continued
Reducing Agent (1):
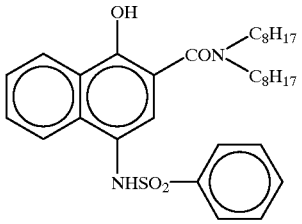
Antifoggant (3):
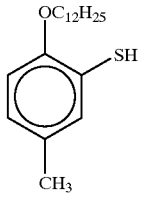
Antifoggant (4):
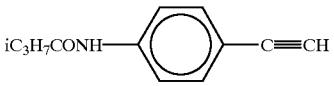
Surfactant (1):
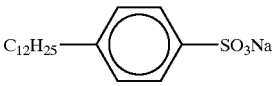
Development Accelerator (1):
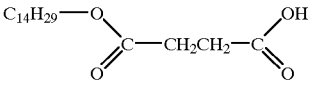
High Boiling Point Solvent (1):
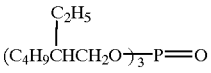
High Boiling Point Solvent (2):
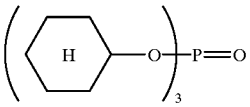
High Boiling Point Solvent (3):
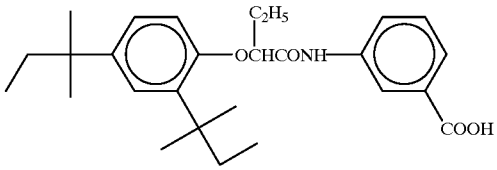
Antiseptic (3):
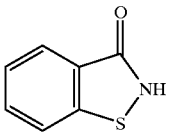
Reducing Agent (2):
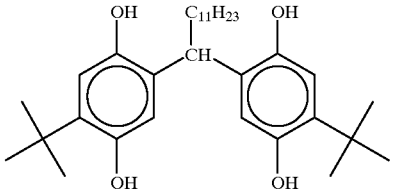
Antiseptic (4):
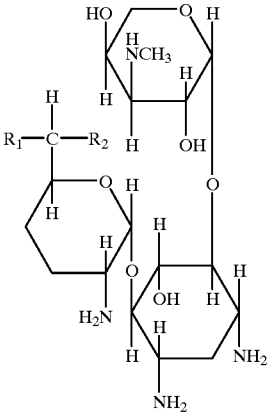
| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |
Surfactant (2):
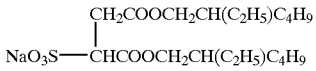

-continued
Surfactant (3):
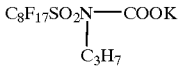
Water-Soluble Polymer (1):
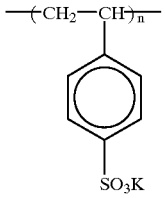
Limiting viscosity number [η] = 1.6
(0.1N NaCl, 30° C.)
Molecular weight ≈ 1,000,000
Water-Soluble Polymer (2):
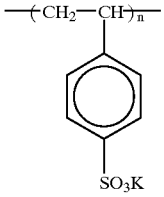
Limiting viscosity number [η] = 0.8
(0.1N NaCl, 30° C.)
Molecular weight ≈ 400,000
Antifoggant (5):
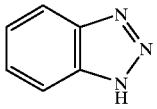
Sensitizing dye (3):
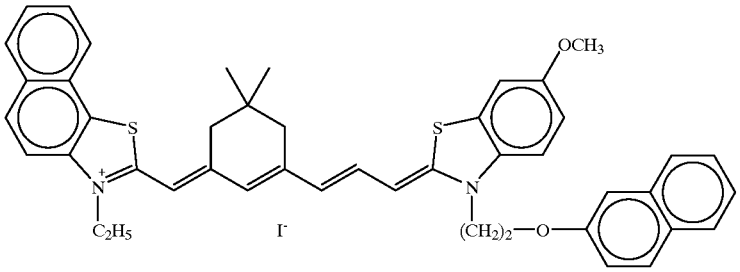
Hardening Agent (1):
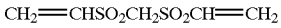
Surfactant (4):
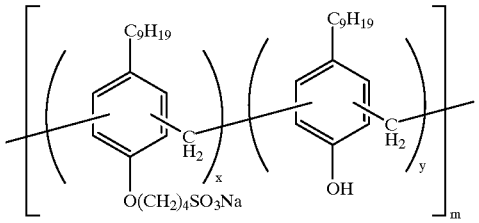
$x:y = 4:6$
$m \approx 6.8$
High-Boiling Point Solvent (5):
$C_{26}H_{46.9}Cl_{7.1}$
Empara 40 (manufactured by Ajinomoto Co., Ltd.)
Polymer Latex (a):
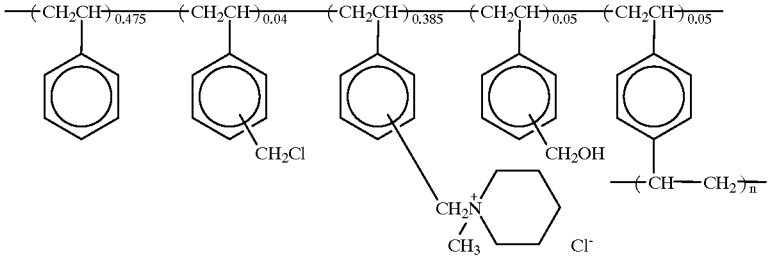

-continued

Surfactant (5):

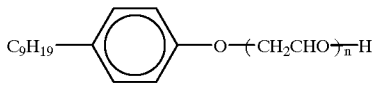

$n = 50$

Anionic Surfactant (6):

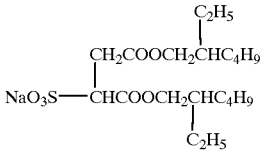

Using the above-described compounds and additives, Heat Developable Color Light-Sensitive Material 100 shown in Table 23B below was prepared.

TABLE 23B

Main Construction of Heat Developable Color Light Sensitive Material 100

| Layer | Name of Layer | Additives | Coating Amount (mg/m$^2$) |
|---|---|---|---|
| Seventh Layer | Protective Layer | Acid-processed gelatin | 437 |
| | | Reducing Agent (2) | 51 |
| | | High Boiling Point Solvent (1) | 32 |
| | | Colloidal silver grain | 2 |
| | | Matting agent (PMMA resin) | 17 |
| | | Surfactant (2) | 16 |
| | | Surfactant (1) | 13 |
| | | Surfactant (3) | 2 |
| | | Polymer Latex (a) | 11 |
| Sixth Layer | Interlayer | Lime-processed gelatin | 862 |
| | | Zinc hydroxide | 480 |
| | | Antifoggant (4) | 14 |
| | | Reducing Agent (1) | 2 |
| | | High Boiling Point Solvent (2) | 42 |
| | | High Boiling Point Solvent (5) | 4 |
| | | Surfactant (1) | 9 |
| | | Surfactant (4) | 9 |
| | | Water-soluble Polymer (1) | 4 |
| | | Calcium nitrate | 21 |
| Fifth Layer | 680 nm Light-Sensitive Layer | Lime-processed gelatin | 452 |
| | | Light-Sensitive Silver Halide Emulsion (1) | as Ag 301 |
| | | Magenta Dye Donating Compound (1) | 389 |
| | | High Boiling Point Solvent (2) | 291 |
| | | Reducing Agent (1) | 6 |
| | | Development Accelerator (1) | 60 |
| | | Antifoggant (4) | 20 |
| | | Surfactant (1) | 0.3 |
| | | Water-Soluble Polymer (1) | 11 |
| Fourth Layer | Interlayer | Lime-processed gelatin | 485 |
| | | Antifoggant (4) | 8 |
| | | Reducing Agent (1) | 1 |
| | | High Boiling Point Solvent (2) | 24 |
| | | High Boiling Point Solvent (5) | 2 |
| | | Surfactant (1) | 5 |
| | | Surfactant (4) | 5 |
| Third Layer | 750 nm Light-Sensitive Layer | Lime-processed gelatin | 373 |
| | | Light-Sensitive Silver Halide Emulsion (2) | as Ag 106 |
| | | Stabilizer (1) | 9 |
| | | Cyan Dye Donating Compound (1) | 222 |
| | | Cyan Dye Donating Compound (2) | 155 |
| | | Dye (a) | 10 |
| | | High Boiling Point Solvent (1) | 101 |
| | | High Boiling Point Solvent (2) | 108 |
| | | Reducing Agent (1) | 22 |
| | | Antifoggant (3) | 4 |
| | | Surfactant (1) | 0.9 |
| | | Carboxymethylcellulose | 5 |
| | | Water-Soluble Polymer (1) | 11 |

TABLE 23B-continued

Main Construction of Heat Developable Color Light Sensitive Material 100

| Layer | Name of Layer | Additives | Coating Amount (mg/m$^2$) |
|---|---|---|---|
| Second Layer | Interlayer | Lime-processed gelatin | 438 |
| | | Antifoggant (5) | 5 |
| | | Surfactant (5) | 150 |
| | | Water-Soluble Polymer (2) | 26 |
| | | Calcium nitrate | 8 |
| First Layer | 810 nm Light-Sensitive Layer | Lime-processed gelatin | 587 |
| | | Light-Sensitive Silver Halide Emulsion (3) | as Ag 311 |
| | | Fine Grain Silver Chloride Particle | as Ag 62 |
| | | Stabilizer (1) | 8 |
| | | Yellow Dye Donating Compound (1) | 403 |
| | | Sensitizing Dye (3) | 0.1 |
| | | Dye (a) | 44 |
| | | High-Boiling Point Solvent (2) | 201 |
| | | Reducing Agent (1) | 35 |
| | | Development Accelerator (1) | 101 |
| | | Antifoggant (3) | 6 |
| | | Water-Soluble Polymer (2) | 46 |
| | | Hardening Agent (1) | 45 |

Support: Polyethylene-laminated paper support (thickness: 131 $\mu$m)

Note: Trace additives such as an antiseptic were omitted in the Tables above.

Light-Sensitive Materials 101 to 111 were prepared in the same manner as in Heat Developable Light-Sensitive Material 100 except for replacing the cyan, magenta and yellow dye donating compounds with the dye donating compounds shown in Table 24B below, respectively. Also, Light-Sensitive Material 112 was prepared in the same manner as in Light-Sensitive Material 100 except for replacing Sensitizing Dye (3) with Sensitizing Dye (4) in the 810 nm light-sensitive layer of Light-Sensitive Material 100. Further, for comparison, Light-Sensitive Materials R101 to R103 were prepared in the same manner as in Light-Sensitive Material 100 except for replacing the cyan, magenta and yellow dye donating compounds with the comparative dye donating compounds shown in Table 24B below, respectively.

TABLE 24B

| Light-Sensitive Material | Cyan Dye Donating Compound | Magenta Dye Donating Compound | Yellow Dye Donating Compound |
|---|---|---|---|
| 100 | Cyan Dye Donating Compound (1) (10.3)<br>Cyan Dye Donating Compound (2) (7.2) | Magenta Dye Donating Compound (1) (16.3) | Yellow Dye Donating Compound (1) (9.8) |
| 101 | Cyan Dye Donating Compound (3) (13.4)<br>Cyan Dye Donating Compound (2) (5.5) | Magenta Dye Donating Compound (1) (16.3) | Yellow Dye Donating Compound (1) (9.8) |
| 102 | Cyan Dye Donating Compound (4) (15.7)<br>Cyan Dye Donating Compound (2) (5.5) | Magenta Dye Donating Compound (1) (16.3) | Yellow Dye Donating Compound (1) (9.8) |
| 103 | Cyan Dye Donating Compound (5) (11.5)<br>Cyan Dye Donating Compound (2) (7.2) | Magenta Dye Donating Compound (1) (16.3) | Yellow Dye Donating Compound (1) (9.8) |
| 104 | Cyan Dye Donating Compound (6) (13.9)<br>Cyan Dye Donating Compound (2) (5.5) | Magenta Dye Donating Compound (1) (16.3) | Yellow Dye Donating Compound (1) (9.8) |
| 105 | Cyan Dye Donating Compound (1) (17.2) | Magenta Dye Donating Compound (1) (16.3) | Yellow Dye Donating Compound (1) (9.8) |
| 106 | Cyan Dye Donating Compound (3) (19.1) | Magenta Dye Donating Compound (1) (16.3) | Yellow Dye Donating Compound (1) (9.8) |
| 107 | Cyan Dye Donating Compound (4) (22.4) | Magenta Dye Donating Compound (1) (16.3) | Yellow Dye Donating Compound (1) (9.8) |
| 108 | Cyan Dye Donating Compound (5) (19.1) | Magenta Dye Donating Compound (1) (16.3) | Yellow Dye Donating Compound (1) (9.8) |
| 109 | Cyan Dye Donating Compound (6) (19.9) | Magenta Dye Donating Compound (1) (16.3) | Yellow Dye Donating Compound (1) (9.8) |
| 110 | Cyan Dye Donating Compound (1) (10.3)<br>Cyan Dye Donating Compound (2) (7.2) | Magenta Dye Donating Compound (1) (16.3) | Yellow Dye Donating Compound (2) (12.3) |
| 111 | Cyan Dye Donating Compound (1) (10.3)<br>Cyan Dye Donating Compound (2) (7.2) | Magenta Dye Donating Compound (1) (8.2)<br>Magenta Dye Donating Compound (2) (7.1) | Yellow Dye Donating Compound (1) (9.8) |
| R101 | Cyan Dye Donating Compound (2) (7.3)<br>Cyan Dye Donating Compound (7) (10.8) | Magenta Dye Donating Compound (1) (16.3) | Yellow Dye Donating Compound (1) (9.8) |
| R102 | Cyan Dye Donating Compound (2) (18.3) | Magenta Dye Donating Compound (1) (16.3) | Yellow Dye Donating Compound (1) (9.8) |
| R103 | Cyan Dye Donating Compound (7) (18.0) | Magenta Dye Donating Compound (1) (16.3) | Yellow Dye Donating Compound (1) (9.8) |

Cyan Dye Donating Compound (3):

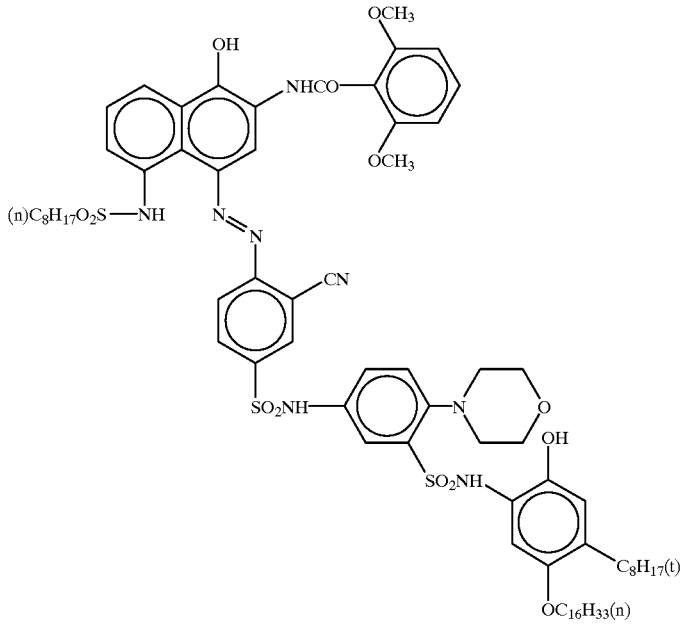

TABLE 24B-continued
| Light-Sensitive Material | Cyan Dye Donating Compound | Magenta Dye Donating Compound | Yellow Dye Donating Compound |
|---|---|---|---|
Cyan Dye Donating Compound (4):
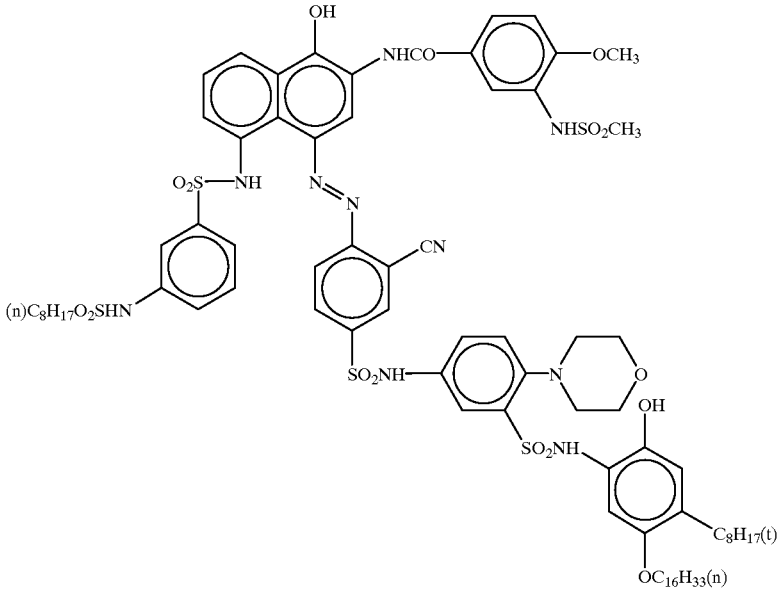
Cyan Dye Donating Compound (5):
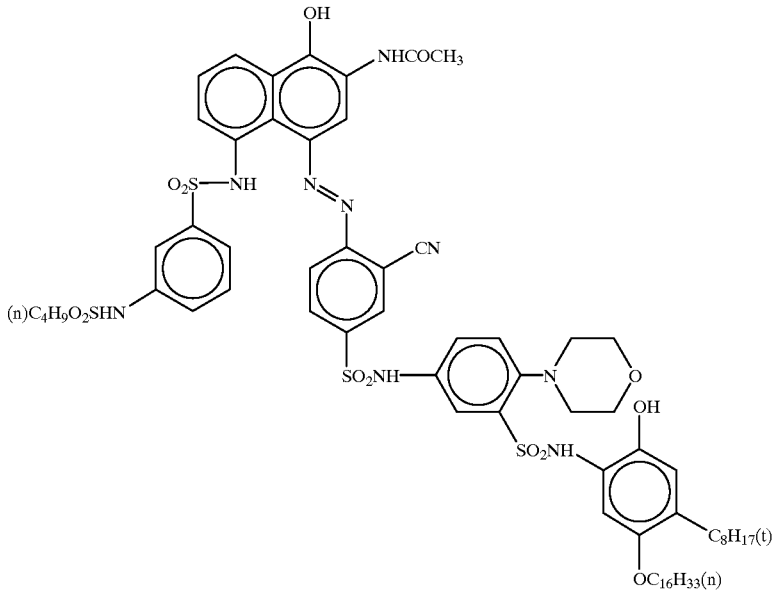

TABLE 24B-continued
| Light-Sensitive Material | Cyan Dye Donating Compound | Magenta Dye Donating Compound | Yellow Dye Donating Compound |
|---|---|---|---|
Cyan Dye Donating Compound (6):
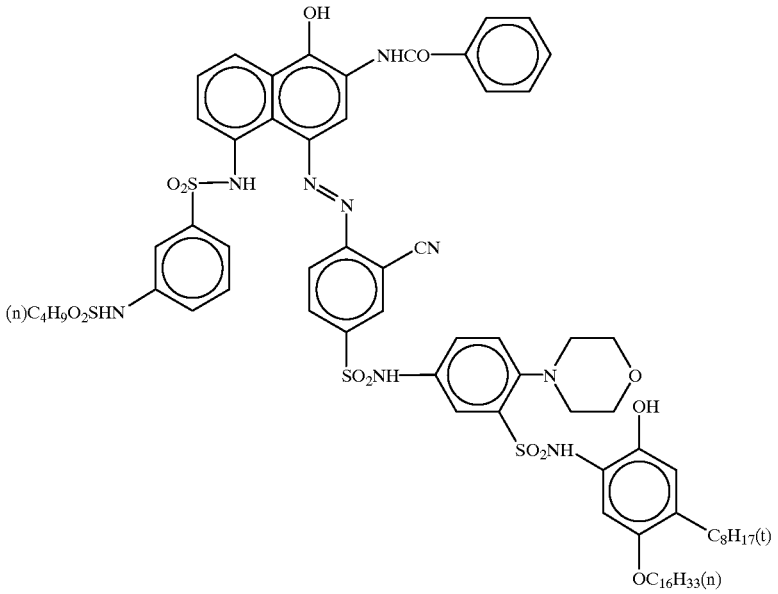
Cyan Dye Donating Compound (7):
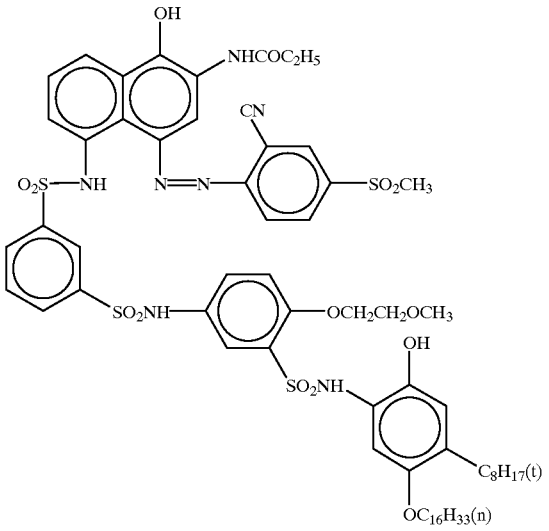

TABLE 24B-continued

| Light-Sensitive Material | Cyan Dye Donating Compound | Magenta Dye Donating Compound | Yellow Dye Donating Compound |
|---|---|---|---|

Magenta Dye Donating Compound (2):

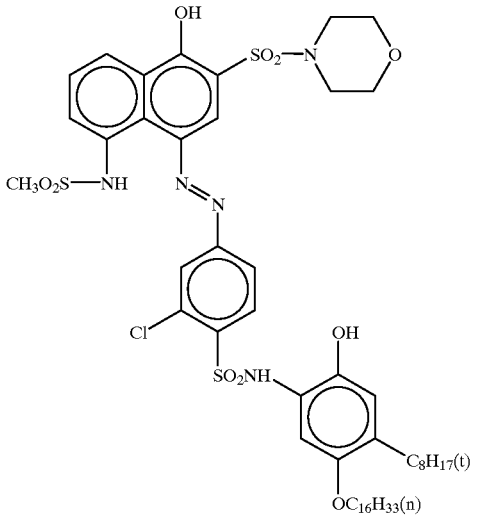

Yellow Dye Donating Compound (2):

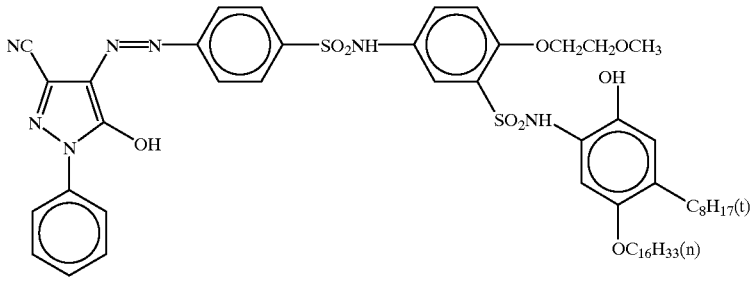

Sensitizing Dye 4:

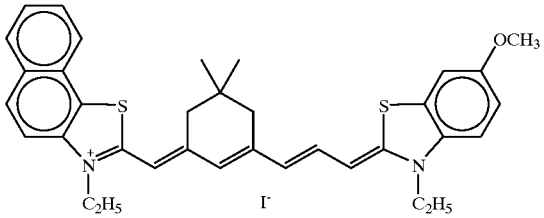

An image was output under the standard condition using each of Light-Sensitive Materials 101 to 112 according to the present invention and Light-Sensitive Materials R101 to R103 for comparison, and Image Receiving Material M101 by means of a digital color printer (Fujix Pictrography PG-3000 manufactured by Fuji Photo Film Co., Ltd.). The output image was a standard color chart (proof chart) for lithography. The output image was subjected to light irradiation test in a xenon light fading tester (Weather-Ometer 65WRC manufactured by ATLAS Co., Ltd.) in an irradiation amount of 85,000 lux for 14 days. The xenon irradiation was conducted intermittently in order to prevent heating of the image surface due to the irradiation.

Color image densities before and after the xenon irradiation was measured by a densitometer (X-Rite 310TR manufactured by Nippon Heihan Kizai Co., Ltd.) with a Status A filter. The measurement was conducted at a black portion in the image, and a change in cyan density of the black portion was determined for evaluation. The results obtained are shown in Table 25B below.

Also, with each output image, density of the black portion was measured using the above described densitometer, and evaluated with visual density.

Further, with each output image, dependency on a light source was investigated. Illumination light sources (observation light sources) used for observation were a standard D65 light source, a tungsten CIEA light source and a fluorescent lamp F-6 light source.

A gray portion of the output sample was visually observed from a low density part to a high density part under illumination with each of these light sources, and a change in color tone of gray was evaluated according to the following classification:

x: a large change in gray tone was observed depending on the kind of light source o: a small change in gray tone was observed depending on the kind of light source ⊙: no change in gray tone was observed depending on the kind of light source The results obtained are also shown in Table 25B below.

TABLE 25B

| Light-Sensitive Material | Change in Cyan Density before and after Xenon Irradiation | Image Density of Black Portion | Change in Gray Tone depending on Kind of Observation Light Source | Remarks |
|---|---|---|---|---|
| 100 | 0.91 | 2.45 | ⊙ | Invention |
| 101 | 0.92 | 2.42 | ⊙ | Invention |
| 102 | 0.92 | 2.43 | ⊙ | Invention |
| 103 | 0.90 | 2.50 | ⊙ | Invention |
| 104 | 0.91 | 2.40 | ⊙ | Invention |
| 105 | 0.94 | 2.45 | o | Invention |
| 106 | 0.94 | 2.42 | o | Invention |
| 107 | 0.94 | 2.45 | o | Invention |
| 108 | 0.92 | 2.45 | o | Invention |
| 109 | 0.93 | 2.44 | o | Invention |
| 110 | 0.91 | 2.45 | o | Invention |
| 111 | 0.90 | 2.45 | o | Invention |
| 112 | 0.91 | 2.44 | ⊙ | Comparison |
| R101 | 0.76 | 2.44 | ⊙ | Comparison |
| R102 | 0.73 | 2.05 | x | Comparison |
| R103 | 0.83 | 2.10 | x | Comparison |

From the results shown in Table 25B, it can be seen that Light-Sensitive Materials 100 to 112 according to the present invention have the futures in that fading of the image due to light irradiation is small and thus light fastness of the image is good, in that a high image density is obtained, and in that a change in gray tone depending on the kind of light source is small is compared with Light-Sensitive Materials R101 to R103 for comparison.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one silver halide layer and said silver halide layer or different layer containing at least one image forming compound represented by the following formula (1A) or (1B):

$$(\text{Dye}-\text{X})_q-\text{Y} \quad (1A)$$

wherein Dye represents a dye moiety containing one or more dyes or precursors thereof represented by the formula (2) or (3) shown below; X represents a mere bond or linking group which is dissociated corresponding to or inversely corresponding to the development of the photographic light-sensitive material; Y represents a group having a property of causing difference in the diffusibility of dye components corresponding to or inversely corresponding to the reaction of a light-sensitive silver salt having imagewise a latent image; Dye bonds to X at the position of at least one of $R^2$, $R^3$, $R^4$ and $W^1$ in the formula (2) or at least one of $R^5$ and $W^2$ in the formula (3); and q represents 1 or 2 and when q is 2, the Dye-X groups may be the same or different, (2)

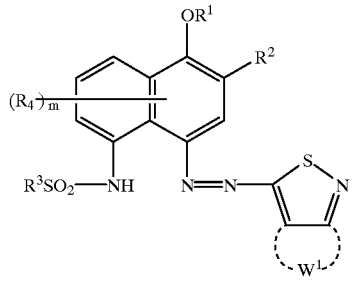

(3)

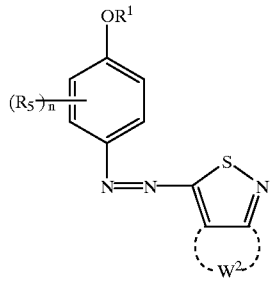

wherein $R^1$ represents a hydrogen atom, a monovalent cation or a group capable of being hydrolyzed; $R^2$ represents an acylamino group, a carbamoyl group, a sulfamoyl group, a ureido group or an alkoxycarbonylamino group; $R^3$ represents an alkyl group or an aryl group; $R^4$ represents a hydrogen atom or a substituent; $R^5$ represents a hydrogen atom or a substituent; m represents an integer of from 0 to 4; n represents an integer of from 0 to 4 and when n is 2 to 4, two $R^5$ groups may be bonded each other to form a saturated or unsaturated ring, provided that a case wherein the ring formed is a naphthalene ring is excluded; $W^1$ represents an atomic group necessary to form a 5-membered or 6-membered ring, provided that case wherein the ring formed is a benzene ring is excluded; and $W^2$ represents an atomic group necessary to form a 5-membered or 6-membered ring;

$$(\text{Dye}'-\text{X})_q-\text{Y} \quad (1B)$$

wherein Dye' represents a dye moiety containing one or more cyan dyes or precursors thereof represented by the formula (4) shown below; X represents a mere bond or a linking group; Y represents a group which is capable of releasing Dye' corresponding to or inversely corresponding to the reaction of a light-sensitive silver salt having imagewise a latent image and has a property of causing difference in the diffusibility between the Dye' released and the compound of $(\text{Dye}'-\text{X})_q-\text{Y}$; q represents 1 or 2 and when q is 2, the Dye'-X groups may be the same or different; and X bonds to Dye' at the benzene ring to which B is bonded, (4)

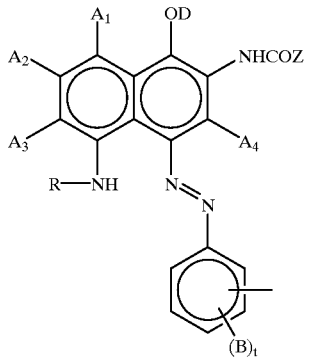

wherein $A^1$, $A^2$, $A^3$ and $A^4$ each represents a hydrogen atom, a cyano group, a carboxyl group, a sulfo group, a halogen atom, an alkyl group, an aryl group, a heterocyclic group, an acyl group, a sulfonyl group, an alkoxy group, an aryloxy group, a heteroaryloxy group, a silyloxy group, an alkylthio group, an arylthio group, a heteroarylthio group, a carbamoyl group, a sulfamoyl group, an acylamino group, a sulfonylamino group, an alkoxycarbonyloxyamino group, an aryloxycarbonylamino group, an alkoxycarbonyloxy group, an aryloxycarbonyloxy group, an aminocarbonylamino group, an aminocarbonyloxy group, an aminosulfonylanino group, a carbamoyloxy group, an amino group, an alkoxycarbonyl group, an aryloxycarbonyl group, an acyloxy group or a sulfonyloxy group; R represents an acyl group, a sulfonyl group, an alkoxycarbonyl group, an aryloxycarbonyl group, an aminocarbonyl group or an aminosulfonyl group; D represents a hydrogen atom or a protective group of a hydroxy group which is released upon the action of a nucleophilic reagent; Z represents a hydrogen atom, an alkyl group, an aryl group, a heterocyclic group or an amino group; B represents a hydrogen atom, an alkylsulfonyl group, a phenylsulfonyl group, a cyano group, a halogen atom or a sulfamoyl group; and *l* represents an integer of from 1 to 4 and when *l* is 2 or more, the B groups may be the same or different.

2. A silver halide photographic light-sensitive material as claimed in claim 1, wherein the image forming compound is a compound represented by the formula (1B) wherein the cyan dye or precursor thereof contained in the dye moiety is represented by the following formula (4'):

(4')

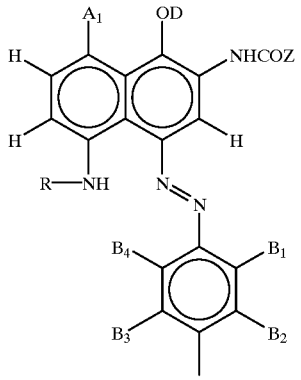

wherein $A^1$ represents a hydrogen atom, a cyano group, a halogen atom, an alkyl group, an alkoxy group, a carbamoyl group, a sulfamoyl group, an acylamino group, a sulfonylamino group, an alkoxycarbonylamino group, an aryloxycarbonylamino group, an aminocarbonylamino group, or an aminosulfonylamino group,; R, D, and Z have the same meanings as those defined in the formula (4), respectively; and $B^1$, $B^2$, $B^3$ and $B^4$ each has the same meaning as B defined in the formula (4).

3. A silver halide photographic light-sensitive material as claimed in claim 1, wherein $R_1$ is a hydrogen atom.

4. A silver halide photographic light-sensitive material as claimed in claim 1, wherein $R^2$ is an acylamino group, a carbamoyl group or a sulfamoyl group.

5. A silver halide photographic light-sensitive material as claimed in claim 1, wherein $R^4$ is a hydrogen atom, a halogen atom, an alkyl group, a cyano group, an alkoxy group, a carbamoyl group, a sulfamoyl group, an acylamino group, a sulfonylamino group, an alkoxycarbonyl group or an alkoxycarbonylamino group.

6. A silver halide photographic light-sensitive material as claimed in claim 1, wherein $R^5$ is a hydrogen atom, a halogen atom, an alkyl group, a cyano group, an alkoxy group, a carbamoyl group a sulfamoyl group, an acylamino group, a sulfonylamino group, an alkoxycarbonyl group or an akoxycarbonylamino group.

7. A silver halide photographic light-sensitive material as claimed in claim 1, wherein $R^4$ is a hydrogen atom.

8. A silver halide photographic light-sensitive material as claimed in claim 1, wherein $R^5$ is an acylamino group which is bonded to the 2-position of the phenol of the dye represented by the formula (3).

9. A silver halide photographic light-sensitive material as claimed in claim 1, wherein $A^1$, $A^2$, $A^3$ and $A^4$ each represents a hydrogen atom, a cyano group, a halogen atom, an alkyl group, an alkoxy group, a carbamoyl group, a sulfamoyl group, an acylamino group, a sulfonylamino group, an aminosulfonylamino group, an alkoxycarbonylamino group, an aryloxycarbonylamino group or an aminocarbonylamino group.

10. A silver halide photographic light-sensitive material as claimed in claim 1, wherein Z is an alkyl group or an aryl group.

11. A silver halide photographic light-sensitive material as claimed in claim 1, wherein B is a hydrogen atom, a methanesulfonyl group, a phenylsulfonyl group, a cyano group, a halogen atom or a sulfamoyl group.

12. A silver halide photographic light-sensitive material as claimed in claim 1, wherein at least one of the B groups is a group having a Hammett's substituent constant sigma para value of 0.3 or more.

13. A silver halide photographic light-sensitive material as claimed in claim 2, wherein $A^1$ is a hydrogen atom, a carbamoyl group or an acylamino group.

14. A silver halide photographic light-sensitive material as claimed in claim 2, wherein R is a sulfonyl group.

15. A silver halide photographic light-sensitive material as claimed in claim 2, wherein z is an alkyl group or an aryl group.

16. A silver halide photographic light-sensitive material as claimed in claim 2, wherein $B^1$, $B^2$, $B^3$ and $B^4$ each represents a hydrogen atom, a methanesulfonyl group, a phenylsulfonyl group, a cyano group, a halogen atom or a sulfamoyl group.

17. A silver halide photographic light-sensitive material as claimed in claim 2, wherein at least one of $B^1$, $B^2$ $B^3$ and $B^4$ is a group having a Hammett's substituent constant sigma para value of 0.3 or more.

* * * * *